US006464586B1

(12) United States Patent
Kamata et al.

(10) Patent No.: US 6,464,586 B1
(45) Date of Patent: Oct. 15, 2002

(54) GAME UNIT

(75) Inventors: Osamu Kamata; Hirobumi Miyauchi; Jyoji Suga; Koji Yamaguchi; Keiji Yano, all of Tokyo (JP)

(73) Assignee: Sega Enterprises, Ltd., Tokyo (JP)

( * ) Notice: Subject to any disclaimer, the term of this patent is extended or adjusted under 35 U.S.C. 154(b) by 0 days.

(21) Appl. No.: 09/400,854

(22) Filed: Sep. 21, 1999

(30) Foreign Application Priority Data

Sep. 21, 1998 (JP) ..... 10-267131

(51) Int. Cl.[7] ..... A63F 9/24
(52) U.S. Cl. ..... 463/46; 463/25
(58) Field of Search ..... 463/1, 11–13, 463/6, 16–20, 25, 30, 36, 46

(56) References Cited

U.S. PATENT DOCUMENTS 4,397,509 A 8/1983 Miller et al.
5,386,903 A 2/1995 Rothschild et al.

FOREIGN PATENT DOCUMENTS

DE 34 45 679 6/1989
EP 0 316 175 5/1989
EP 0 701 849 3/1996
GB 2 265 745 10/1993

*Primary Examiner*—Mark Sager
(74) *Attorney, Agent, or Firm*—Dickstein Shapiro Morin & Oshinsky LLP

(57) ABSTRACT

A structure of a box-like game unit to be arranged in large number outside of and adjacently to a main body of a game machine such as a casino game machine, a horse race game machine, a boat race game machine or the like. The game unit comprises a game unit cabinet of box-shape having a front face and a top face; a display instrument housed in the game unit cabinet having a display surface for displaying progress of game. bet rate, result of game, allotment and the like, the display surface being disposed on the a top face of the game unit cabinet upward; a top door provided at the top face of the game unit cabinet substantially on the same surface as the display surface so as to be opened upward; a machine door hinged on a side of the front face of the game unit cabinet by a hinge so as to be opened in front; a narrow flat space formed between the display instrument and a side wall of the game unit cabinet near the hinge within the game unit cabinet; and a control unit case in shape of a flat parallelepiped disposed in the flat space in an erect posture, the control unit case moving up and down in the flat space to be detachably housed in the flat space from above when the top door is opened.

29 Claims, 45 Drawing Sheets

GAME UNIT

BACKGROUND OF THE INVENTION

The present invention relates to a structure of a box-like game unit to be arranged in large numbers outside of and adjacently to a main body of a game machine such as a casino game machine, a horse race game machine, a boat race game machine or the like.

In a customary box-like game unit, a cash box capable of storing surplus coins resulted from deducting pay-back coins from cast coins (in the following, coin and medal are called coin collectively) is disposed on a bottom of a game unit cabinet, and on the cash box are piled up in order a flat parallelepiped control unit for carrying out controlling necessary to game, a coin pay-back apparatus, and a display apparatus for displaying progress of game, bet rate, result of game, allotment and the like.

The customary game unit has a difficulty that if the display apparatus is made larger it becomes higher and necessarily also the box-like game unit cabinet becomes higher.

If the flat parallelepiped control unit is disposed adjacently to a side wall of the game unit cabinet in an erect posture, a coin inspecting apparatus and a coin return must be disposed adjacently to another side wall of the game unit cabinet. And when a hinge-type machine door is provided at a front face of the game unit cabinet for repair, maintenance and inspection of the control unit, the coin pay-back apparatus, the coin inspecting apparatus and the like, the coin inspecting apparatus which may be repaired or inspected frequently is disposed on a side corresponding to a free end of the machine door, therefore the control unit must be disposed on a side corresponding to the hinge of the machine door.

As a result, in order to take out the control unit from the game unit cabinet, the machine door must be opened beyond 90 degrees.

Players often perform a casino game or a horse race game drinking drinks such as juice and beer. If a player spills the drink on the box-like game unit cabinet, the drink leaks into the game unit cabinet through a gap between an opening part of a top door and a top part of a display instrument to give various instruments in the cabinet a bad influence.

In a machine door hinged on one side of a front face of the game unit cabinet so as to open in front, sometimes a lower edge of the machine door is inclined downward from a hinge side by own weight of the door and the door does not close tightly.

Particularly, in case that a door for taking out a cash box is provided under the machine door, sometimes the lower edge of the machine door interferes with the cash box take out door to prevent smooth opening and closing of the cash box take out door.

In a game unit cabinet having a top face on which a top door is provided so as to be opened upward, since the top door is wide and heavy enough, spring force of a gas spring for letting the top door spring up when a locking mechanism of the top door is unlocked must be increased against own weight and inertia force of the top door acting in the closing direction. However, the increased spring force of the gas spring undesirebly lets the top door spring up vigorously when the top door is unlocked.

In a customary game unit in which players pay bet moneys of game by bills, a bill receiving apparatus is disposed on a front face of the game unit cabinet, therefore it is difficult to insert bills in a bill slot of the bill receiving apparatus because players must crouch in a half-sitting posture and there is high possibility that unfairness is acted behind back of the game unit cabinet.

SUMMARY OF THE INVENTION

The present invention relates to an improvement of the game unit for a game machine which overcomes the aforementioned difficulties.

The present invention provides a game unit to be arranged outside of and adjacently to a game machine main, comprising: a game unit cabinet of box-shape having a front face and a top face; a display instrument housed in the game unit cabinet having a display surface for displaying progress of game, bet rate, result of game, allotment and the like, the display surface being disposed on the top face of the game unit cabinet upward; a top door provided at the top face of the game unit cabinet substantially on the same surface as the display surface so as to be opened upward; a machine door hinged on a side of the front face of the game unit cabinet by a hinge so as to be opened in front; a narrow flat space formed between the display instrument and a side wall of the game unit cabinet near the hinge within the game unit cabinet; and a control unit case in shape of a flat parallelepiped disposed in the flat space in an erect posture, the control unit case moving up and down in the flat space to be detachably housed in the flat space from above when the top door is opened.

According to this invention, the flat parallelepiped control unit case can be housed compactly in the narrow flat space formed between the display instrument and the side wall of the game unit cabinet near the hinge within the game unit cabinet so that the game unit cabinet can be miniaturized. In addition, the control unit case can be easily taken out and in through an opening formed by the top door opened upward.

The top door may be formed with an opening for the display instrument which is fitted to a circumference of the display instrument. The displayed picture of the display instrument can be watched directly and contents of the displayed picture can be easily and correctly recognized visually.

A vertical guide rail may be provided on an inner surface of the side wall of the game unit cabinet near the hinge, and a slide member going up and down guided by the guide rail may be provided on an outer surface of the control unit case. The control unit case can be housed in the game unit cabinet stably and taken out and in surely without collision with other instruments and parts.

A handle for pulling up the control unit case against its weight may be provided on a top of the control unit case. Taking out and in of the control unit case can be performed easily by holding the handle.

The present invention provides also, a game unit to be arranged outside of and adjacently to a game machine main, comprising: a game unit cabinet of box-shape having a front face and a top face; a display instrument housed in the game unit cabinet having a display surface for displaying progress of game, bet rate, result of game, allotment and the like, the display surface being disposed on the top face of the game unit cabinet upward; a top door provided at the top face of the game unit cabinet substantially on the same surface as the display surface so as to be opened upward; a machine door hinged on a side of the front face of the game unit cabinet by a hinge so as to be opened in front; a narrow flat space formed between the display instrument and a side wall of the game unit cabinet near the hinge within the game unit cabinet; a control unit case in shape of a flat parallelepiped disposed in the flat space in an erect posture; a control substrate with electronic control parts necessary for operation of the game unit housed in the control unit case; an opening formed in a front face of the control unit case for taking in and out the control substrate along a flat face of the control unit case; and a closing member formed on a front edge of the control substrate integrally for closing the opening when the control substrate is housed in the control unit case.

According to this invention, in a state that the control unit case is housed in the game unit cabinet, the control substrate with electronic control parts alone can be taken out and in easily through the opening of the front face to perform efficiently exchange, repair. inspection and the like of the electronic control parts.

Grooves of V-shape in plan may be formed at respective upper and lower parts on a rear side in the control unit case, for holding respective upper and lower edges on a rear side of the control substrate. The control substrate can be installed easily in the control unit case and held stably at a predetermined position in the control unit case.

A locking mechanism for maintaining the control substrate in a state housed in the control unit case may be provided. Unjust exchange of ROM etc. in the control unit case can be prevented previously.

The present invention provides further, a game unit to be arranged outside of and adjacently to a game machine main, comprising: a game unit cabinet of box-shape having a front face and a top face; a display instrument housed in the game unit cabinet having a display surface for displaying progress of game, bet rate, result of game, allotment and the like, the display surface being disposed on the top face of the game unit cabinet upward; a top door provided at the top face of the game unit cabinet substantially on the same surface as the display surface so as to be opened upward; a liquid receiving trough member surrounding and adhered to the display instrument; a liquid receptacle detachably provided in the game unit cabinet positioned under the liquid receiving trough member and the top door closed; and a pipe connecting a lowermost part of the liquid receiving trough member with the liquid receptacle.

According to the invention, even if a player spills a drink on the display instrument or the top door, the drink is prevented from entering into the game unit cabinet so that trouble or damage of the game unit can be avoided surely.

The liquid receptacle may be disposed just under the closed top door. The liquid receptacle can be taken out of the game unit cabinet easily so that the liquid in the liquid receptacle can be discharged easily.

The display surface of the display instrument may be inclined so as to lower toward front from rear. Contents of displays of the display instrument can be easily recognized visually and the liquid receptacle can be disposed on the front side so as to be taken out easily.

Further, the present invention provides, a game unit to be arranged outside of and adjacently to a game machine main, comprising: a game unit cabinet of box-like having a front face and a top face; a display instrument housed in the game unit cabinet having a display surface for displaying progress of game, bet rate, result of game, allotment and the like, the display surface being disposed on the top face of the game unit cabinet; a top door provided at the top face of the game unit cabinet substantially on the same surface as the display surface so as to be opened upward; a machine door hinged on a side of the front face of the game unit cabinet by a hinge so as to be opened in front; and a door guide piece formed along a lower edge of the machine door gently curved upward toward rear, the door guide piece coming into sliding contact with a middle bottom member of the game unit cabinet adjacent to a lower edge of the machine door when the machine door is opened and closed.

In this game unit, even if the machine door is deformed downward in a parallelogram by its own weight, the deformation of the machine door is corrected by the door guide piece so that the machine door can be opened and closed smoothly.

An opening and closing member other than the machine door may be provided under and adjacently to the machine door so as to be opened in front. Since the deformation of the machine door is corrected, movement of the opening and closing member is not obstructed.

The present invention provides moreover, a game unit to be arranged outside of and adjacently to a game machine main, comprising: a game unit cabinet of box-like having a front face and a top face; a display instrument housed in the game unit cabinet having a display surface for displaying progress of game, bet rate, result of game, allotment and the like, the display surface being disposed on the top face of the game unit cabinet; a top door provided at the top face of the game unit cabinet substantially on the same surface as the display surface so as to be opened upward; a gas spring having both ends respectively connected to the game unit cabinet and the top door; and an oil buffer mechanism provided on the game unit cabinet so as to be contacted with the top door when the top door is on or near a closing position thereof.

In this game unit, the top door having a heavy own weight can be closed lightly and fast from an open state and when the top door approaches a close position, the top door can be closed softly.

The top door may be hinged on a rear edge of the game unit cabinet so as to open upward and close downward. Since the top door is opened with the front side lifted, inspection of various instruments within the game unit cabinet can be performed easily.

The present invention provides, a game unit to be arranged outside of and adjacently to a game machine main, comprising: a game unit cabinet of box-shape having a front face and a top face; a display instrument housed in the game unit cabinet having a display surface for displaying progress of game, bet rate, result of game, allotment and the like, the display surface being disposed on the top face of the game unit cabinet upward; a bill receiving apparatus positioned on one side of the display instrument; a top face member of the game unit cabinet covering upper surfaces of the display instrument and the bill receiving apparatus having an opening through which an upper portion of the bill receiving apparatus is exposed; a lid member for opening and shutting the opening; and a locking mechanism for locking the lid member.

According to the game unit, only a specific person with a key can release the locking mechanism, open the lid member and expose the bill receiving apparatus upward for performing repair, maintenance and inspection of the bill receiving apparatus.

The rear edge of the lid member may be hinged on the game unit cabinet so as to be opened upward. The person with the key can observe or touch the bill receiving apparatus from the front side of the game unit cabinet without being obstructed by the lid member, therefore repair, maintenance or inspection of the bill receiving apparatus can be performed easily without moving the game unit cabinet at all.

The top face member of the game unit cabinet and the lid member may be constructed so as to open and close about a common pivotal axis. The top face member and the lid member can open and close separately without interfering with each other.

The bill receiving apparatus may be provided with a lifting mechanism by which the bill receiving apparatus can be lifted for repair, maintenance, inspection and the like when the lid member is opened. Since the bill receiving apparatus can be lifted by the lifting mechanism to be exposed enough, repair, maintenance, inspection etc. can be performed easily and surely.

The bill receiving apparatus may comprise an upper bill inspecting section and a lower bill storing section which are separable from each other. Repair, maintenance or inspection works of the bill inspection section and the bill storing section can be performed separately.

The bill receiving apparatus may be lifted in two steps by the lifting mechanism so as to take two lift positions of which a second lift position can be taken by unlocking a locking mechanism other than the locking mechanism of the lid member, thereby the bill inspecting section can be separately taken out from the game unit cabinet at a first lift position of the bill receiving apparatus, and the bill storing section can be separately taken out from the game unit cabinet at the second lift position of the bill receiving apparatus. Only a service man with a key allowing the first step lift can perform repair, maintenance and inspection of the bill inspecting section which is apt to cause troubles or bill jamming, and only an owner of the game machine or a responsible person with a key or keys allowing both first and second step lifts can take out bills from the bill storing section in which a large number of bills are stored. Therefore, administration of bills can be performed safely and surely.

The present invention provides moreover, a game unit to be arranged outside of and adjacently to a game machine main, comprising: a game unit cabinet of box-shape having a front face and a top face; a display instrument housed in the game unit cabinet having a display surface for displaying progress of game, bet rate, result of game, allotment and the like, the display surface being disposed on the top face of the game unit cabinet upward; a handle provided on a rear face of the game unit cabinet; a plurality of wheels provided on a bottom face near the rear face of the game unit cabinet so as to roll in front and in the rear; and a caster provided on a bottom face near the front face of the game unit cabinet so as to roll in every direction.

According to the game unit, a work man can move the box-like game unit cabinet on a fat floor in a required direction easily. When the cabinet approaches a step, the workman holds the handle on a rear face of the cabinet to incline the cabinet rearward so that the cabinet can ride across the step.

The present invention provides further, a game unit to be arranged outside of and adjacently to a game machine main, comprising: a game unit cabinet of box-shape having a front face and a top face; a display instrument housed in the game unit cabinet having a display surface for displaying progress of game, bet rate, result of game, allotment and the like, the display surface being disposed on the top face of the game unit cabinet upward; a top door provided at the top face of the game unit cabinet substantially on the same surface as the display surface so as to be opened upward; a channel-like attachment member fixed to the top door or the game unit cabinet; a rise and fall member fitted to the attachment member so as to rise and fall; an adjust screw provided between the rise and fall member and the top door or the game unit cabinet; an engage member fixed to the rise and fall member; and a hook member detachably engaging with the engage member provided on the game unit cabinet or the top door.

According to the game unit, closing position of the top door relating to the game unit cabinet can be adjusted very easily and surely.

The hook member may be combined with a locking means so as to be disconnected from the engage member when the locking means is unlocked. Since only a person having a key can unlock the locking means, various instruments in the game unit cabinet can be prevented from theft, damage or mischief.

In addition, the present invention provides a guard apparatus of a game unit having a game unit cabinet, comprising: a door switch for detecting opening-closing of a door provided in the game unit cabinet; a display means for displaying information of opening closing of the door; a first watch means for watching state of the door switch when electricity is transmitted from a main electric source; a second watch means for watching state of the door switch when electricity from the main electric source is cut off; a signal holding means for holding a detection signal when the second watch means detects an open state of the door switch to generate the detection signal; a battery for supplying the second watch means and the signal holding means with electric power, and a display control means for letting the display means display a special display in case that the signal holding means holds the detection signal when electricity is transmitted from the main electric source.

According to the guard apparatus, if the door opens during electricity is transmitted from the main electric source, the first watch means detects opening of the door switch and lets the display means display opening of the door. If the door opens during electricity from the main electric source is cut off or electricity fails, the second watch means operated by the battery detects opening of the door switch, the signal holding means operated by the battery holds the detection signal, and the display control means lets the display means display the special display to warn that the door was opened during electricity failure.

Thus, opening-closing of the door can be watched for warning round the clock.

In the guard apparatus, the game unit cabinet may have a plurality of doors provided with respective door switches, and the first and second watching means may watch states of the door switches. States of the door switches are watched by the first watch means during electricity is transmitted and by the second watch means during electricity fails, so that when at least one door is opened during electricity is transmitted the display means displays that the door is opened, and in case that at least one door is opened during electricity failure the display means displays the special display when electricity is transmitted again to warn that the door was opened during electricity failure.

By arranging any one of the above-mentioned game units around a game machine main in large numbers, a compact game machine can be obtained.

DETAILED DESCRIPTION OF PREFERRED EMBODIMENT OF THE INVENTION

Figure 1:
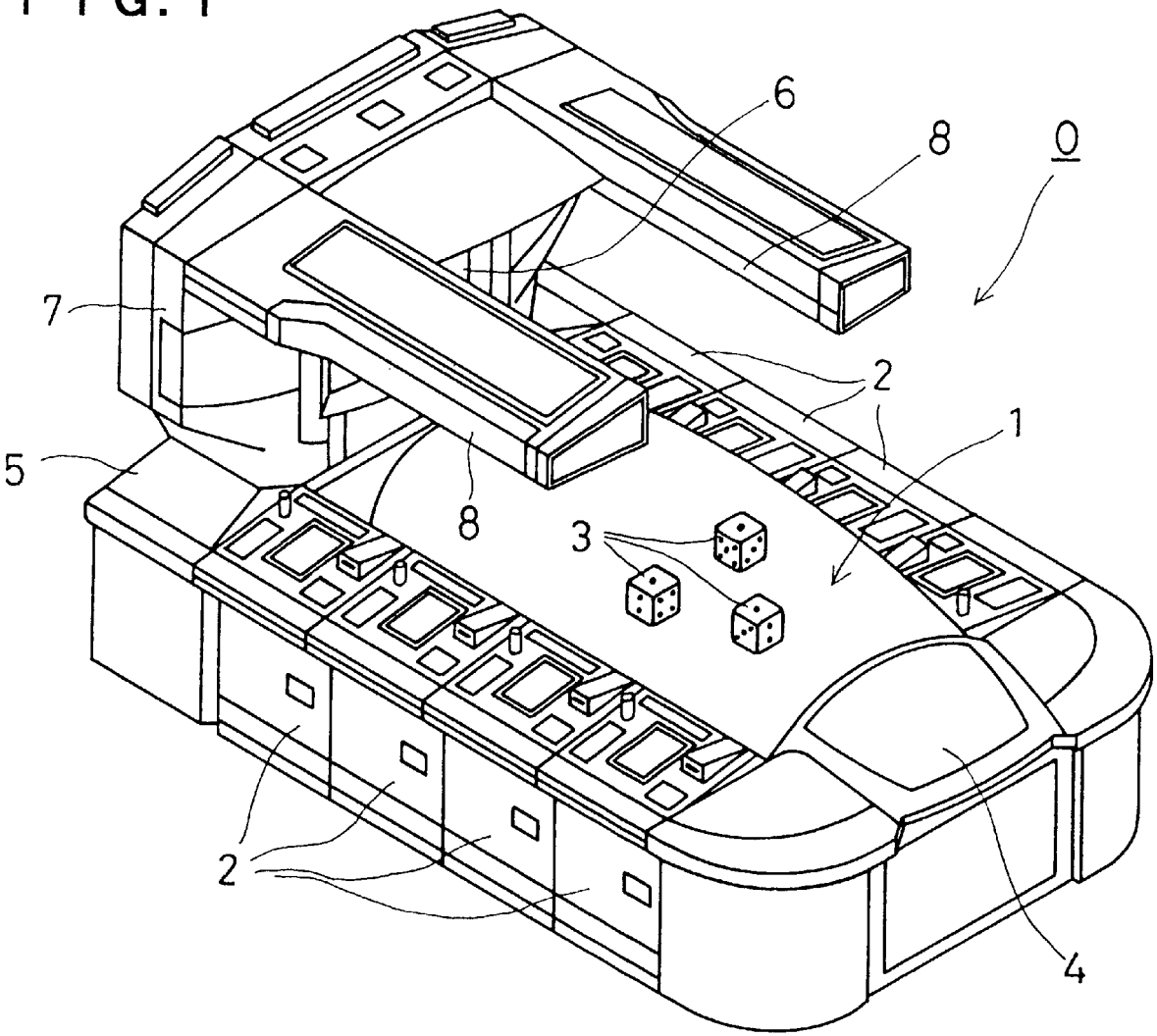
FIG. 1 is an entire perspective view of a casino game machine having game units according to the present invention.
Figure 2:
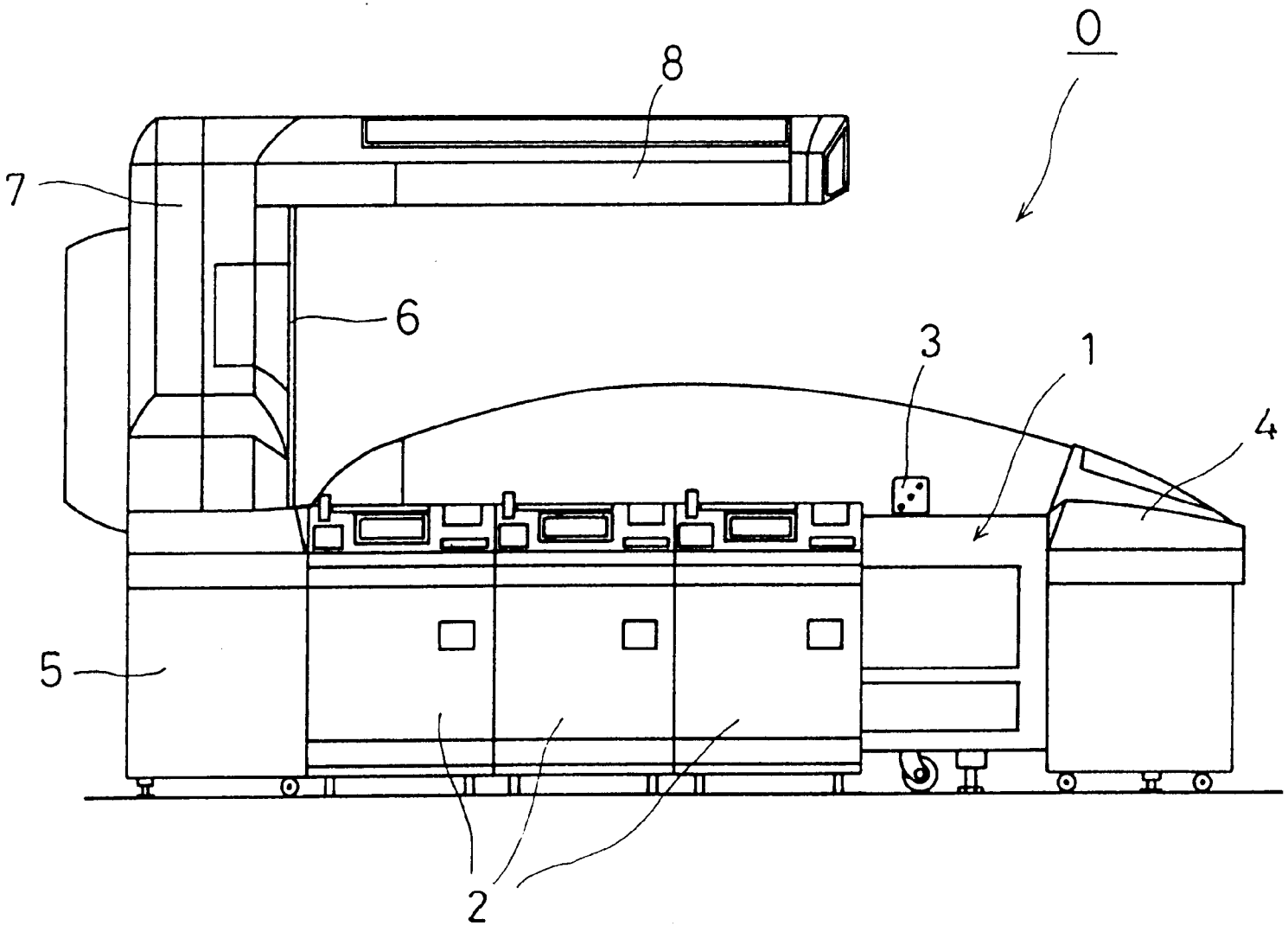
FIG. 2 is a side view of FIG. 1.

Hereinafter, a preferred embodiment of the present invention will be described with reference to the drawings.

In this embodiment, the present invention is applied to a casino game machine 0. The casino game machine 0 comprises a casino game machine main 1, box-like game units 2 which are arranged on both sides of the game machine main 1 four by four, a dice shooting apparatus 4 for throwing dice 3 disposed on one side of the game machine main 1 and the game units 2, a game control apparatus 5 disposed on another side of the game machine main 1 and the game units 2 for controlling the casino game machine 0 as a whole, a display apparatus 6 erected on the game control apparatus 5, and a lighting apparatuses 8 extending from tops of supports 7 provided on both sides of the display apparatus 6. Each of the dice 3 is made of soft plastics and has rounded edges and corners. Three dice 3 are thrown on a top face of the game machine main 1 by the dice shooting apparatus 4.

Players stand in front of respective game units 2, predict total number of pips of the dice 3, combination of the pips or the like before the dice 3 are thrown, and put bills or coins into the game unit 2. After all players have paid bets, the dice 3 are thrown by the dice shooting apparatus 4, and if the prediction comes true, coins are paid at the corresponding game unit 2.

The game unit 2 has a box-like game unit cabinet 9 which is shaped nearly in a vertically long parallelepiped as shown in FIGS. 3 to 8. A top face member or a top door 10 of the game unit cabinet 9 is inclined down from a rear side toward a front side and has a armrest 11 projecting horizontally at the front side. A rear edge of the top door 10 is hinged on a top edge of a back plate 9*a* of the game unit cabinet 9 by a hinge 58 so as to rock up and down.

Figure 12:
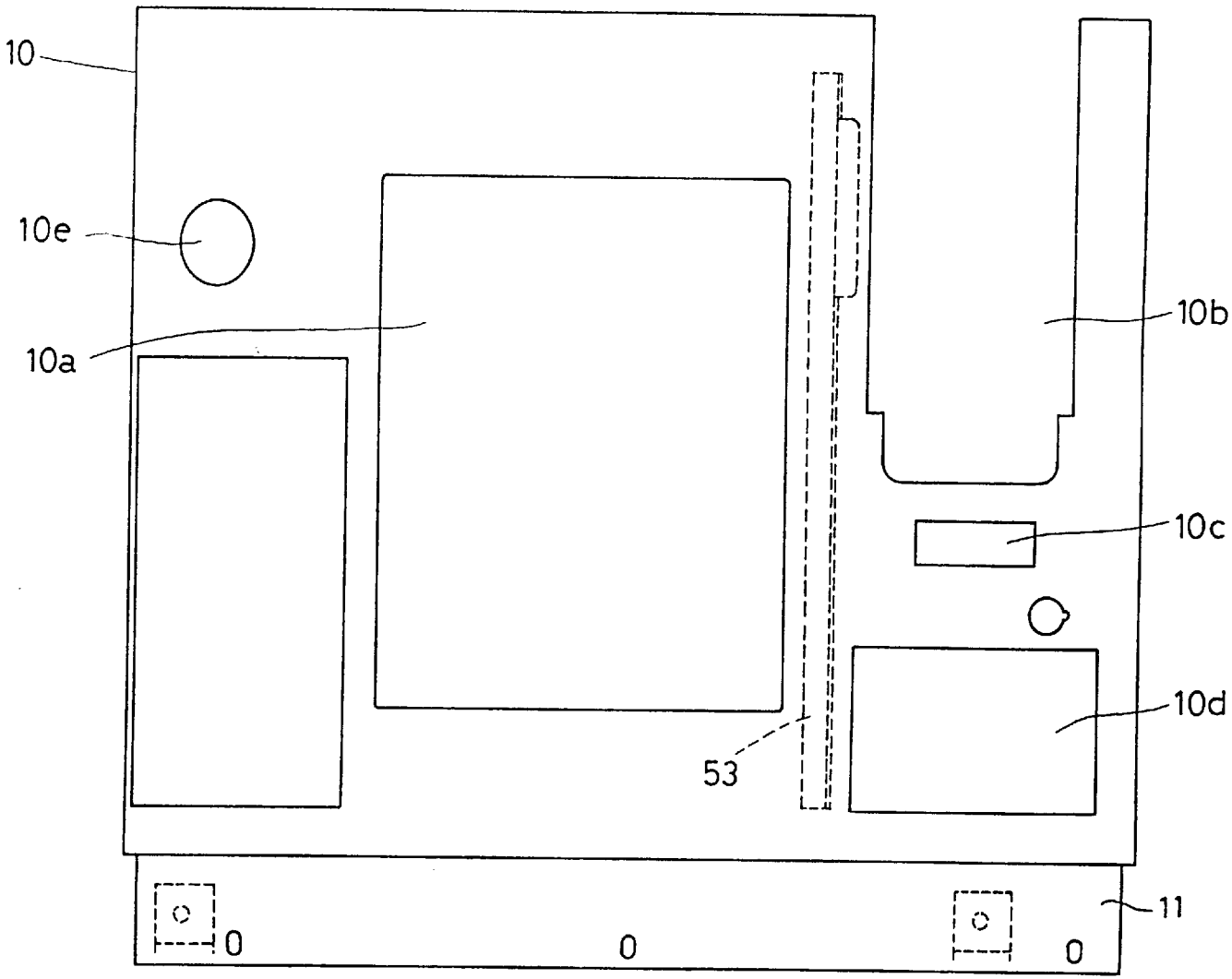
FIG. 12 is a plan view of a top door.

As shown in FIG. 12, the top door 10 is formed with a display opening 1*a* to which a display section 12*a* of a CRT display apparatus 12 can be loosely fitted. Further, on the right side of the top door 10 is formed a cut 10*b* to which an upper part of a bill receiving apparatus 13 can be loosely fitted, in front of the cut 10*b* is formed a coin slot 10*c*, and in front of the coin slot 10*c* is formed an opening 10*d* adapted to house a coin return section 14. On the left side of the top door 10 is provided a pit 10*e* for attaching an indication light 15.

Figure 9:
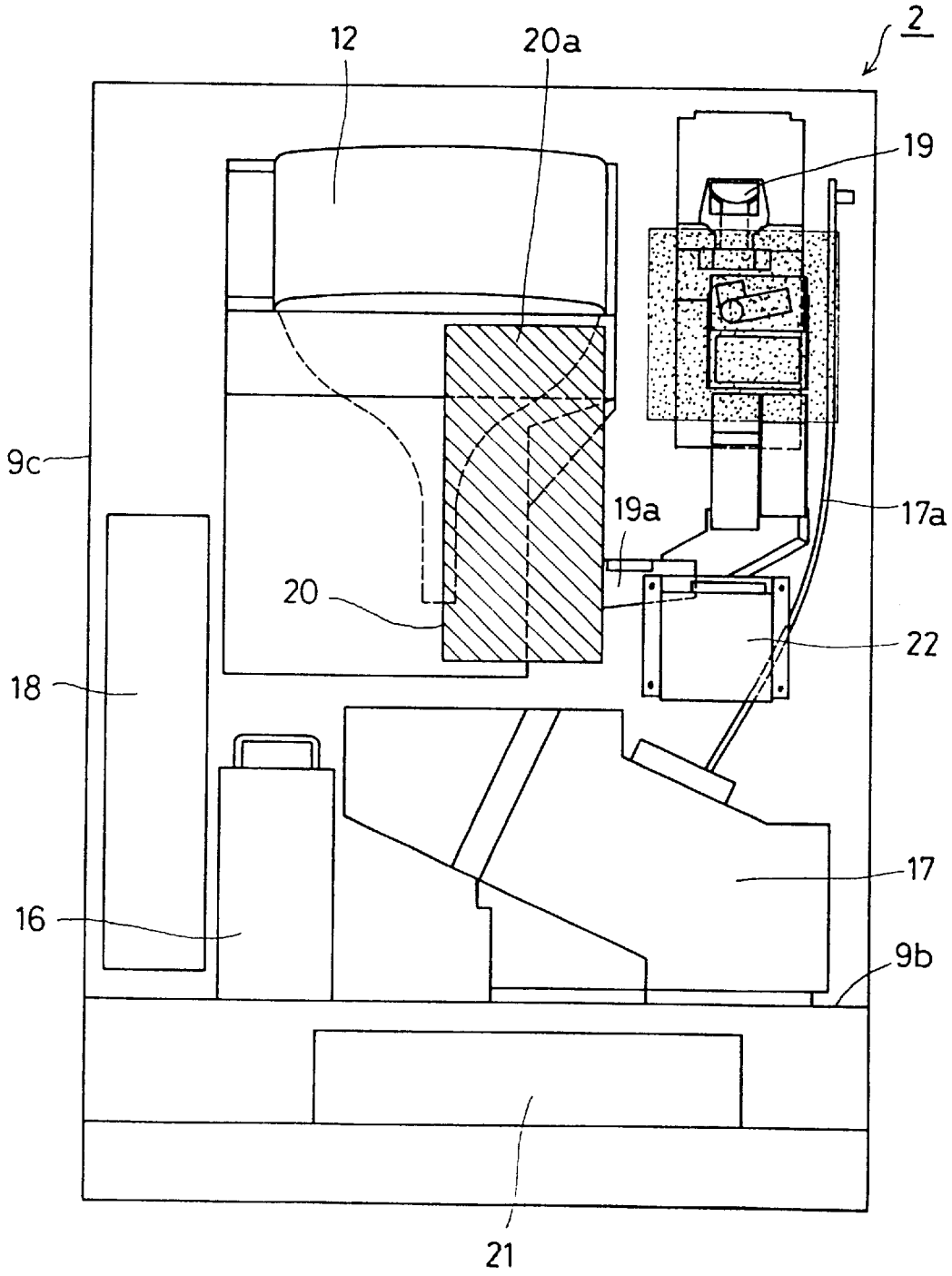
FIG. 9 is a front view showing arrangement of instruments in the game unit.
Figure 10:
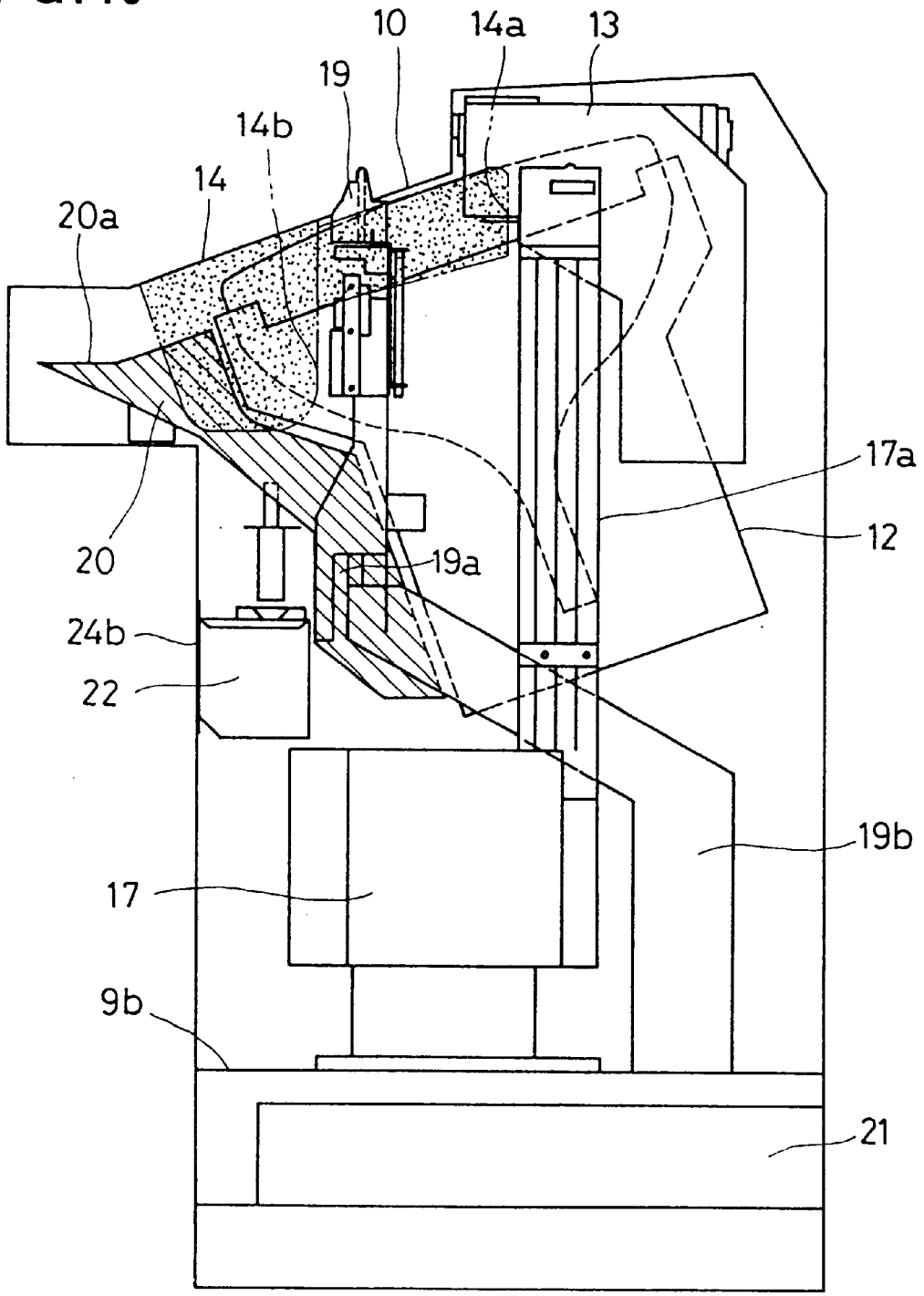
FIG. 10 is a right side view of FIG. 9.
Figure 11:
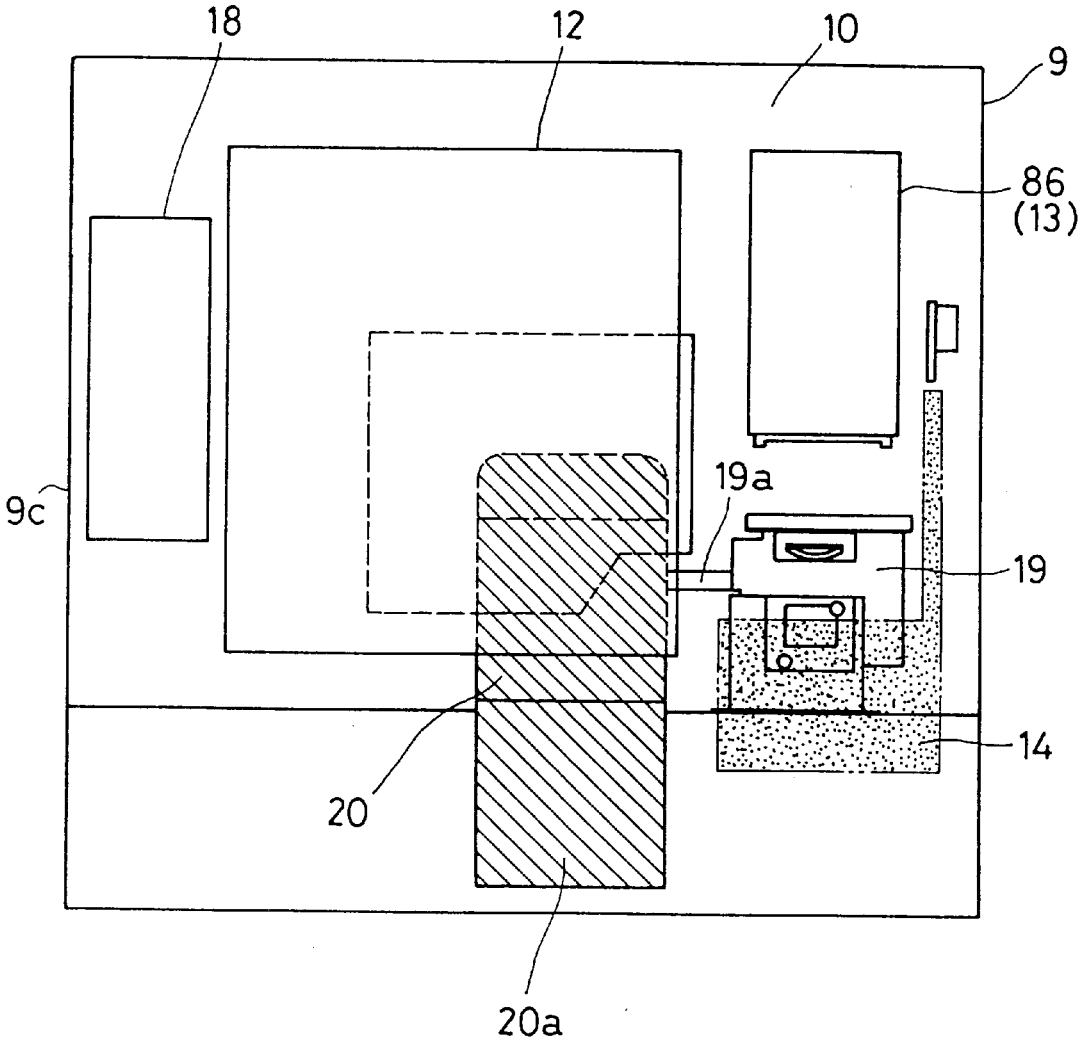
FIG. 11 is a plan view of FIG. 9.

Within the game unit cabinet 9, as shown in FIGS. 9 to 11, under the CRT display apparatus 12 are disposed an electric power unit 16 on the left and a coin pay-back apparatus 17 on the right. The electric power unit 16 and the coin pay-back apparatus 17 are installed on a middle bottom plate 9*b* of the game unit cabinet 9. Between the CRT display apparatus 12 as well as the electric power unit 16 and a left side plate 9*c* of the game unit cabinet 9 is disposed a flat parallelepiped control unit case 18. On the right rear side of the coin pay-back apparatus 17 is disposed the bill receiving apparatus 13 with its upper part exposed above the top door 10, and a coin inspecting apparatus 19 is disposed in front of the bill receiving apparatus 13. Further in front of the coin inspecting apparatus 19 is disposed the coin return section 14. An upper end of a coin shoot 17*a* of the coin pay-back apparatus 17 is connected to a coin guide section 14*a* on rear side of the coin return section 14, so that coins are sent to the coin guide section 14*a* from the coin pay-back apparatus 17 through the coin shoot 17*a* and supplied to a saucer 14*b* on front side of the coin return section 14.

At an upper part in the game unit 9 and in front of the CRT display apparatus 12 is disposed an opening 20*a* of a coin supplement shoot 20 having a lower part opened above the coin pay-back apparatus 17. When the coin payoff apparatus 17 is in short of coin and the shortage is indicated, an administrator of the casino game machine 0 can put a large number of coins into the coin pay-back apparatus 17 through the opening 20*a* at the upper end of the coin supplement shoot 20 to supplement coins.

A lower portion of the coin inspecting apparatus 19 is bifurcated in two branch shoots. A branch shoot 19*a* (FIG. 11) is opened to the coin supplement shoot 20, and another branch shoot 19*b* (FIG. 10) passes behind the coin pay-back apparatus 17, penetrates the middle bottom plate 9*b* of the game unit 9 and opens above a cash box 21 below the middle bottom plate 9*b*. A switchover apparatus (not shown) is provided at the bifurcated portion, so that when the coin pay-back apparatus 17 is full of coin, normal coins put into the coin inspecting apparatus 19 are guided to the cash box 21 through the branch shoot 19*b*, and when the coin pay-back apparatus is not full of coin, normal coins put into the coin inspection apparatus 19 are supplemented in the coin pay-back apparatus 17 through the branch shoot 19*a* and the coin supplement shoot 20.

When a coin put into the coin inspecting apparatus 19 is an abnormal one, the abnormal coin does not supplied to the branch shoots 19*a*, 19*b* and discharged to a coin return 22.

Figure 3:
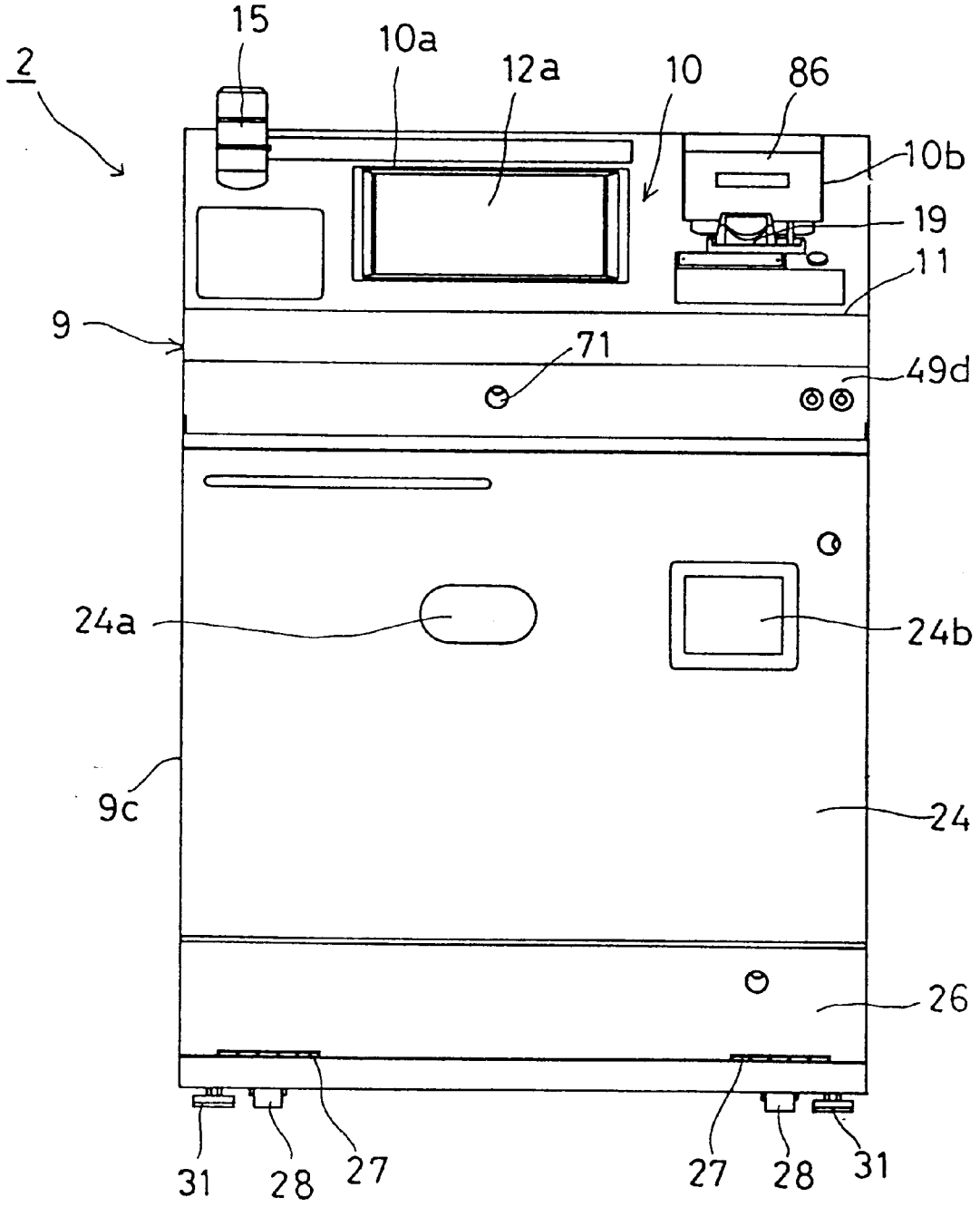
FIG. 3 is a front view of a game unit shown in FIG. 1.
Figure 4:
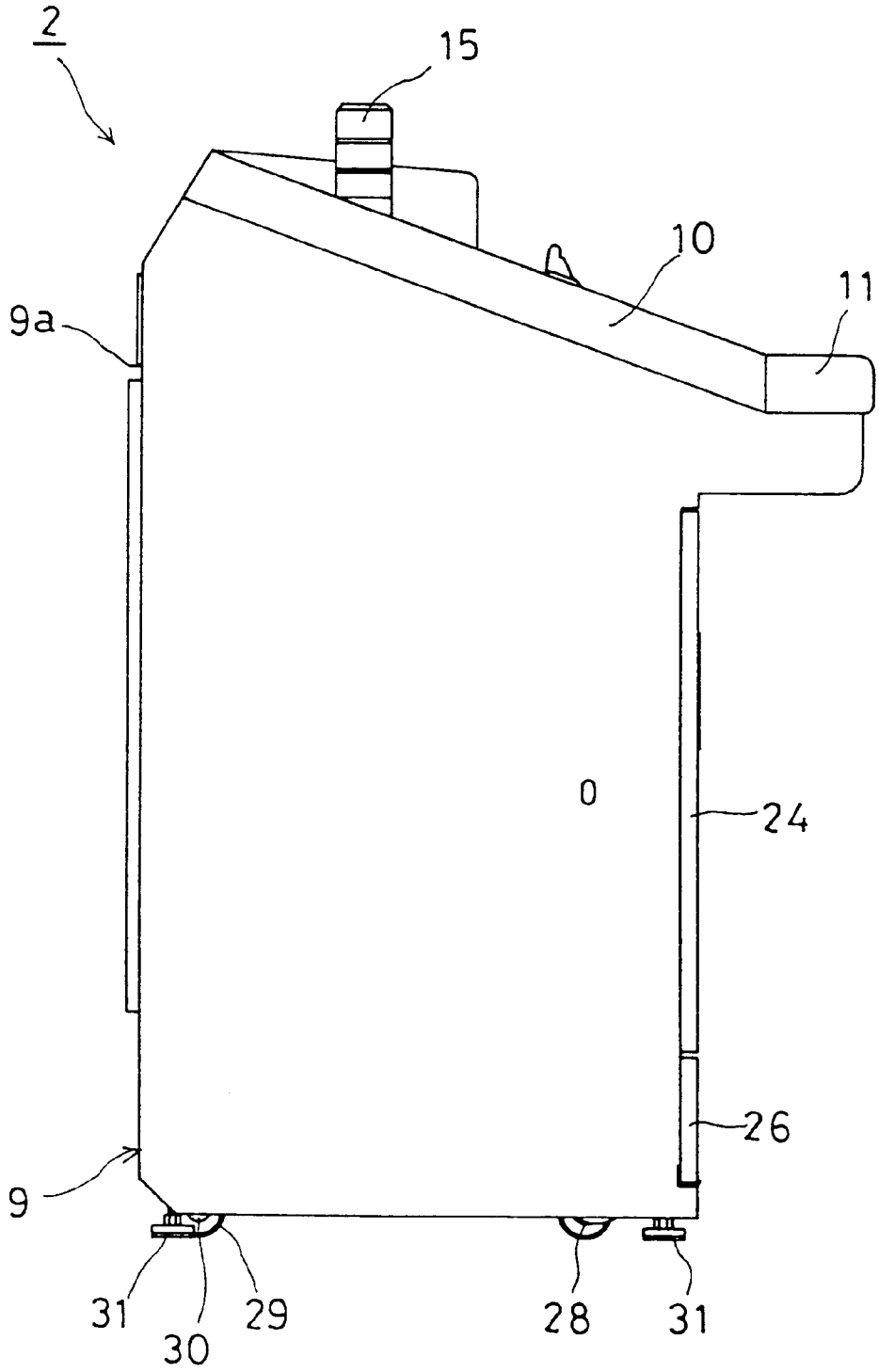
FIG. 4 is a left side view of the game unit.
Figure 5:
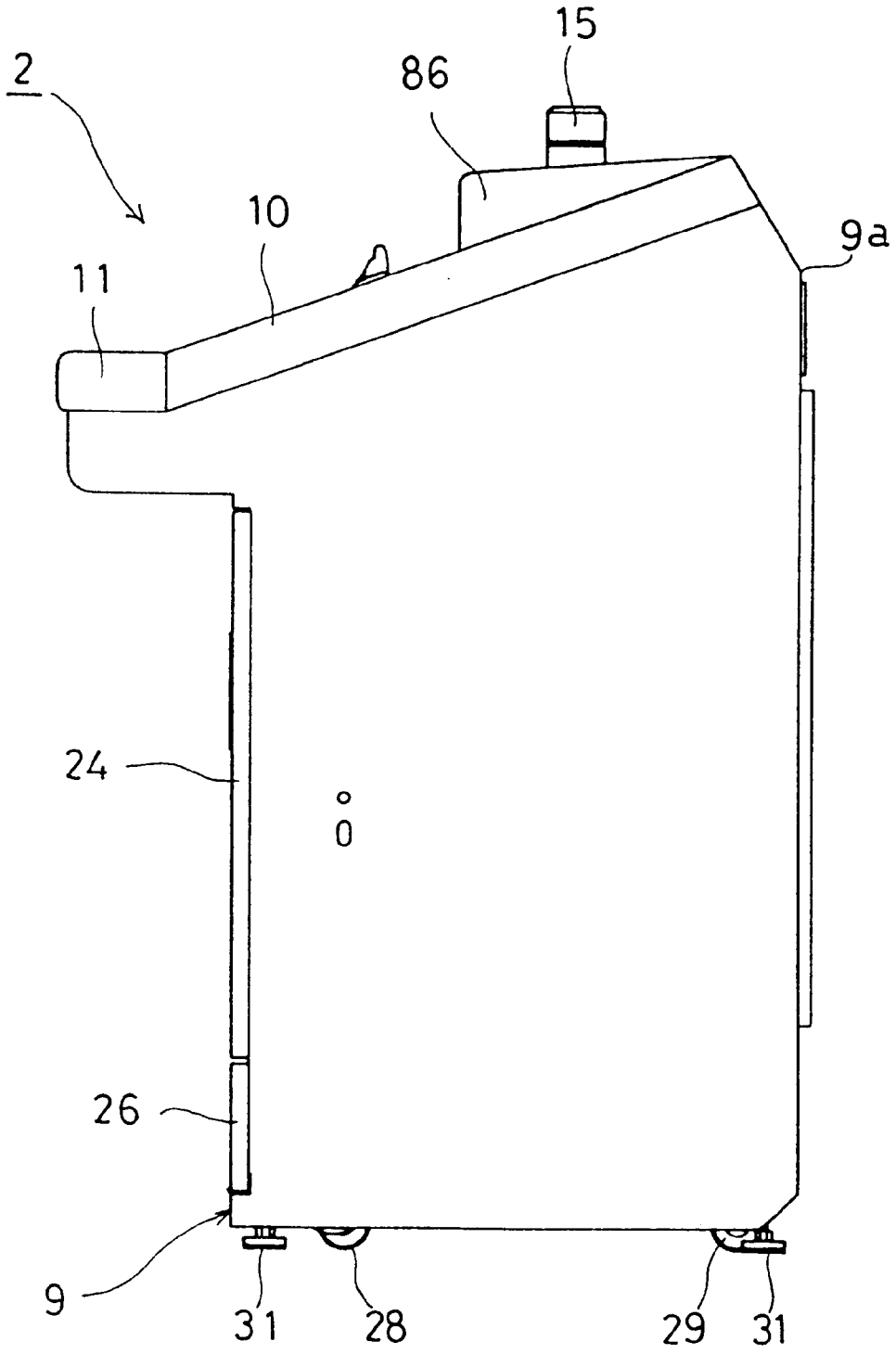
FIG. 5 is a right side view of the game unit.
Figure 6:
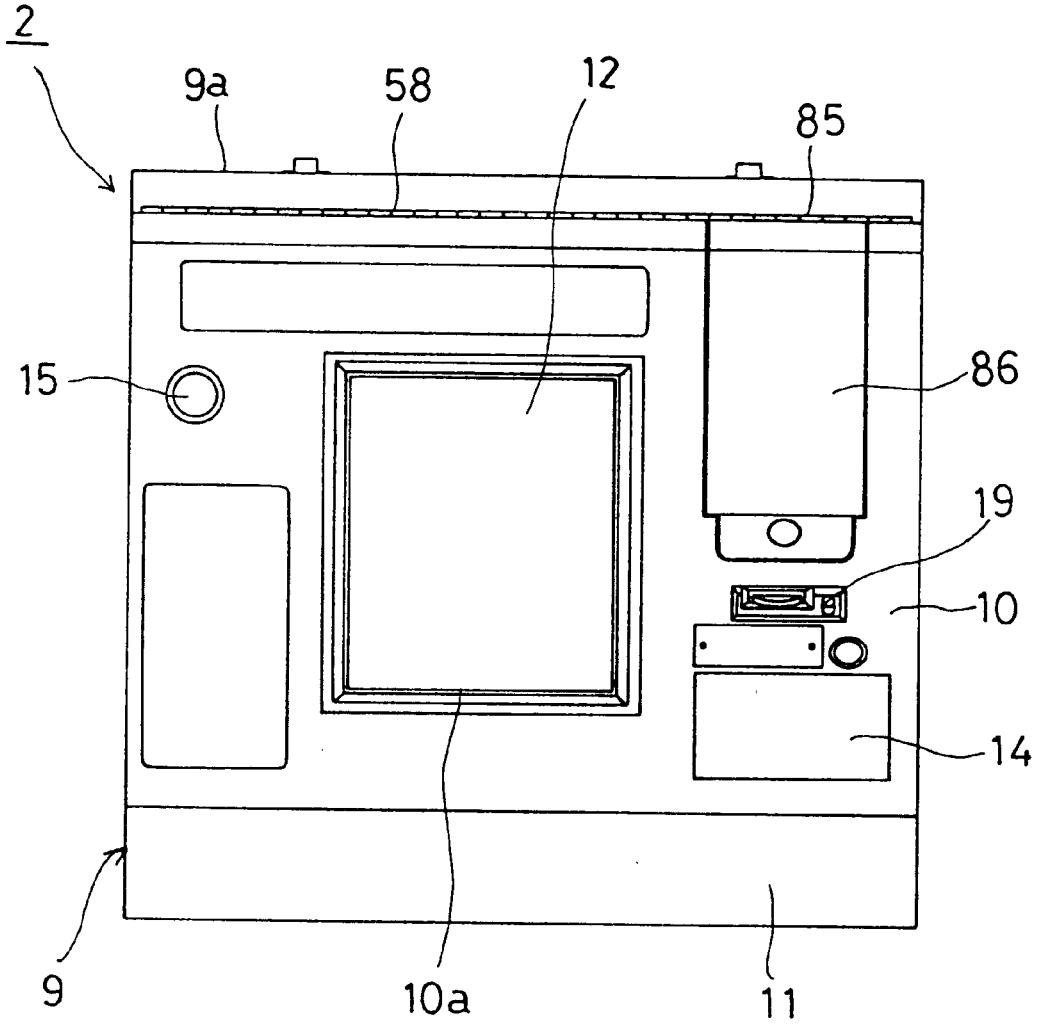
FIG. 6 is a plan view of the game unit.
Figure 7:
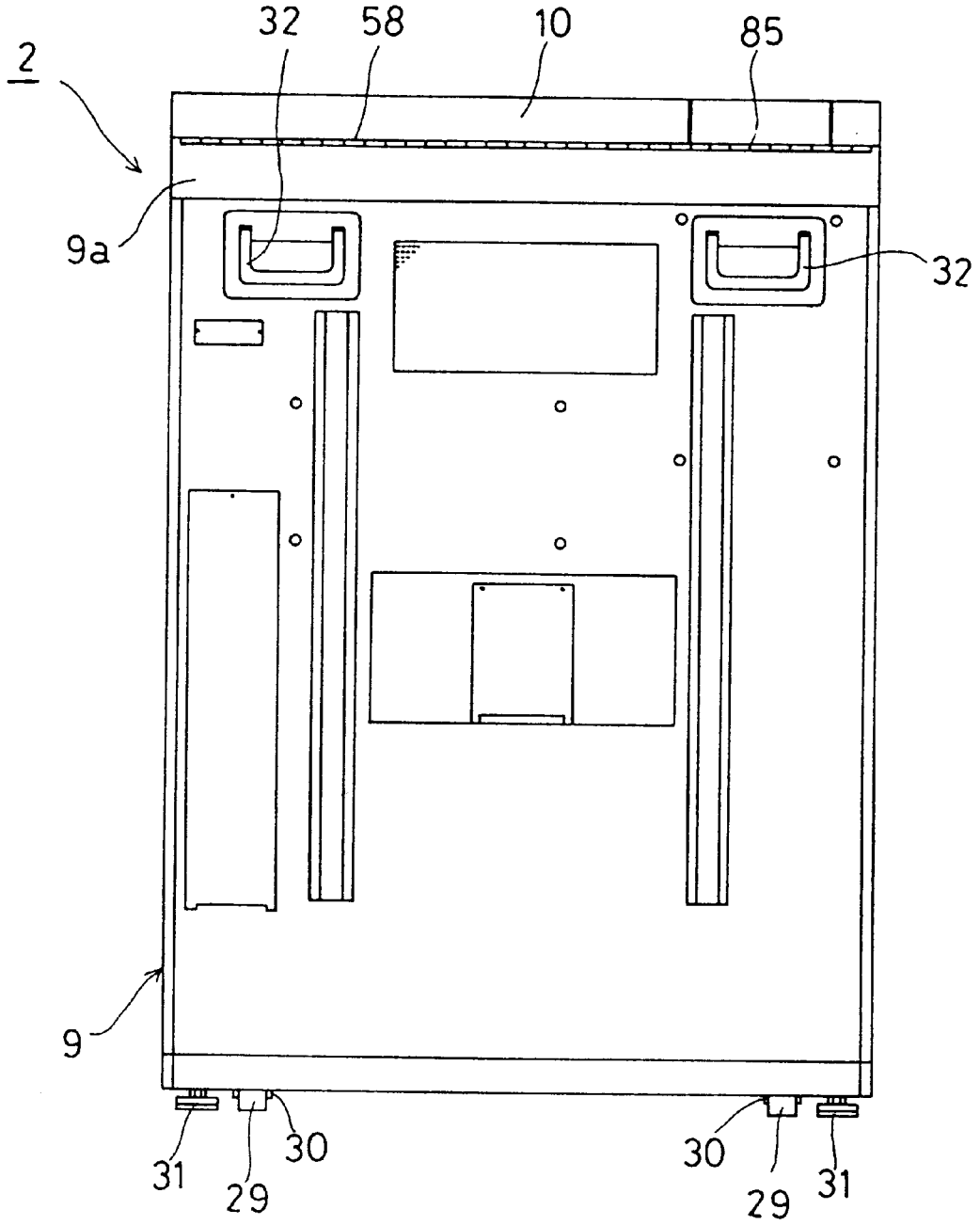
FIG. 7 is a rear view of the game unit.
Figure 8:
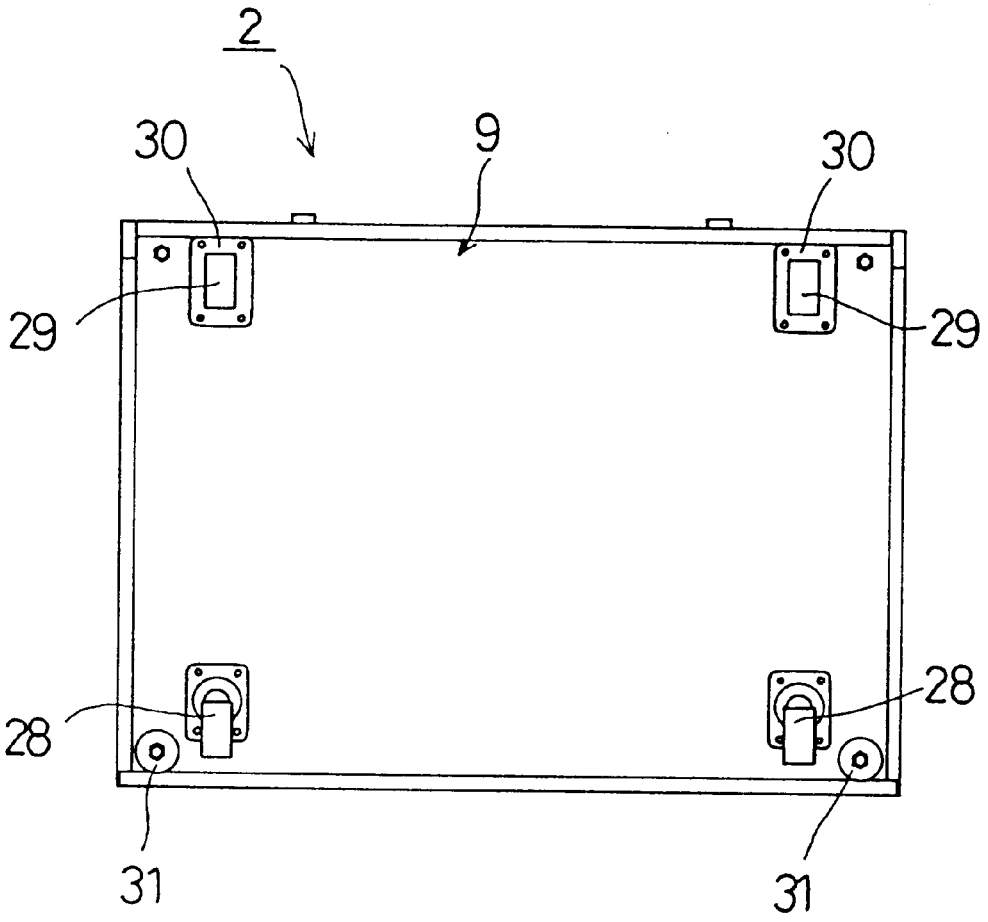
FIG. 8 is a bottom view of the game unit.
Figure 13:
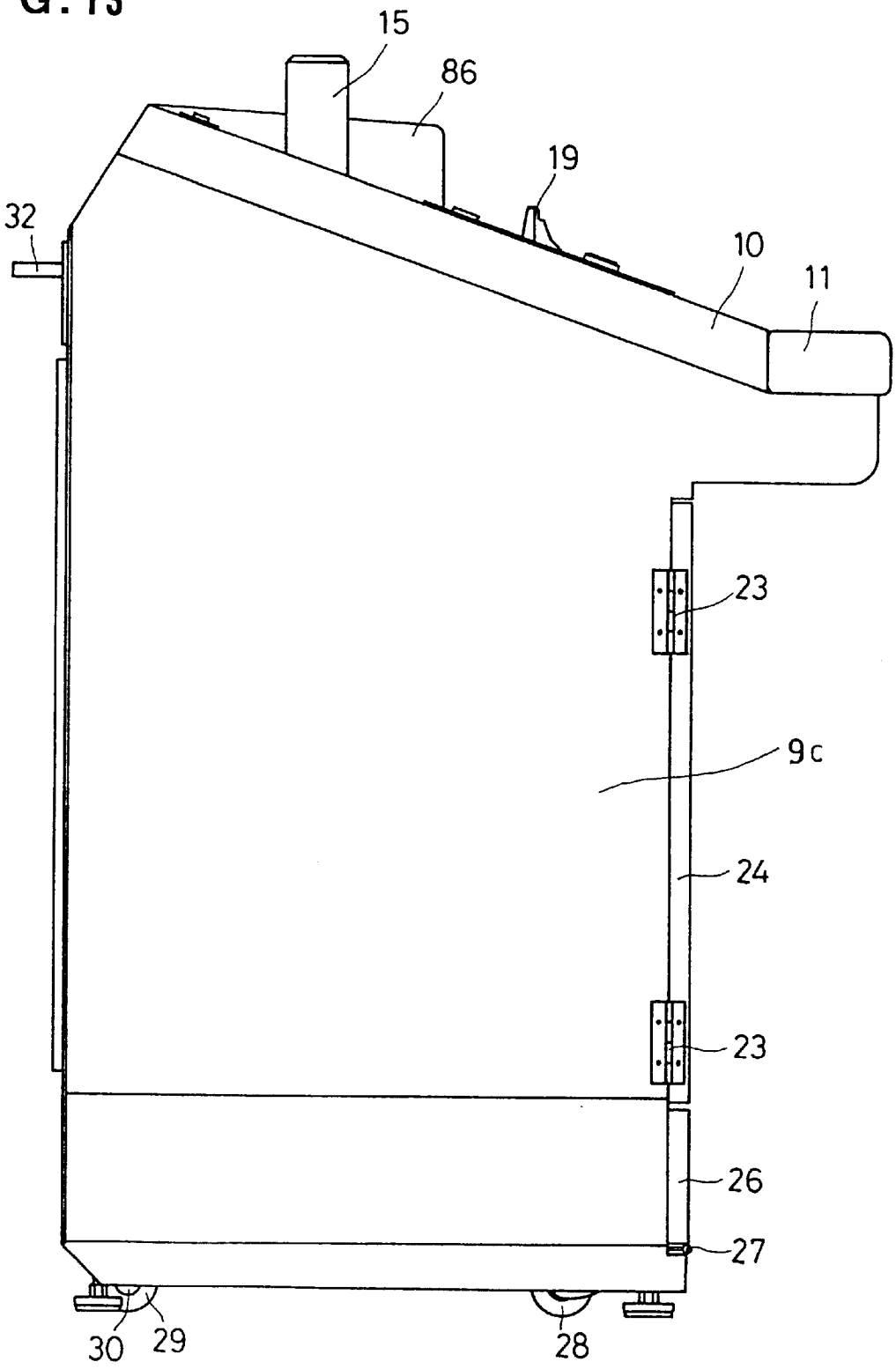
FIG. 13 is a side view showing the game unit in more detail than FIG. 4.
Figure 14:
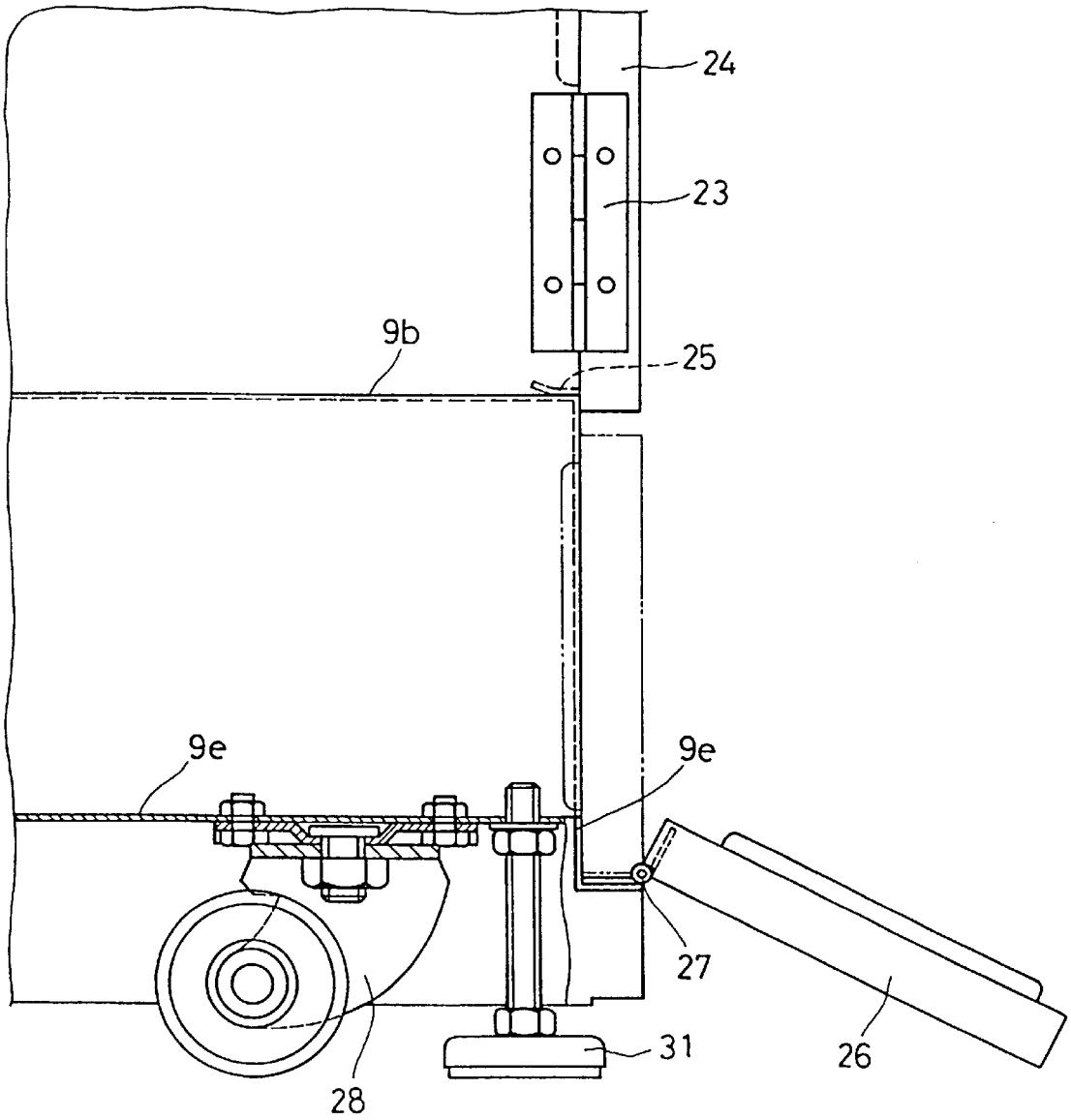
FIG. 14 is an enlarged sectional side view showing a part of FIG. 13.

As shown in FIGS. 3, 13, 14, a machine door 24 is hinged on a front edge of the left side plate 9*c* of the game unit cabinet 9 by hinges 23. At a nearly central portion of the machine door 24 is formed a sound opening 24*a* for conducting sound generated by a speaker (not shown) in the game unit cabinet 9, and a return opening 24*b* communicating with the above-mentioned coin return 22 is formed on the right side of the sound opening 24*a*. Along a lower edge of the machine door 24 is formed a machine door guide piece 25 gently curved upward toward rear (FIG. 14). Positioned below the machine door 24, a lower edge of a cash box door 26 is hinged on a bottom plate 9*e* of the game unit cabinet 9 by a hinge 27 so as to be opened in front. The cash box 21 is housed in a space between the middle bottom plate 9*b* and the bottom plate 9*e*, as shown in FIGS. 9, 10. Even if the machine door 24 is deformed in a parallelogram by its own weight with the right side part hung down, the machine door 24 is corrected by the door guide piece 25 into a rectangle, so that the machine door 24 does not interfere with the cash box door 26 and both the doors 24, 26 can be opened and closed smoothly.

As shown in FIG. 14, at both right and left ends of front side of the bottom plate 9*e* are attached casters 28 which freely turn on vertical axes, and as shown in FIGS. 4, 5, 7, 8, at both right and left ends of rear side of the bottom plate 9*e* are attached wheels 29 pivoted on brackets 30. In neighborhoods of the caster 28 and the wheel 29 are screwed fixing stud bolts 31 which are shortened when the cabinet 9 is moved and lengthened when the cabinet 9 is installed. And at upper right and left parts of the back plate 9*a* of the cabinet 9 are attached grip handles 32 so as to appear and disappear.

The flat parallelepiped control unit case 18 constructed as shown in FIGS. 17 to 22 has a front plate 18*a* with an opening 18*b* formed (FIG. 17), and a closing plate 34 somewhat larger than the opening 18*b* is fixed at right angle to a front edge of a control substrate 33 which has control parts attaching plates 35*a*, 35*b*, 35*c* disposed in parallel with each other. On the control parts attaching plates 35*a*, 35*b*, 35*c* are attached electronic parts such as IC, IC memory and the like (not shown), so that transmission and receiving of signals are carried out between the game control apparatus 5 of the casino game machine 0 and the control substrate 33, necessary pictures are displayed on the CRT display apparatus 12 by signals from the control substrate 5, and the coin pay-back apparatus 15 is operated.

Figure 17:
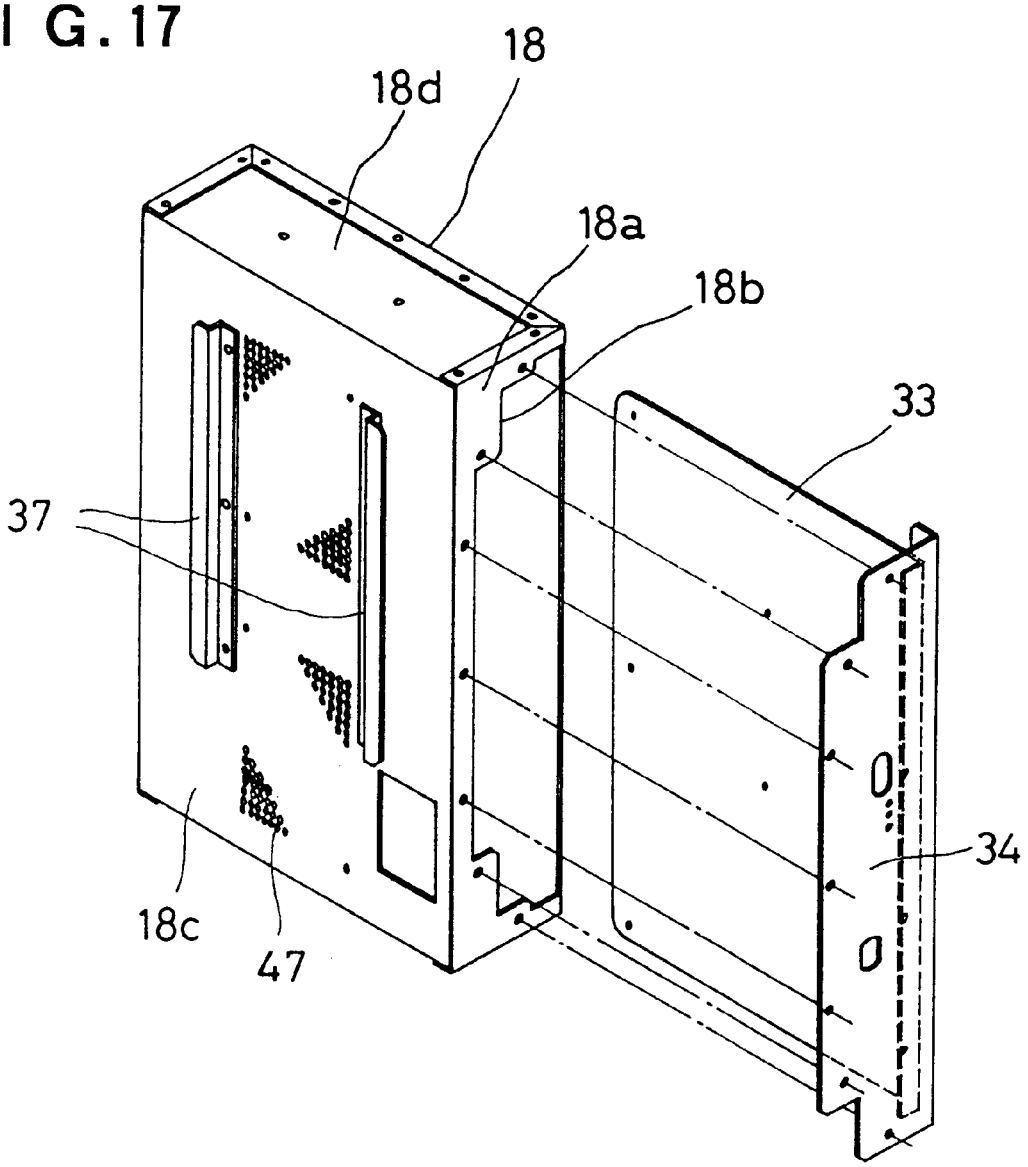
FIG. 17 is an exploded perspective view of a flat parallelepiped control unit case.
Figure 18:
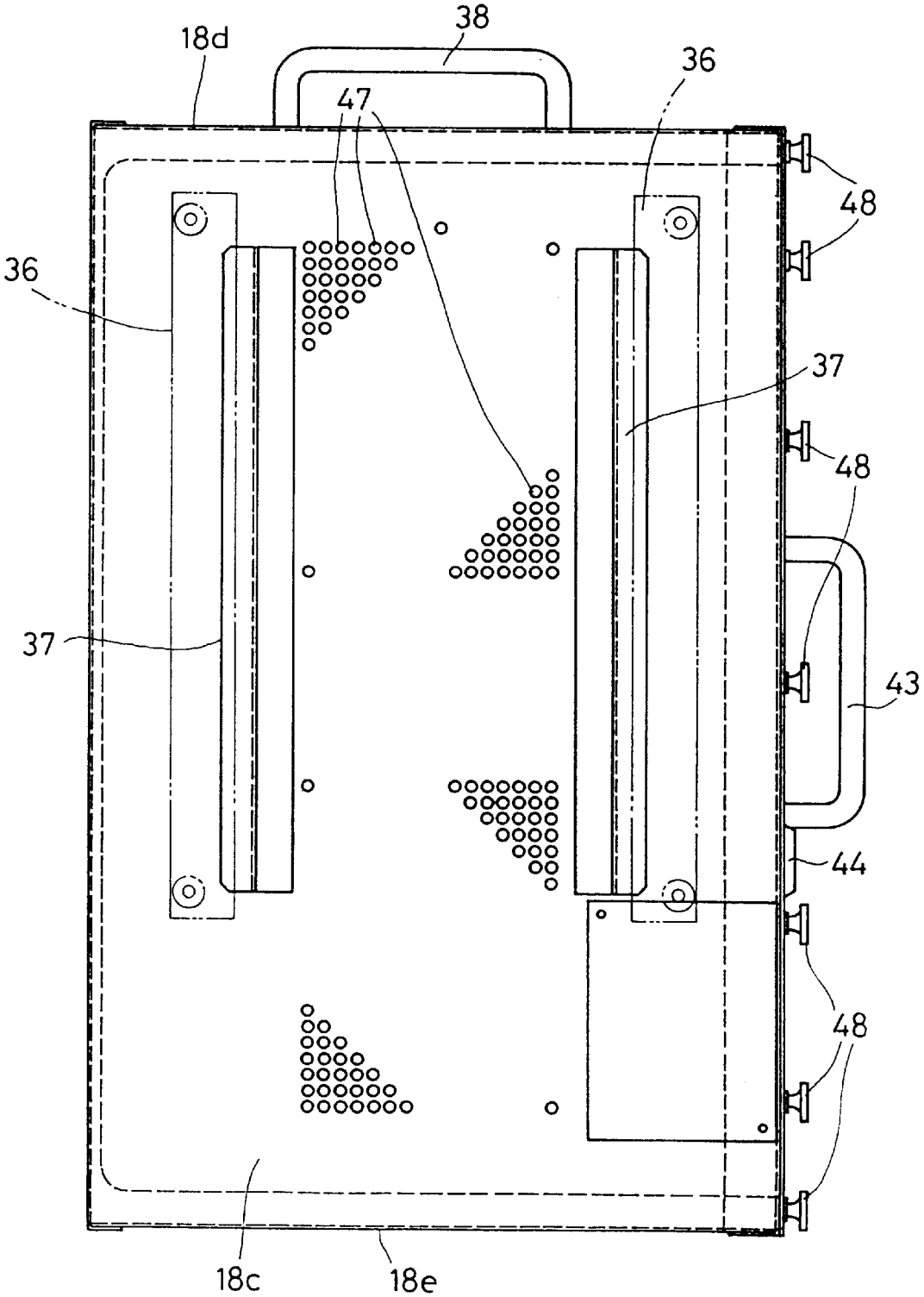
FIG. 18 is a left side view of the control unit case.
Figure 19:
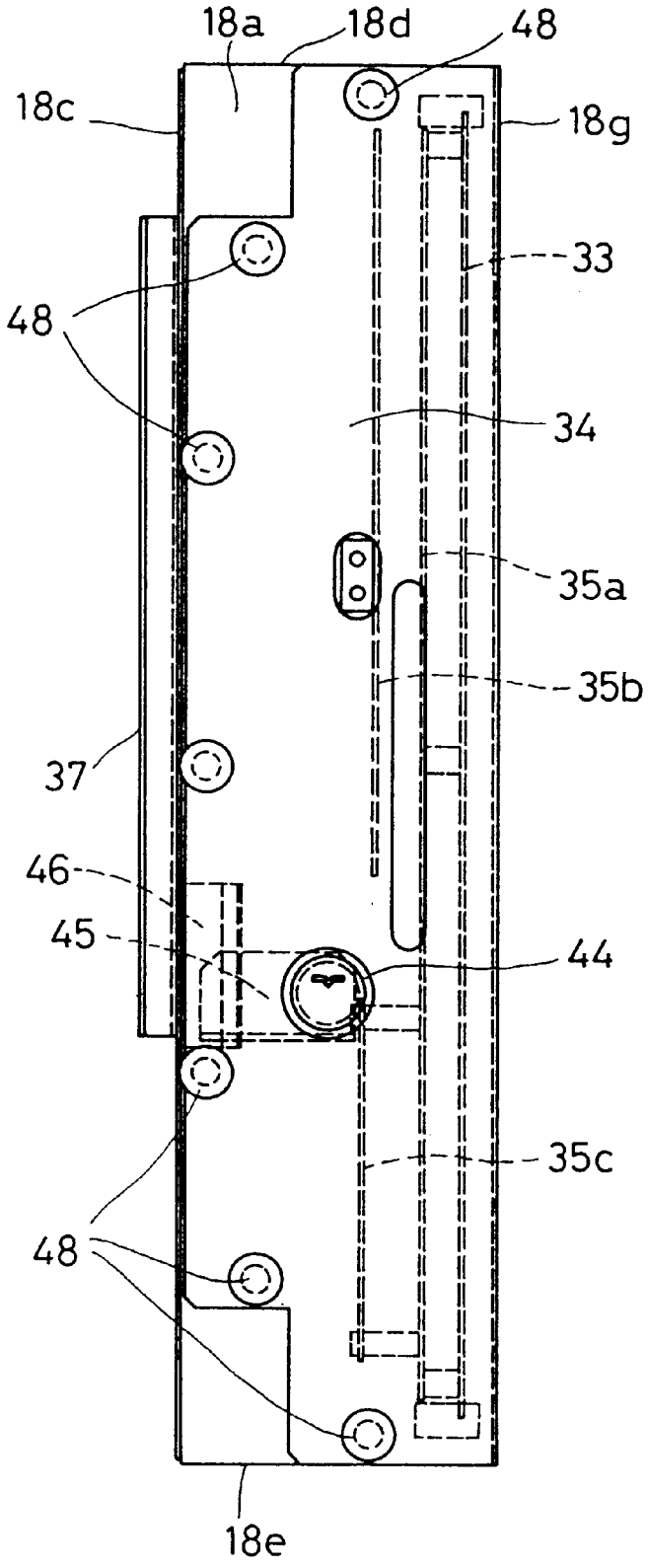
FIG. 19 is a front view of the control unit case.
Figure 20:
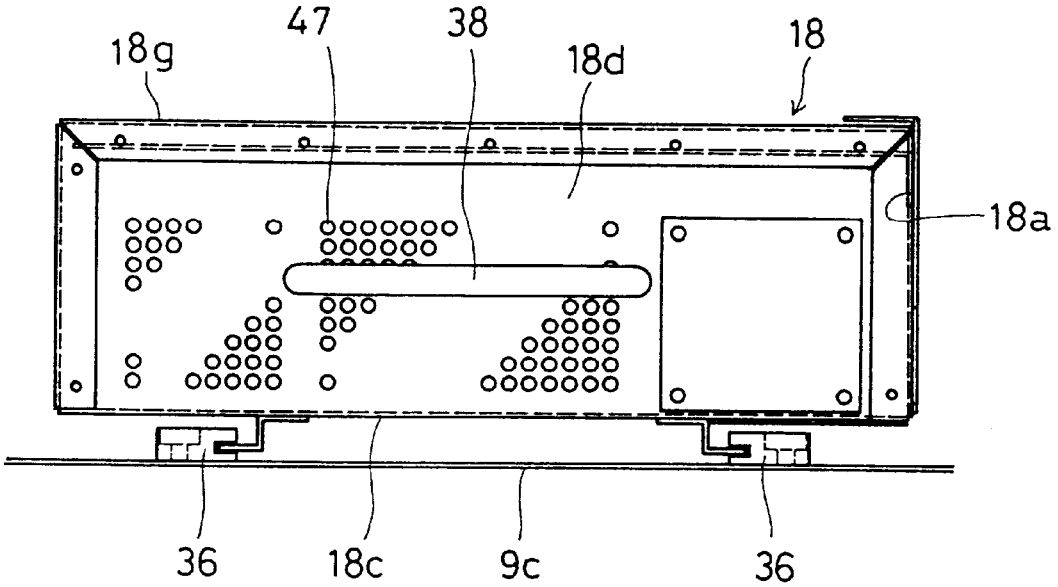
FIG. 20 is a plan view of the control unit case.
Figure 21:
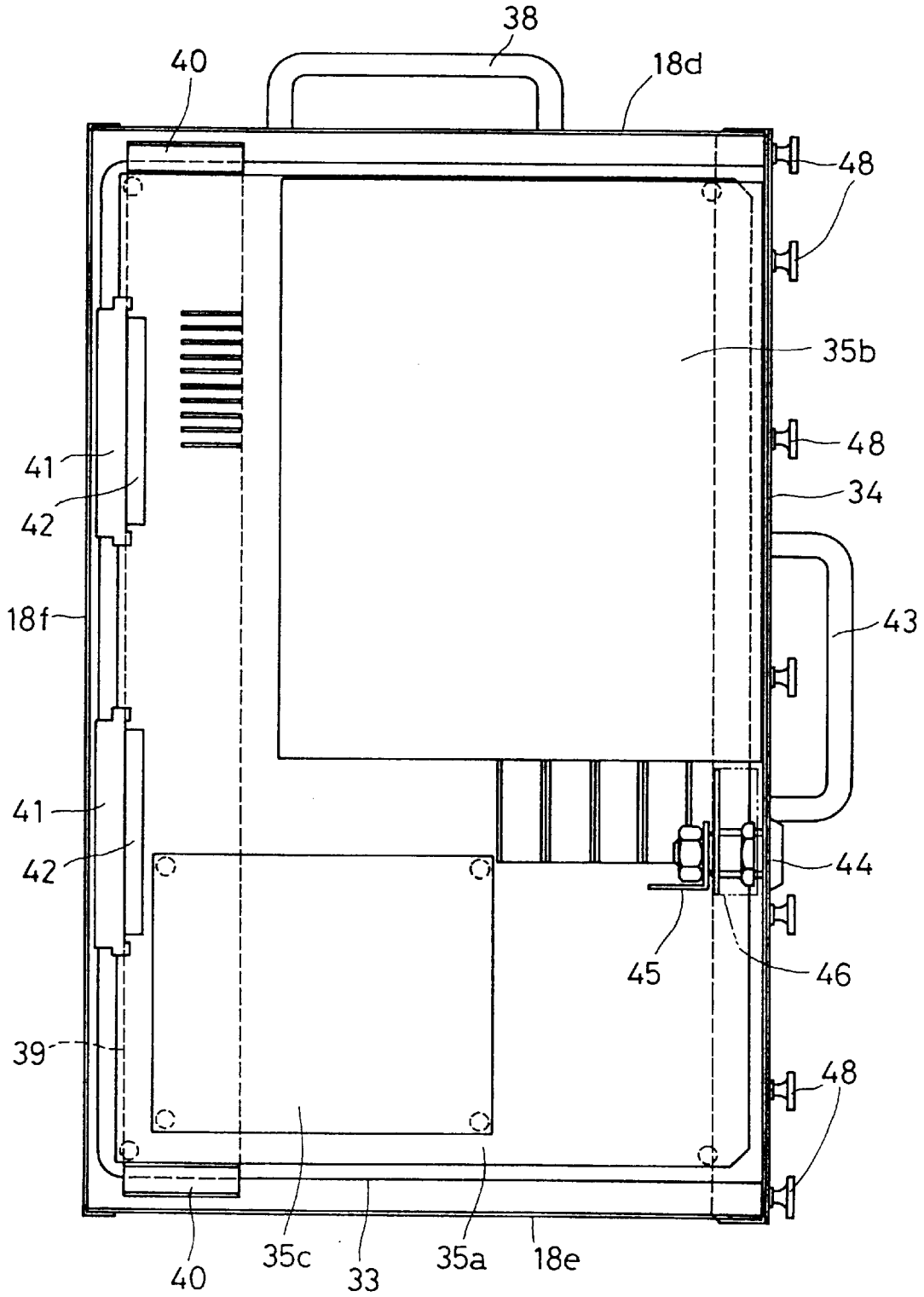
FIG. 21 is a sectional side view of the control unit case.

As shown in FIGS. 18, 20, on an inner surface of the left side plate 9*c* of the game unit cabinet 9 are fixed vertically two guide rails 36 at a predetermined interval. As shown in FIGS. 17, 20, on a left side plate 18*c* of the control unit case 18 are fixed sliding members 37 capable of fitting to the guide rails 36. And as shown in FIGS. 18, 20, 21, on a top plate 18*d* of the control unit case 18 is fixed a grip 38. In order to install the control unit case 18 in the game unit cabinet 9, in a state that the top door 10 is opened upward (FIG. 25), the control unit case 18 is lowered from the top of the game unit cabinet 9 through the space between the left side plate 9*c* of the cabinet 9 and the CRT display apparatus 12 until the sliding members 37 engage with the guide rails 36, then the control unit case 18 is lowered gently. Thus the control unit case 18 can be installed in the game unit cabinet 9 stably.

Figure 22:
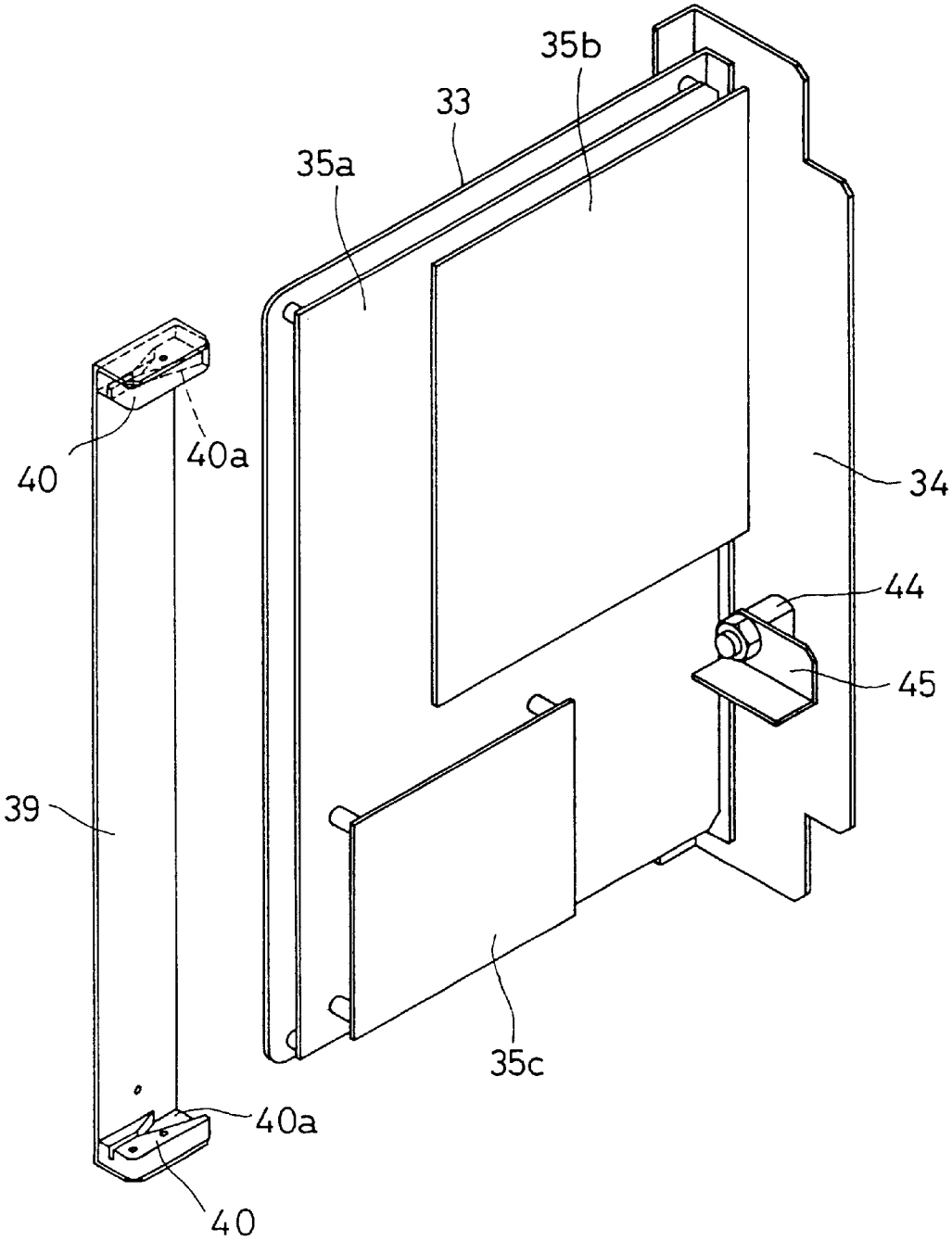
FIG. 22 is an exploded perspective view of a control substrate.
Figure 23:
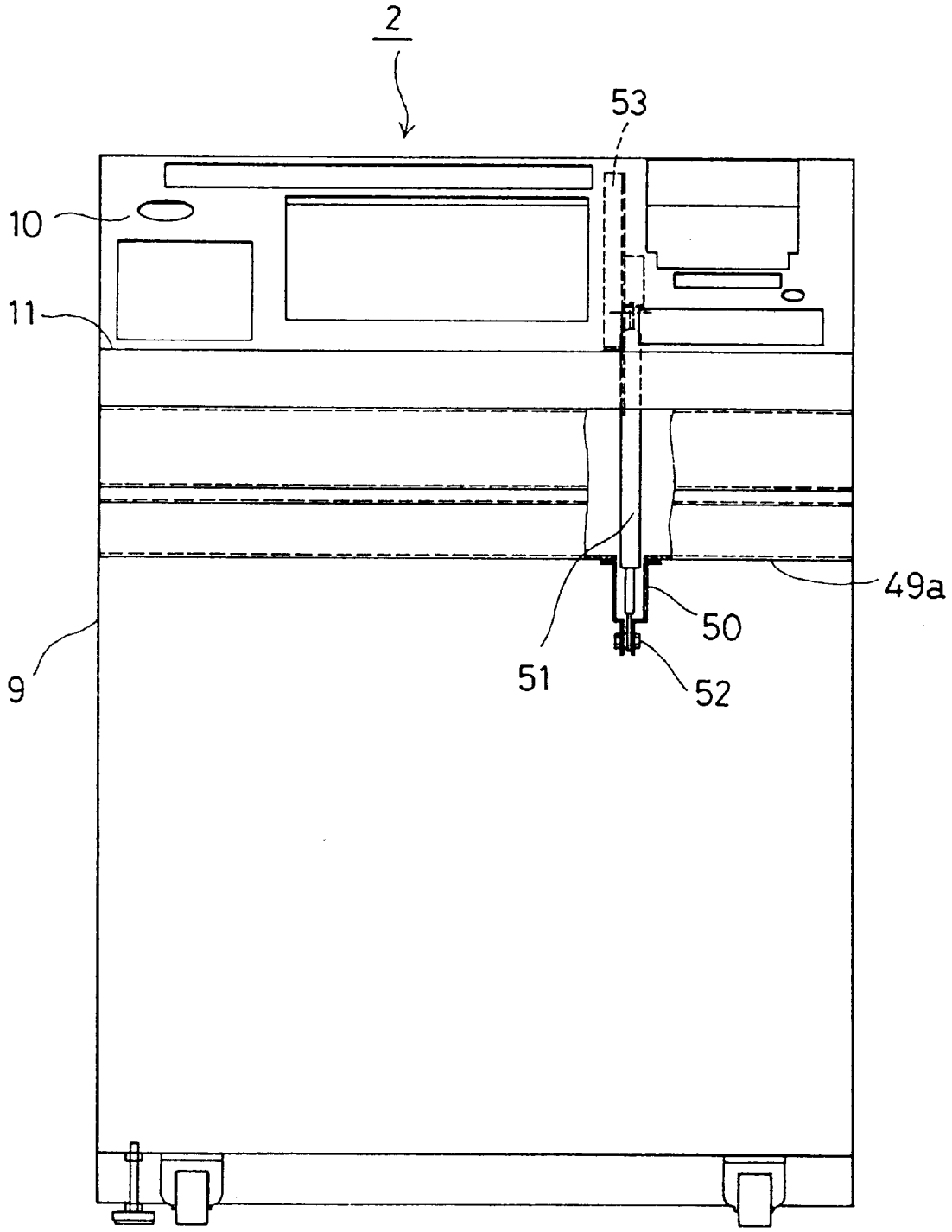
FIG. 23 is a partly cut front view of the game unit.
Figure 24:
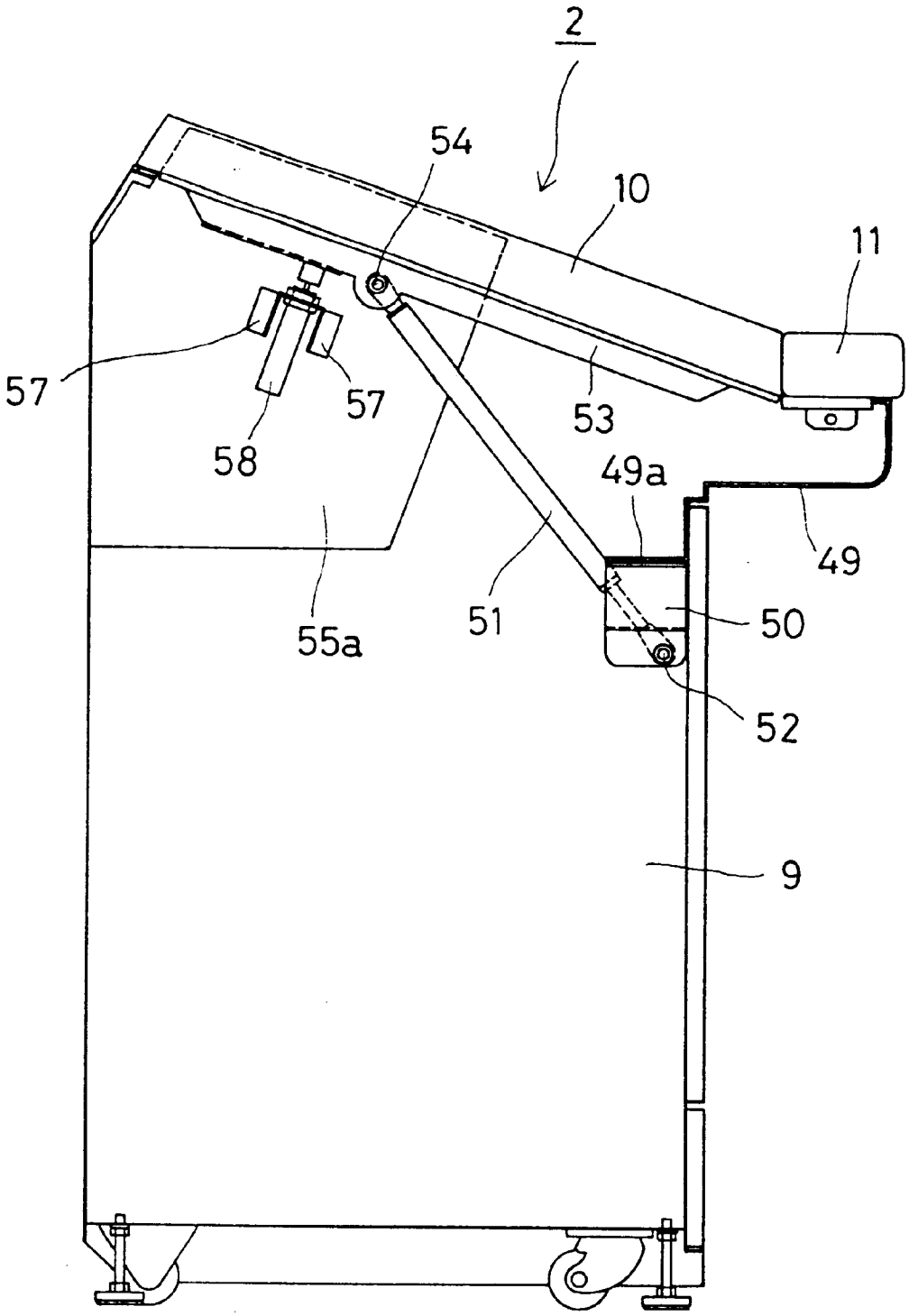
FIG. 24 is a sectional side view of the game unit with a top door closed.

On a right side plate 18*g* of the control unit case 18 are fixed upper and lower ends of a attaching bracket 39 (FIGS. 21, 22). At each of the upper and lower ends is integrally formed a clipping piece 40 having a groove 40*a* of V-shape in plan. When the control substrate 33 is inserted into the control unit case 18, upper and lower ends in rear of the control substrate 33 are engaged with the V-shaped grooves 40*a* to surely and stably fix the control substrate 33 within the control unit case 18.

As shown in FIG. 21, on a rear side plate 18*f* of the control unit case 18 and a rear side edge of the control parts attaching plate 35*a* are provided connectors 41, 42, respectively. When the control substrate 33 is engaged with the clipping pieces 40, the connectors 41, 42 are connected with each other to electrically connect leading wires in the control unit case 18 with the electronic parts on the control substrate 33.

Also on the closing plate 34 is provided a grip 43 and under the grip 43 is provided a locking mechanism 44. When a key (not shown) is inserted in the locking mechanism 44 and turned, a clasp 45 of the locking mechanism 44 is rotated and retained by a clasp receiving member 46 on the front plate 18*a* of the control unit case 18 to prevent the control substrate 33 from being pulled out from the control unit case 18.

Many ventilation holes 47 which are so small that an electric wave does not leak are formed in the left side plate 18*c* and the top plate 18*d* of the control unit case 18, and adhering hold member 48 are provided on a circumferential edge of the closing plate 34. Therefore, an electric wave in the control unit case does not leak out, but air can freely pass through the interior of the control unit case 18.

Next, a mechanism for carrying out opening and closing of the top door 10 shown in FIGS. 23 to 27 will be described.

At a position of the game unit cabinet 9 under the armrest 11 is formed a support member 49 like a step for supporting a front edge of the armrest 11. A lower horizontal section 49*a* of the support member 49 is formed with a cut 49*b*, and neighboring the cut 49*b*, on a lower surface of the lower horizontal section 49*a* are fixed a pair of gas cylinder pivoting bracket 50 on which a lower end of a gas cylinder 51 is pivoted by a bolt-nut 52.

An upper end of the gas cylinder 51 is pivoted by a bolt-nut 54 on a gas cylinder receiving member 53 fixed on a lower surface of the top door 10 positioned on the right side of the display opening 10*a* as shown in FIG. 12.

Figure 25:
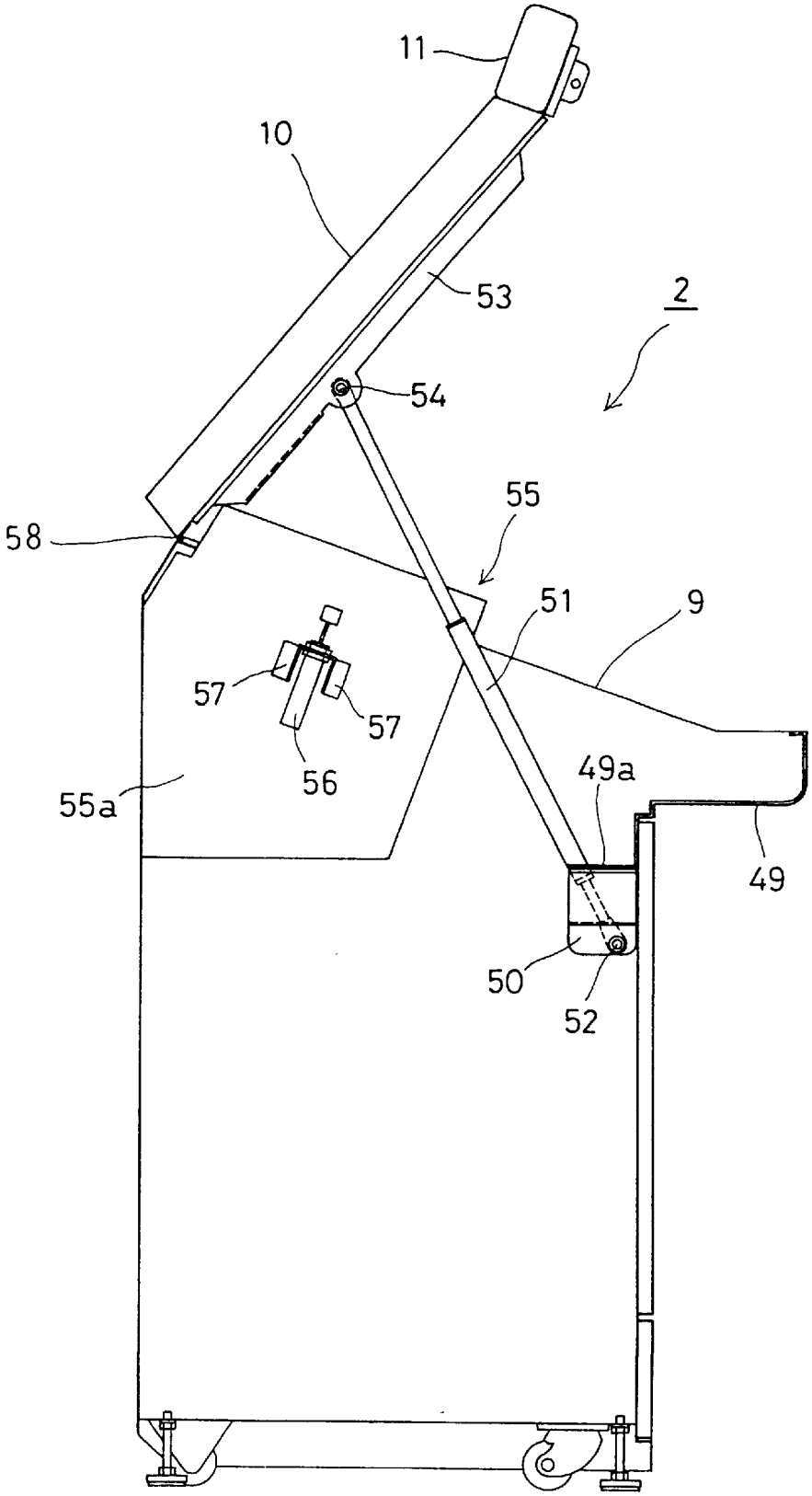
FIG. 25 is a sectional side view of the game unit with the top door full opened.
Figure 26:
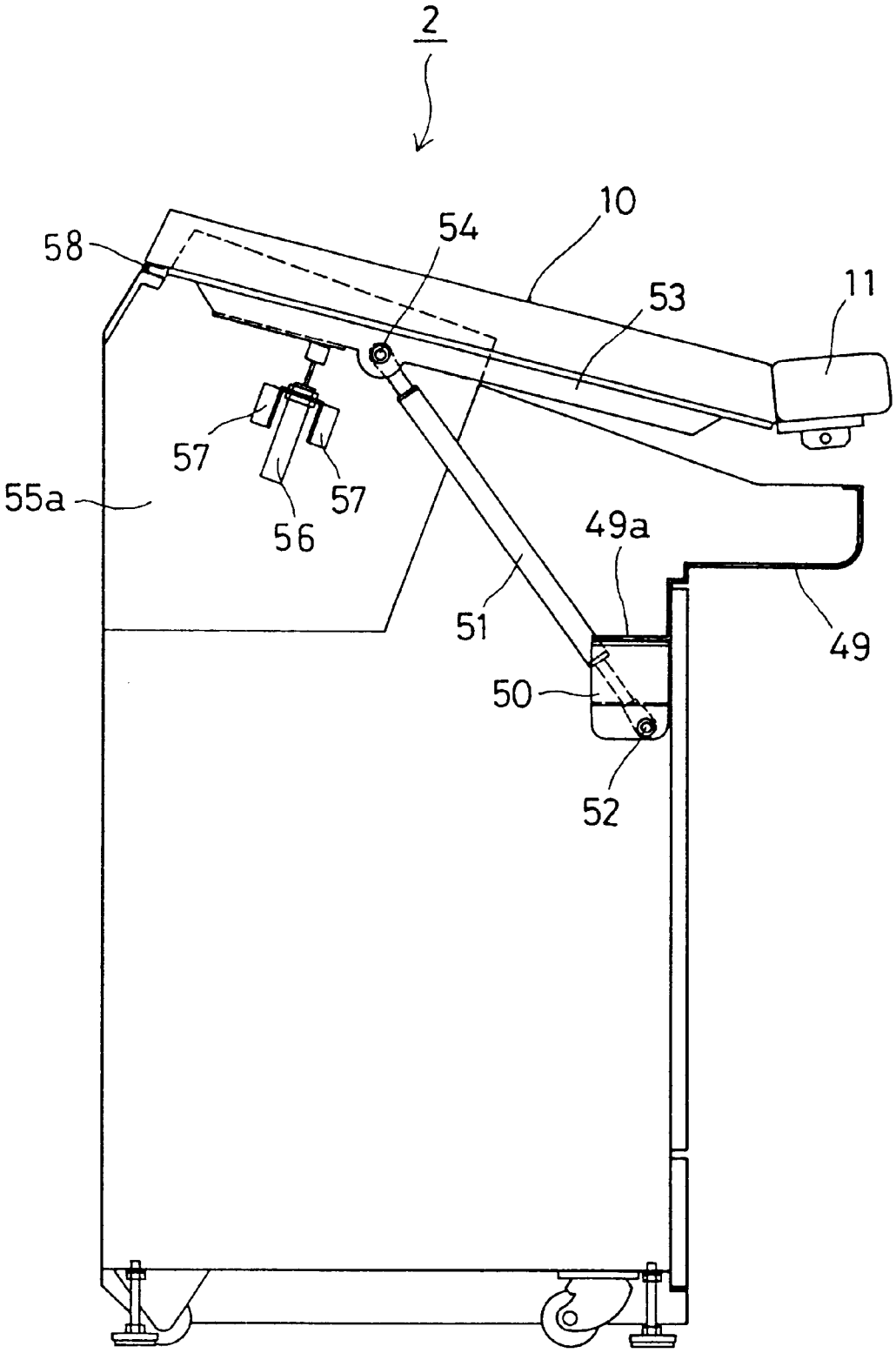
FIG. 26 is a sectional side view of the game unit showing a state just before the top door is closed.
Figure 27:
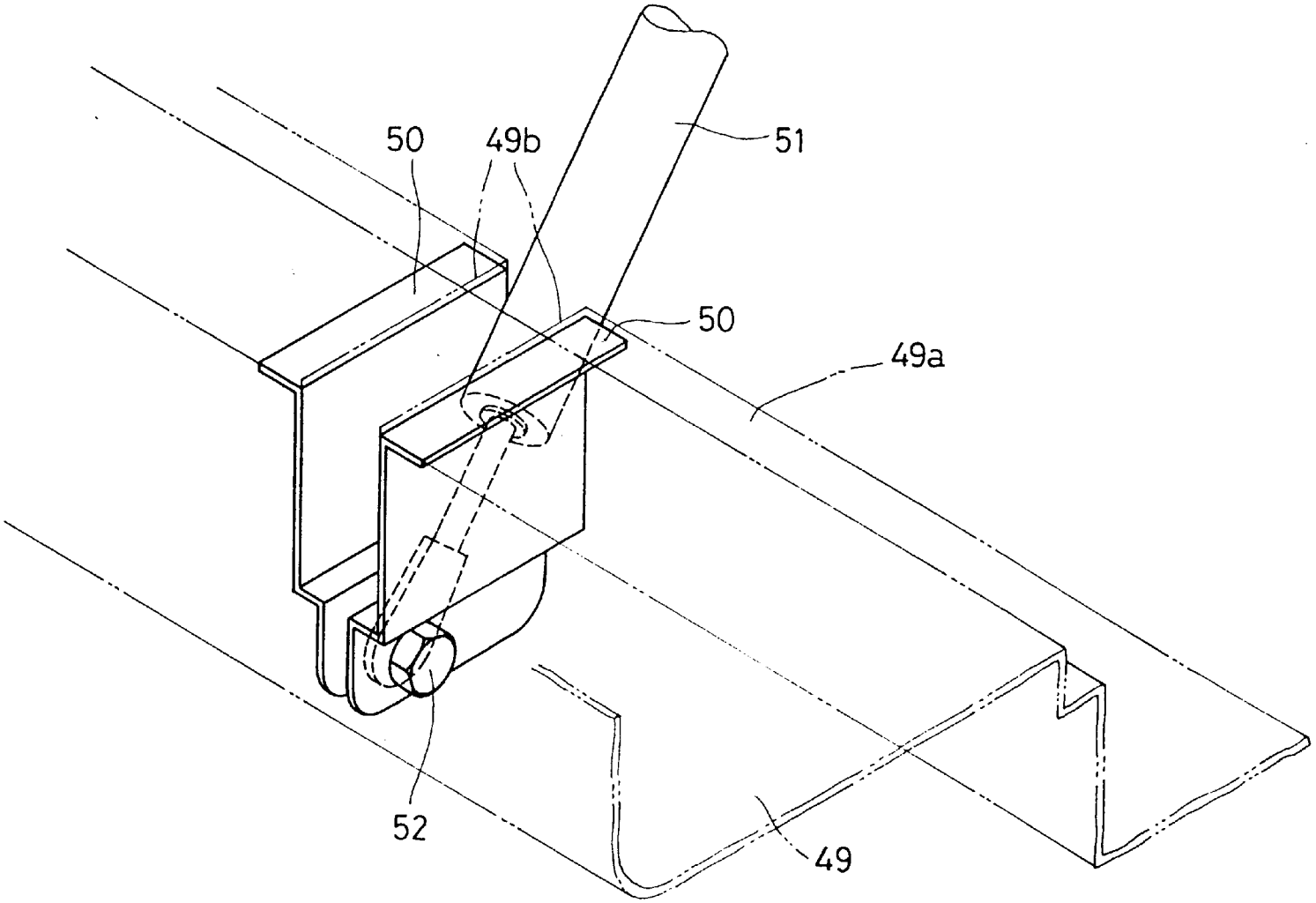
FIG. 27 is a perspective view showing a pivot portion of lower end of a gas cylinder.

A sealing box 55 for partitioning and sealing the bill receiving apparatus 13 from the space within the game unit cabinet 9 is provided and a damper attaching bracket 56 is fixed on a left side plate 55*a* of the sealing box 55. When an operator pulls down the top door 10 opened as shown in FIG. 25, moment by own weight of the top door 10 increases gradually to accelerate the top door 10, and just before the top door is closed (FIG. 26), the gas cylinder receiving member 53 of the top door 10 touches the oil damper 57 to largely decelerate lowering of the top door 10 by the oil damper 57. Therefore, the top door 10 does not collide with the game unit cabinet 9 with a large impact force so that the top door can be closed quietly.

FIGS. 28 to 33 show a construction for preventing drink such as juice spilled on an upper surface of the CRT display apparatus 12 from invading in the game unit cabinet 9.

Figure 30:
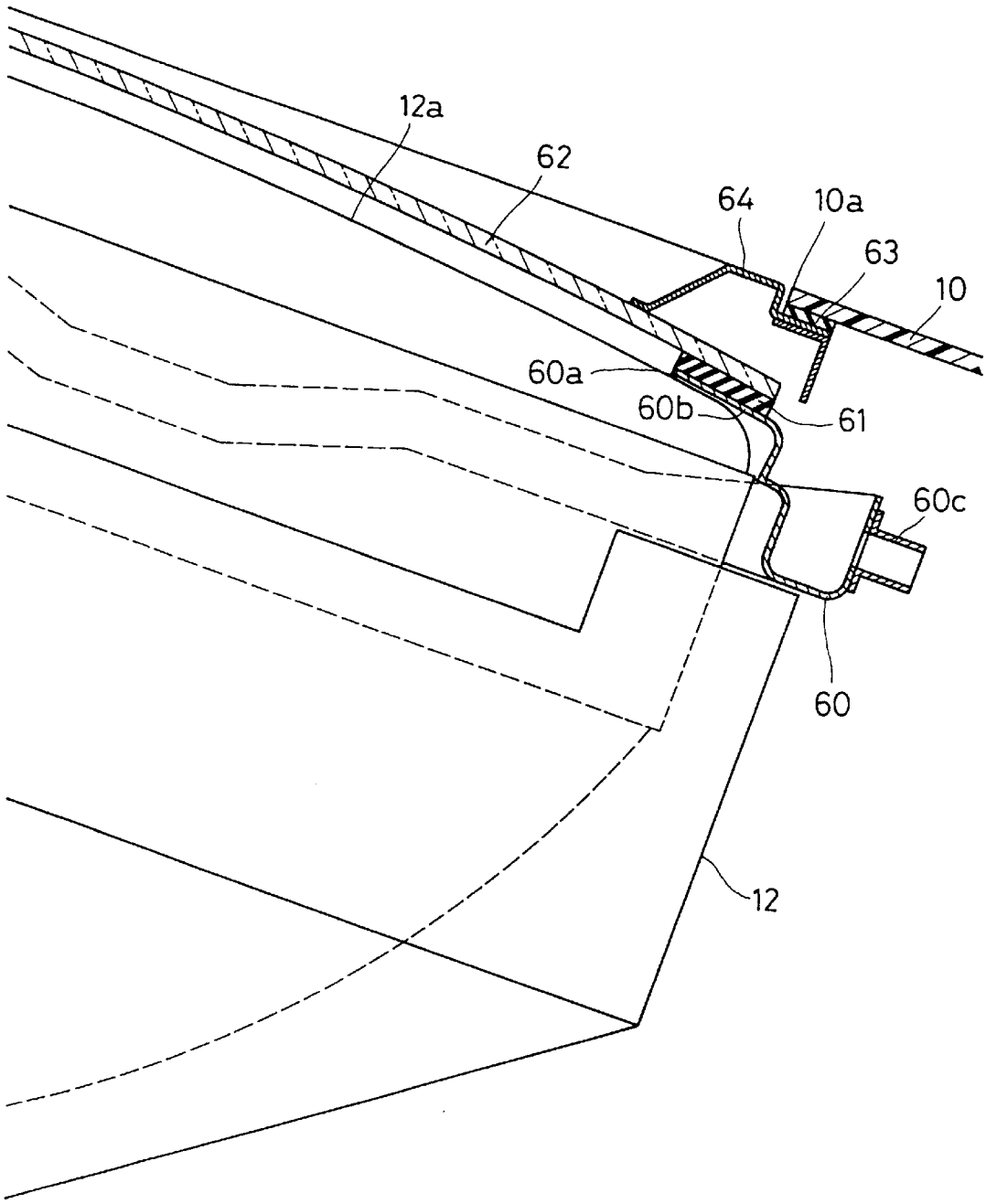
FIG. 30 is an enlarged sectional view showing an essential part of FIG. 28.
Figure 31:
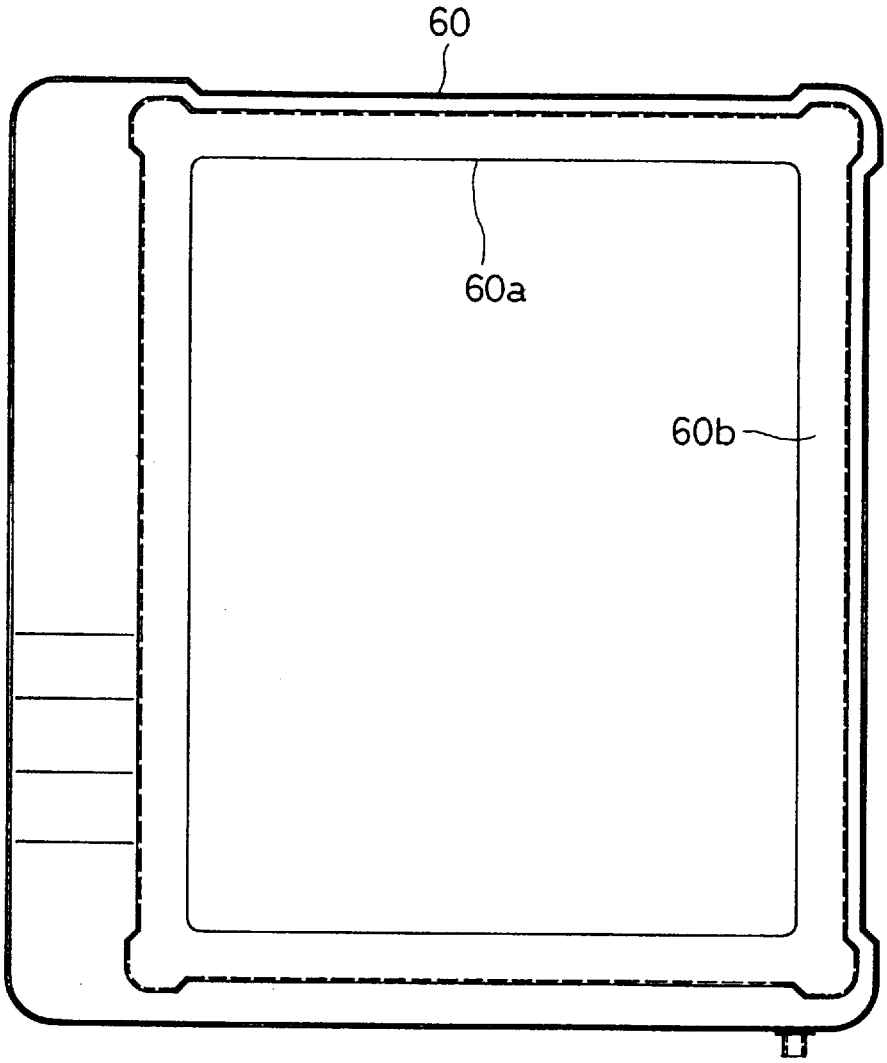
FIG. 31 is a plan view of a liquid receiving trough member.
Figure 32:
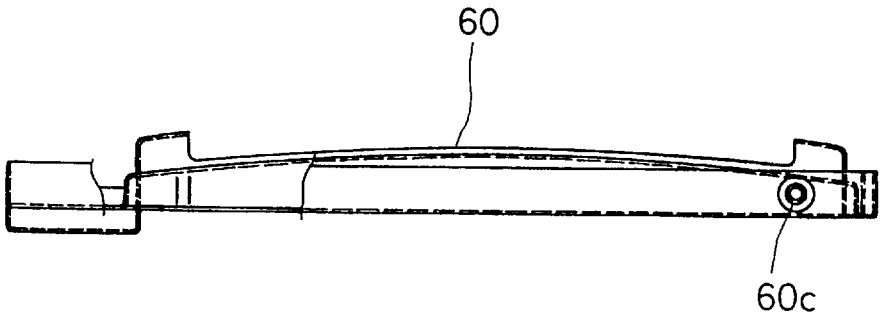
FIG. 32 is a front view of the liquid receiving trough member.
Figure 33:
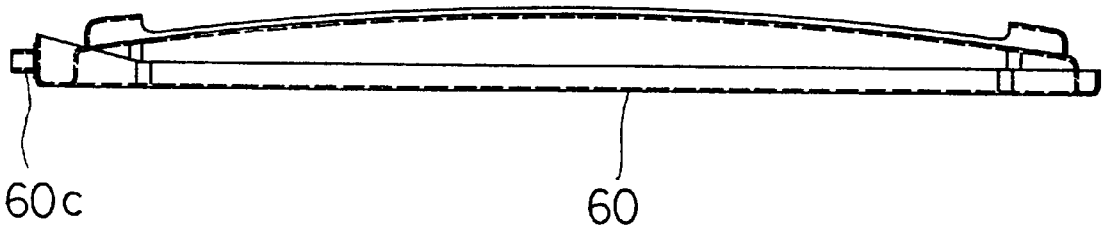
FIG. 33 is a right side view of the gutter-like liquid receiving member.

A liquid receiving trough member 60 made of synthetic resin is formed as shown in FIGS. 31, 32, and as shown in FIG. 30, the trough member 60 is fitted to the CRT display apparatus 12 so that a peripheral part 60*b* of the trough member 60 adjacent to an annular inner edge 60*a* thereof is closely contacted with a peripheral part of the display section 12*a* of the CRT display apparatus 12. On the peripheral part 60*a* of the trough member 60 is adhered a touch panel 62 through an elastic material 61 such as soft rubber. On a lower surface of the top door 10 adjacent to the opening 10*a* is attached a frame member 64 through an elastic material 63 similar to the elastic material 61, so that when the top door 10 is closed down, the frame member 64 is closely contacted with the touch panel 62.

A liquid discharging sleeve 60*c* is provided on the front right side of the liquid receiving trough member 60, and an upper end of a flexible communication pipe 65 is fitted to the liquid discharging sleeve 60*c*.

Figure 28:
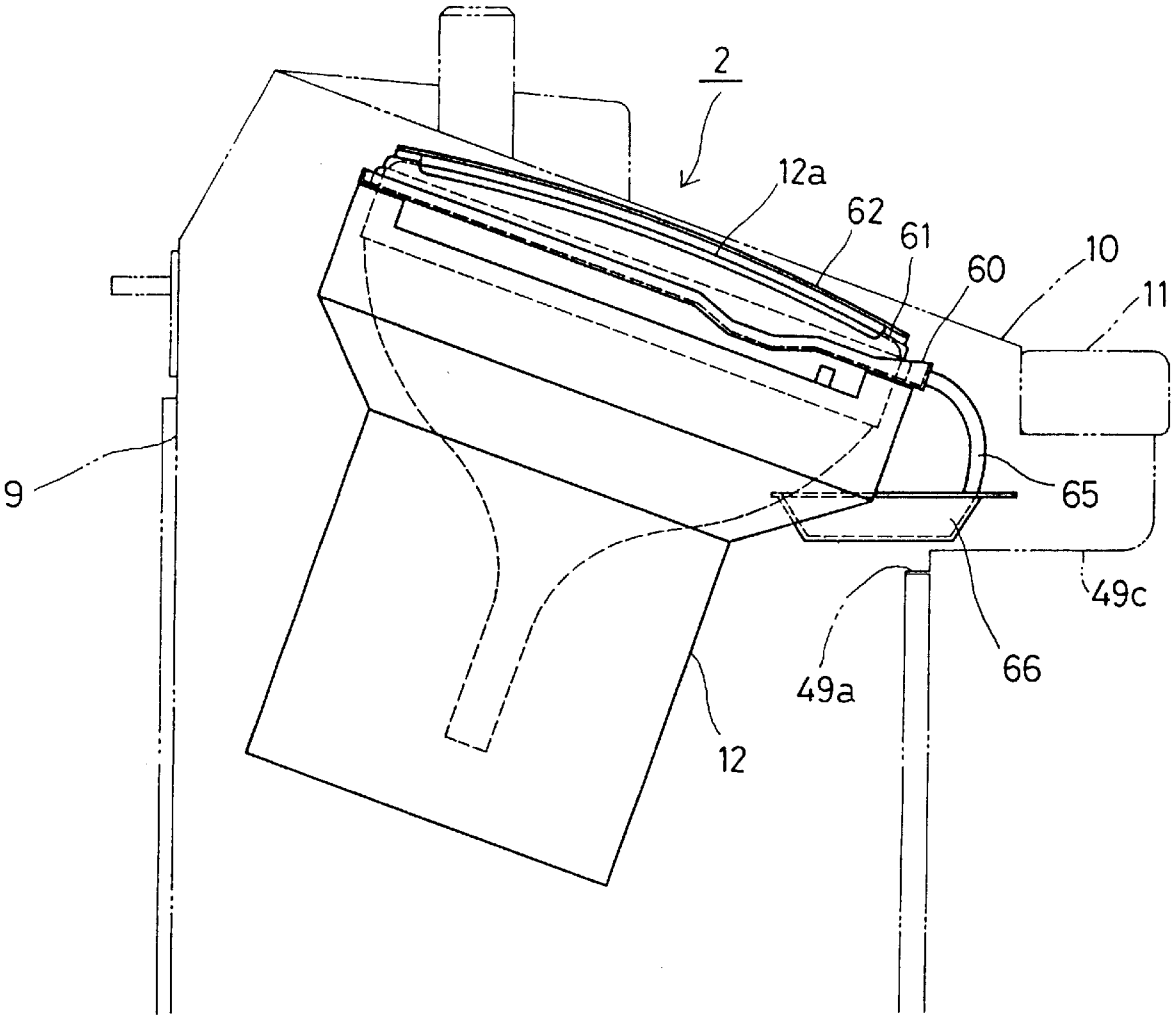
FIG. 28 is a side view of a top part of the game unit showing a liquid receiving structure.
Figure 29:
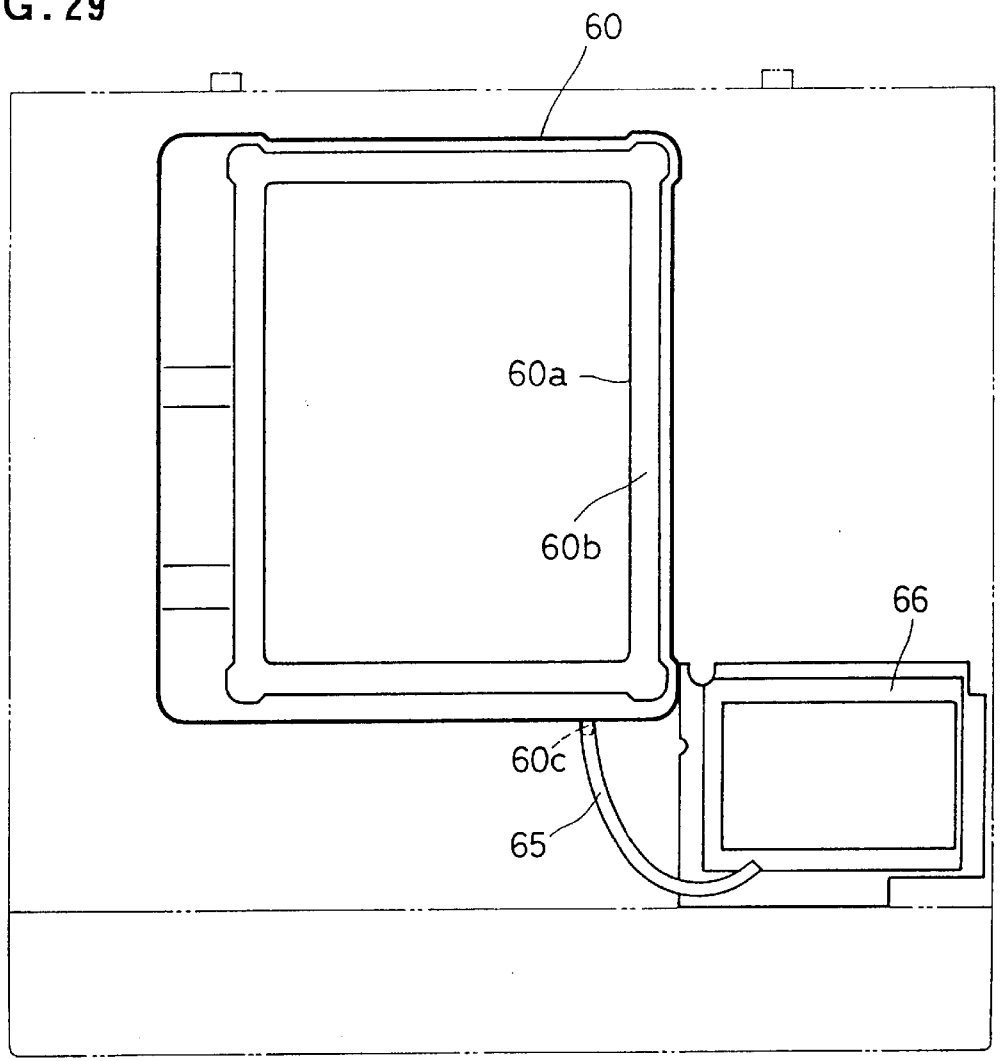
FIG. 29 is a plan view of FIG. 28.

As shown in FIG. 28, a liquid receiving saucer (liquid receptacle) 66 is positioned under the liquid discharging sleeve 60*c* partly laying over the upper step 49*c* of the support member 49. The liquid receiving saucer 66 is placed on a support member (not shown) so as not to move horizontally. The liquid receiving saucer 66 has a receiving sleeve to which a lower end of the communication pipe 65 is fitted, so that liquid flowing into the liquid receiving trough member 60 is led to the liquid receiving saucer 66 through the communication pipe 65.

A mechanism for adjusting an upper opening position and a lower closing position of the top door 10 is shown in FIGS. 34 to 38.

Figure 34:
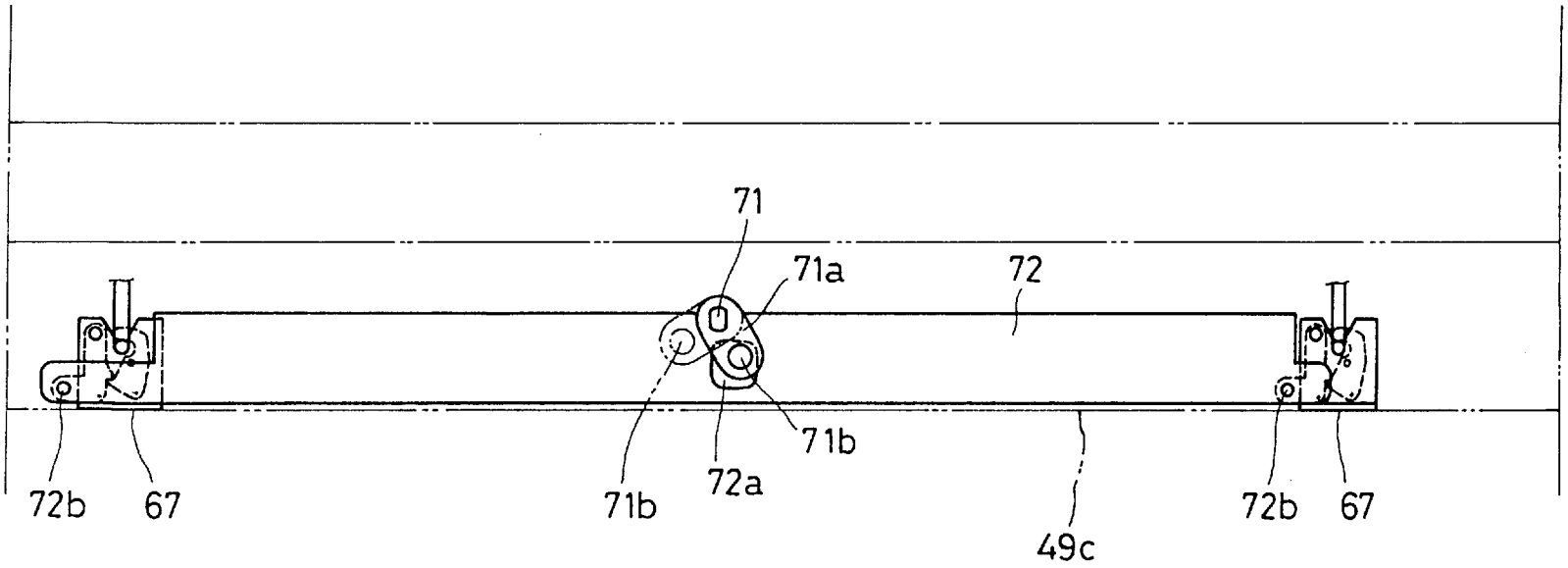
FIG. 34 is a front view of a top door close position adjusting mechanism.
Figure 35:
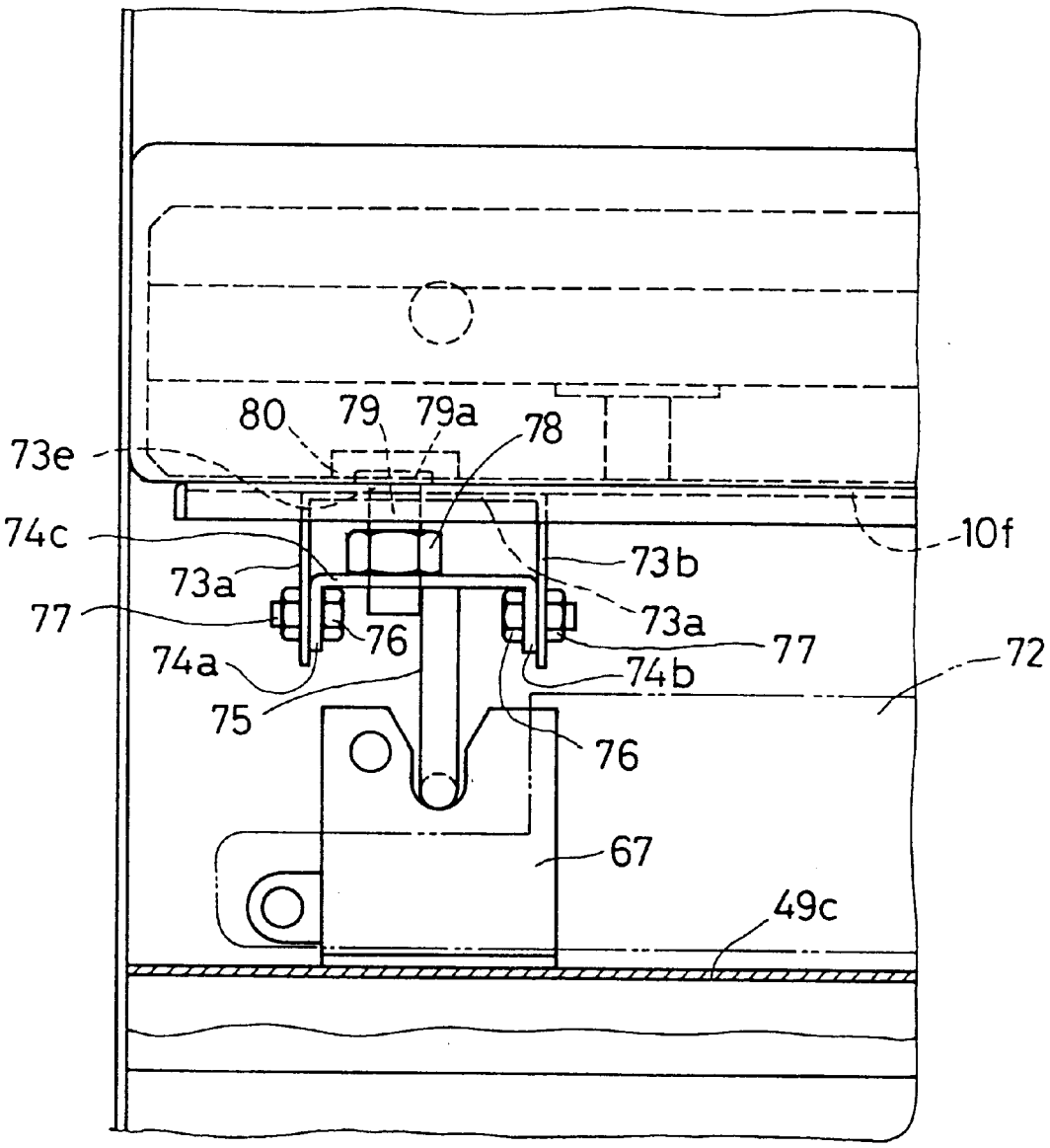
FIG. 35 is an enlarged front view showing an essential part of FIG. 34.
Figure 36:
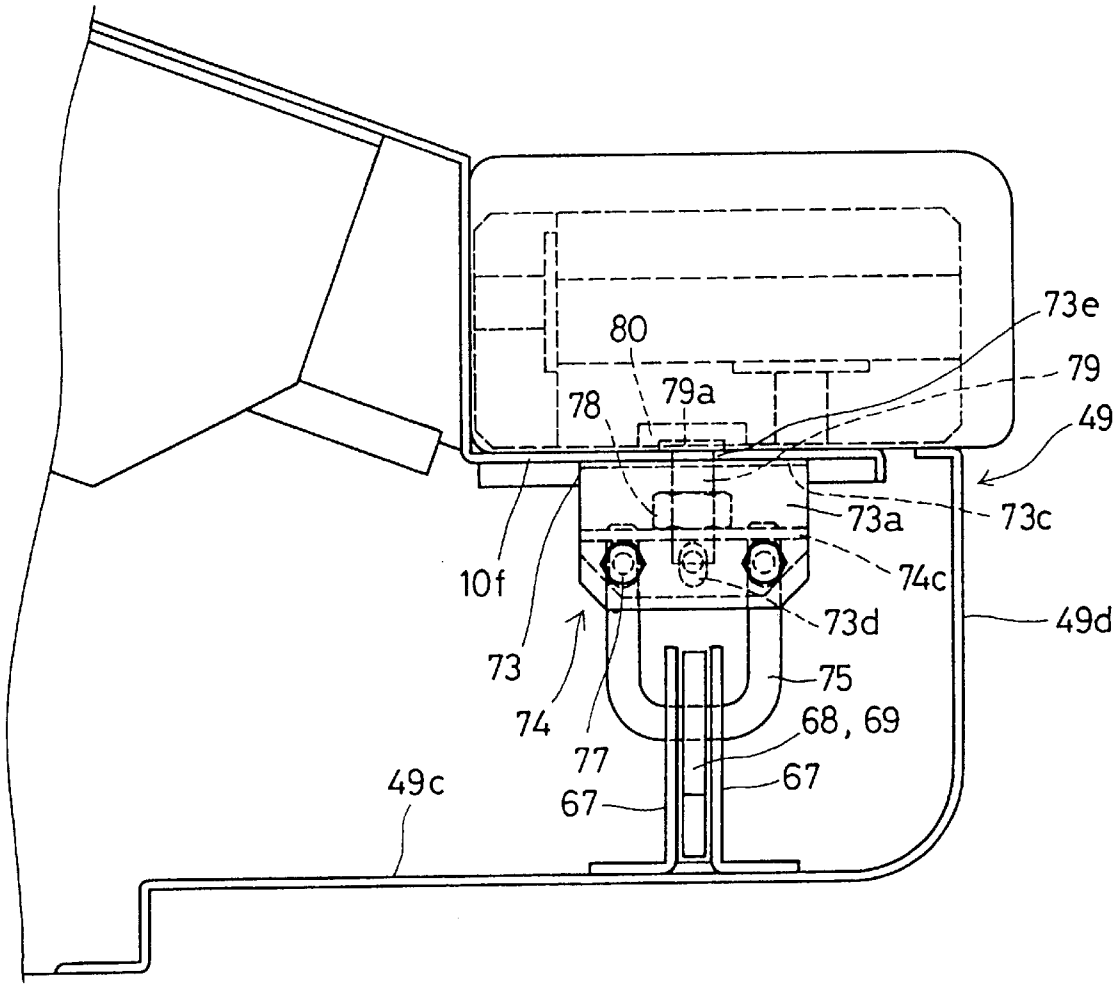
FIG. 36 is an enlarged left side view showing an essential part of FIG. 34.
Figure 37:
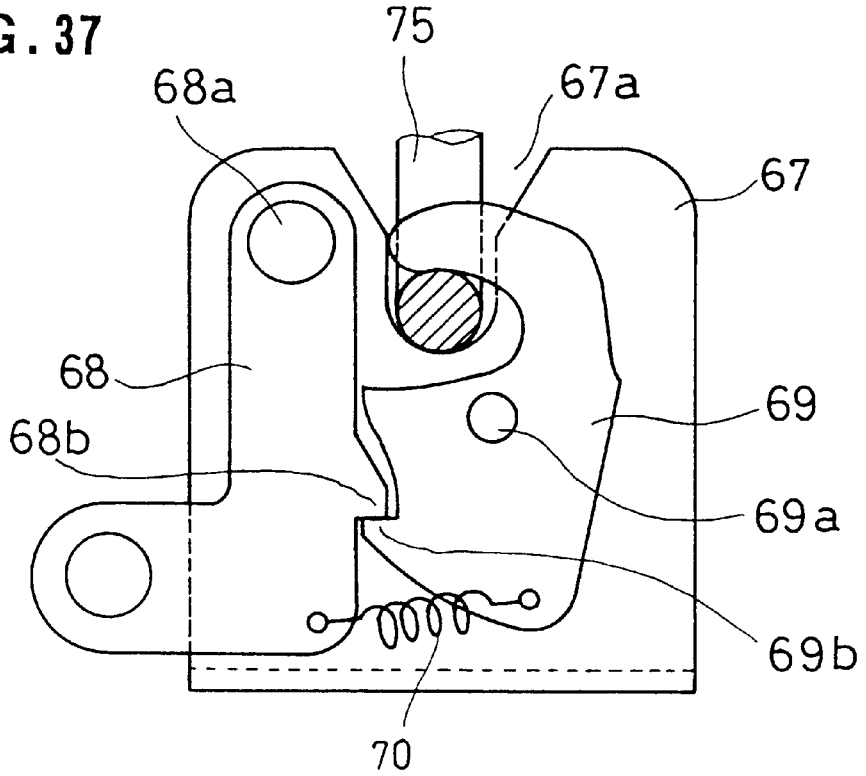
FIG. 37 is a front view of a top door retaining mechanism.
Figure 38:
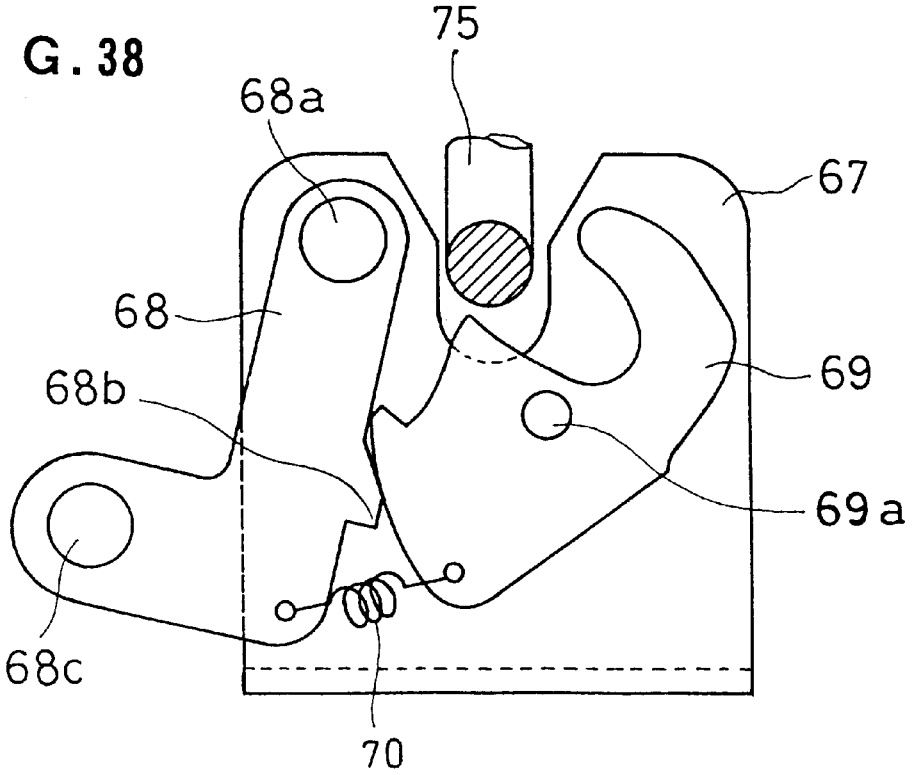
FIG. 38 is a front view similar to FIG. 37 showing a state that the top door is released.

As shown in FIGS. 34, 36, at each of right and left positions of the upper step 49*c* of the support member 49 is attached a pair of hook brackets 67, and between the pair of hook brackets 67 are pivoted a engaging piece 68 and a hook piece 69 by pins 68*a*, 69*a* so as to rock right and left (FIGS. 37, 38). A tensile coil spring 70 is interposed between the engaging piece 68 and the hook piece 69. A engaging section 69*b* of the hook piece 69 is retained by a retaining section 68*b* of the engaging piece 68.

On a front wall standing up at a front side of the upper step 49*c* of the support member 49 is provided a locking mechanism 71. A pin 71*b* projecting from a rocking piece 71*a* of the locking mechanism 71 is loosely fitted in a window 72*a* of a connecting plate 72 provided in contact with the upper step 49*c*. Each pin 72*b* projected at respective ends of the connecting plate 72 is fitted to a hole 68*c* of the engaging piece 68. When a key (not shown) is inserted in the locking mechanism 71 and turned right and left, the connecting plate 72 moves right and left to rock the engaging pieces right and left.

Above the hook bracket 67 is positioned a channel-like attachment member 73 which is fixed to an armrest support plate 10*f* of the top door 10 by welding for instance. A right piece 73*b* of the attachment member 73 is formed with a vertically prolonged hole 73*d* (FIG. 36), a left piece 73*a* of the channel-like attachment member 73 is formed with both front and rear vertically prolonged holes similar to the hole 73*d* which are the same as the hole 73*d*, and a top piece 73*c* of the attachment member 73 is formed with a hole 73*e*.

Between the left and right pieces 73*a*, 73*b* of the attachment member 73 is fitted a channel-like rise and fall member 74, and at a middle position in respect of right and left of a top piece 74*c* of the member 74 is fixed an engage member 75 of U-shape side view. Bolts 76 penetrating respective left and right pieces 74*a*, 74*b* of the channel-like rise and fall member 74 are inserted in the above-mentioned prolonged holes of the channel-like attachment member 73 and nuts 77 are screwed onto tip ends of the bolts 76. Positioned just below the hole 73*e* of the attachment member 73, a nut 78 is welded to the top piece 74*c* of the rise and fall member 74.

An adjust screw 79 is inserted in the hole 73*e* formed in the top piece 73*c* of the attachment member 73 from above. A top part 79*a* of the adjust screw 79 is rotatably contacted with a pressing piece 80 fixed on the armrest support plate 10*f* of the top door 10. The adjustment screw 79 is screwed in the nut 78, and a diametric groove (not shown) is formed on a lower end of the adjust screw 79.

Next, a lifting mechanism of the bill receiving apparatus 13 shown in FIGS. 39 to 45 will be described.

Figure 40:
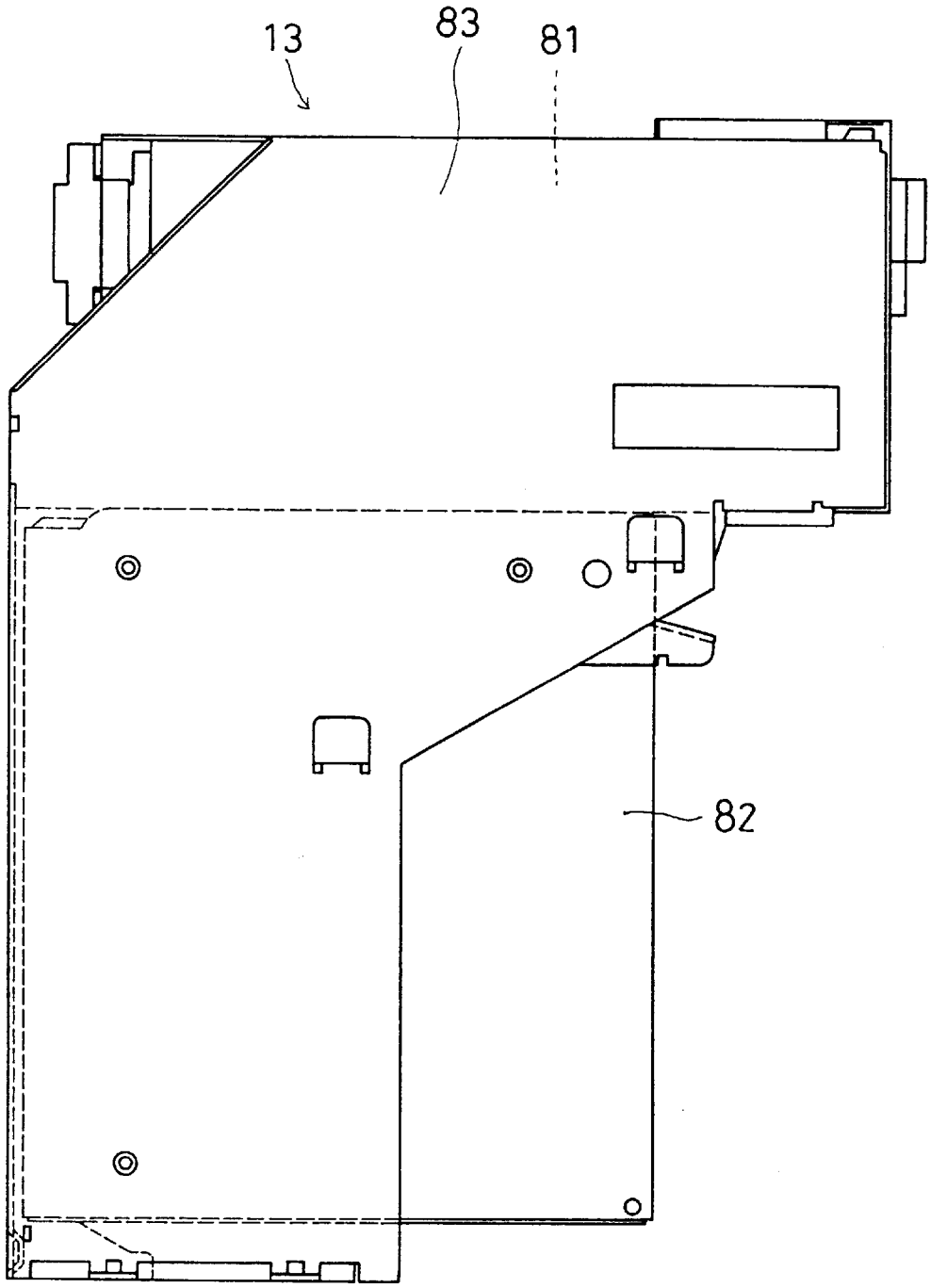
FIG. 40 is a left side view of a bill receiving case.
Figure 41:
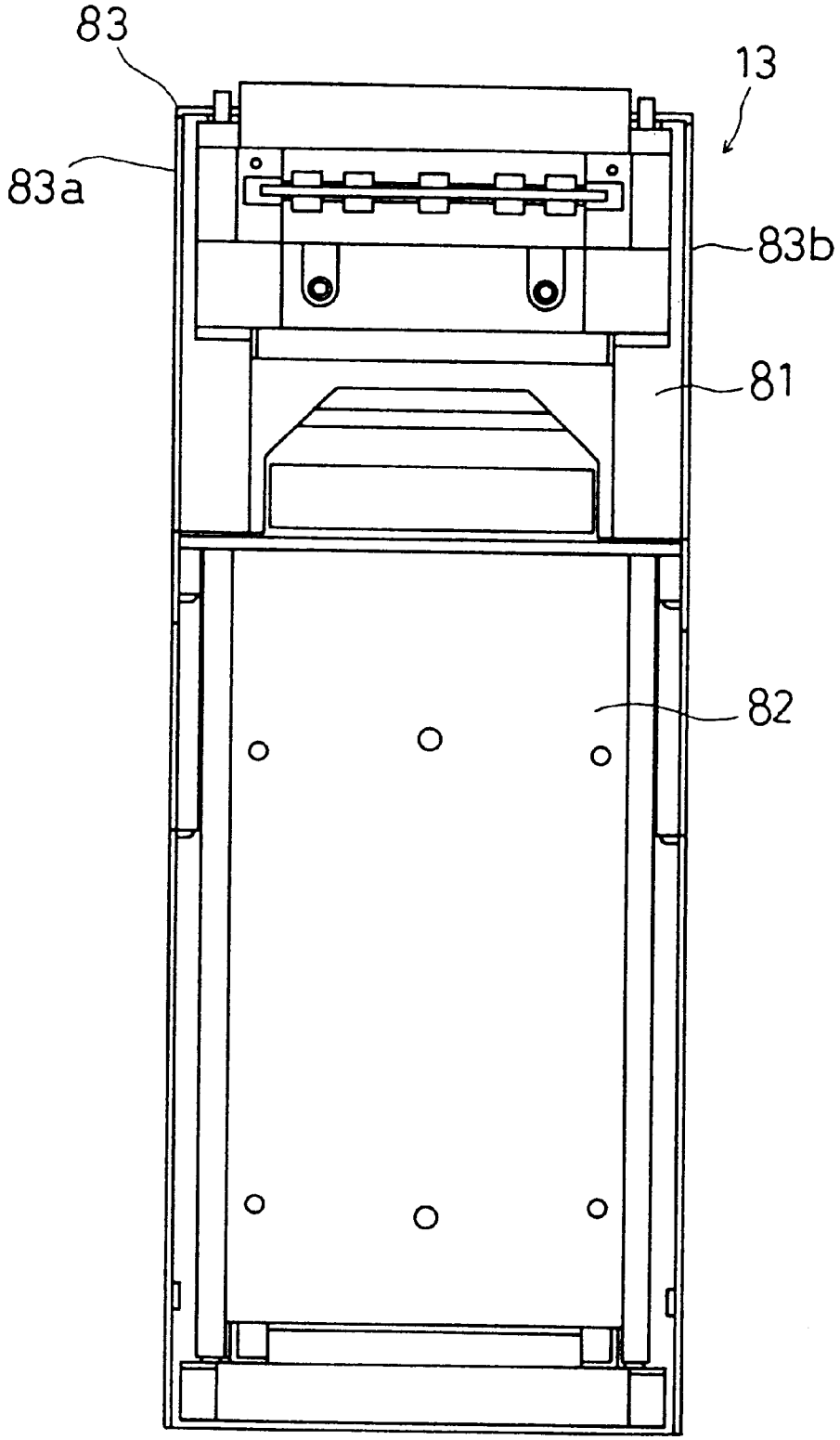
FIG. 41 is a front view of the bill receiving case.
Figure 42:
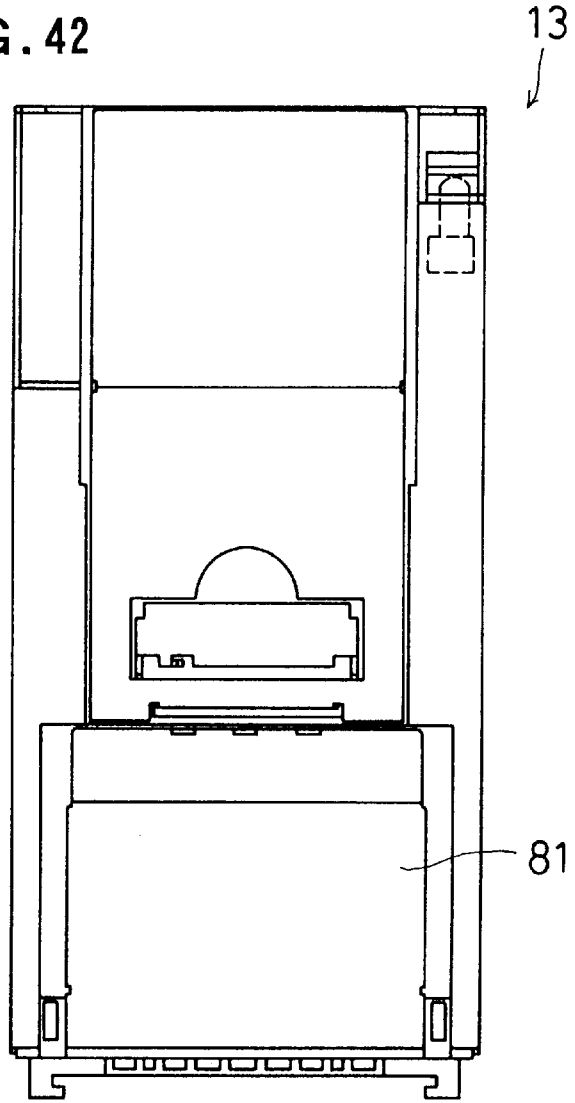
FIG. 42 is a plan view of the bill receiving case.

As shown in FIGS. 40 to 42, the bill receiving apparatus 13 comprises a bill detecting unit 81 which is prolonged in front and rear and has a front shape of nearly regular square, and a flat parallelepiped bill storing unit 82 which has a width nearly equal to that of the bill detecting unit 81, a depth smaller than that of the bill detecting unit 81, and a height larger than that of the bill detecting unit 81. The bill detecting unit 81 and the bill storing unit 82 are housed in a bill receiving case 83 with the bill detecting 81 piled up on the bill storing unit 82 so as to be pulled out and separated from the bill receiving case 83.

Figure 39:
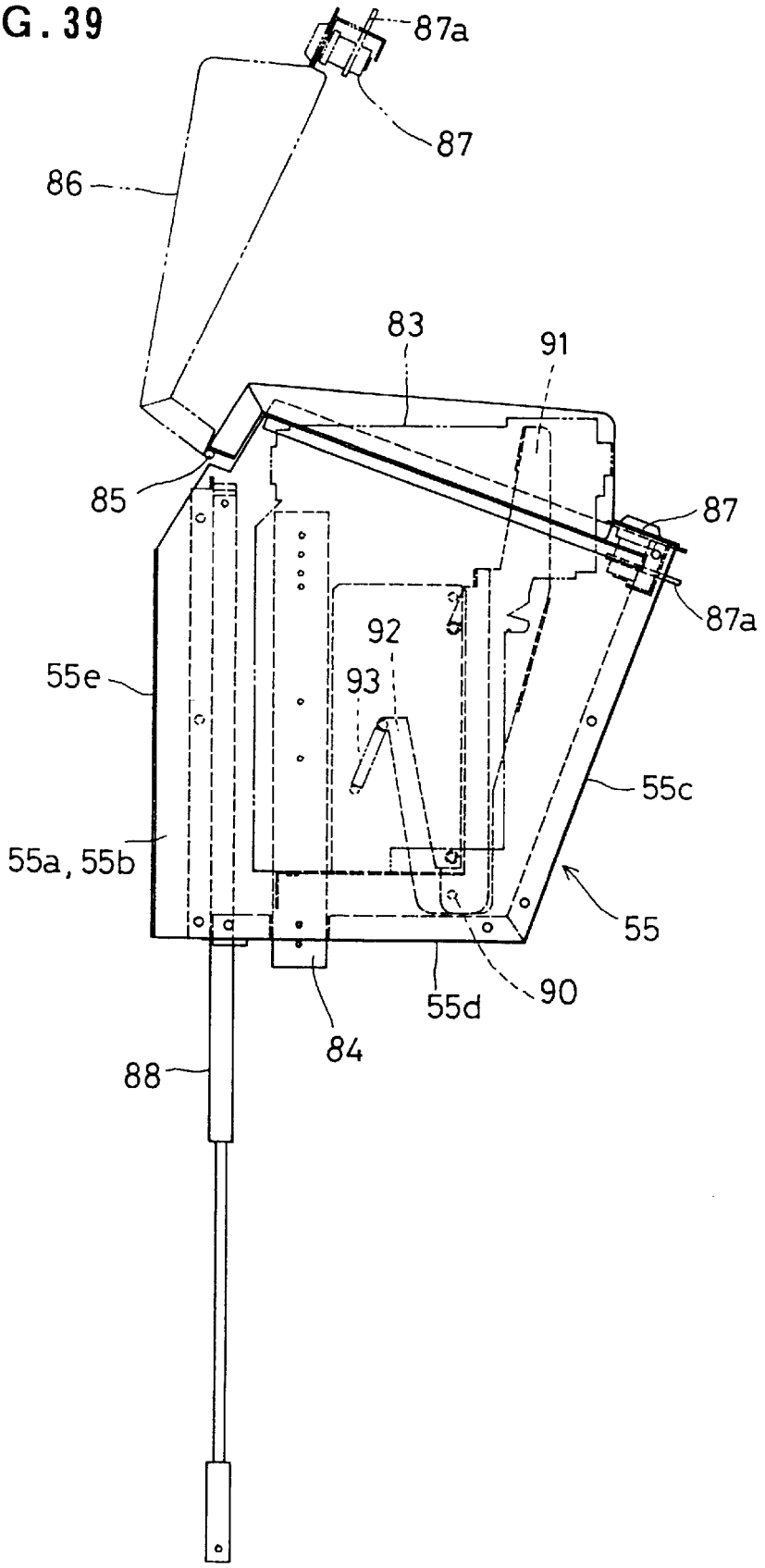
FIG. 39 is a left side view of a bill receiving apparatus.

The bill receiving case 83 is housed in the sealing box 55 of a modified pentagon in side view (FIGS. 24 to 26, 39). Between an inner surface of a left side plate 55*a* of the sealing box 55 and an outer surface of a left side plate 83*a* of the bill receiving case 83, and between an inner surface of a right side plate 55*b* of the sealing box 55 and an outer surface of a right side plate 83*b* of the bill receiving case 83 are interposed respective slide rails 84 (FIG. 39). The bill receiving case 83 can move up and down guided by the slide rails 84 to appear from and disappear in the sealing box 55.

Figure 43:
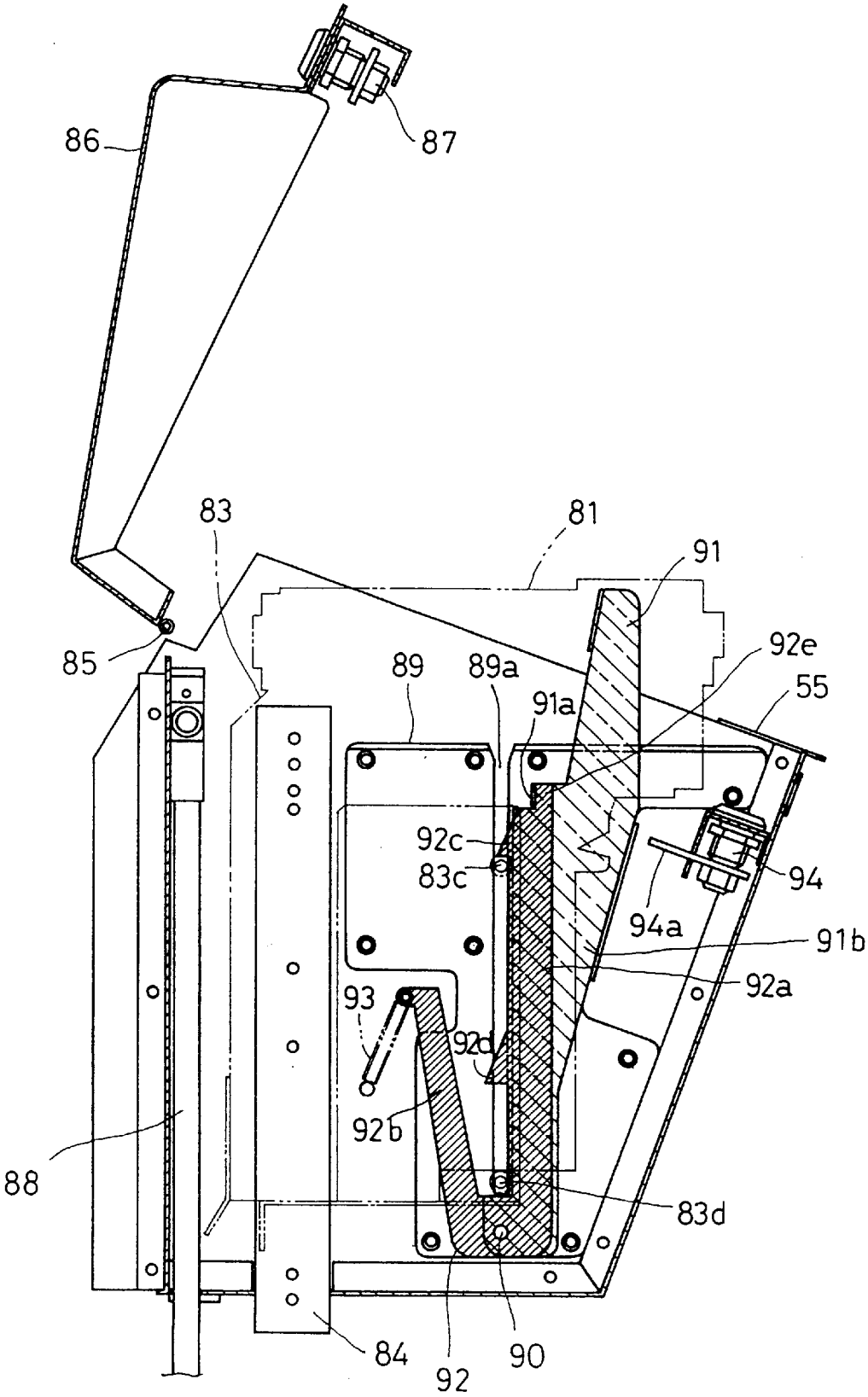
FIG. 43 is a sectional side view of the bill receiving case showing a state that a sealing cover is opened.
Figure 44:
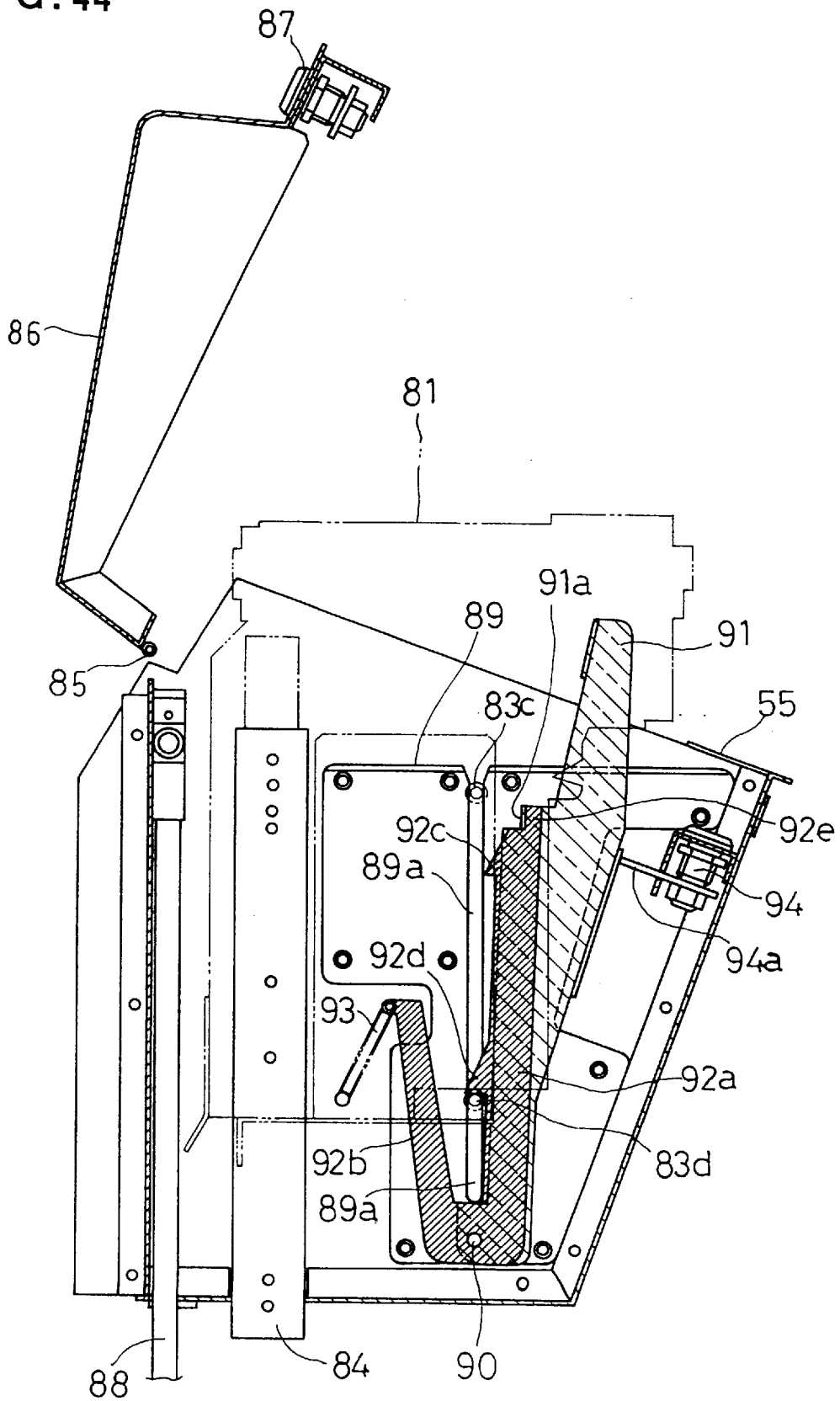
FIG. 44 is a sectional side view similar to FIG. 43 showing a state that the sealing cover is opened and a manipulative lever is pulled in front.
Figure 45:
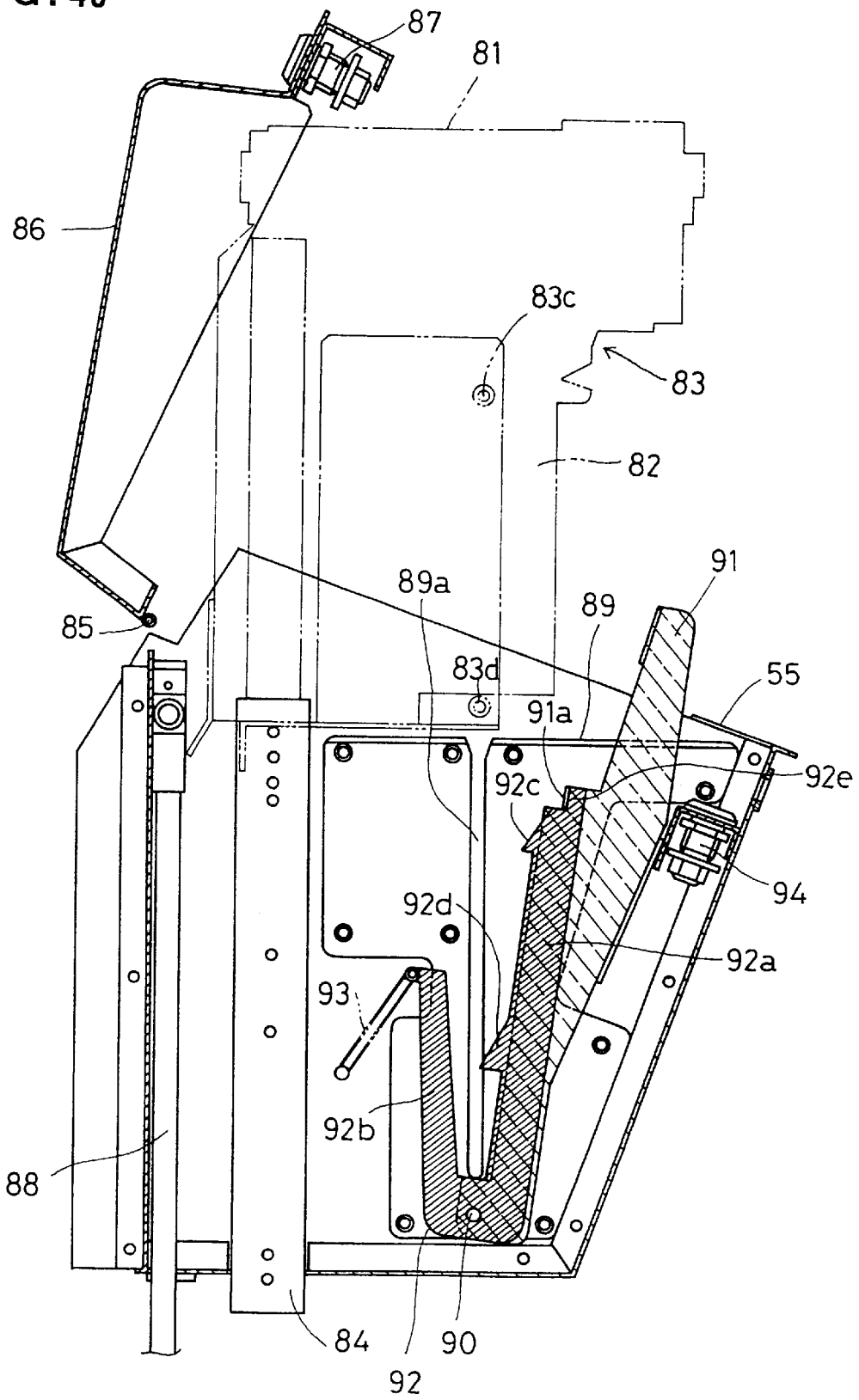
FIG. 45 is a sectional side view similar to FIG. 43 showing a state that the sealing cover is opened and the manipulative lever is pulled fully in front to unlock a locking mechanism.

The sealing box 55 has a front plate 55*c*, a bottom plate 55*d* and a rear plate 55*e*, besides the left and right side plates 55*a*, 55*b*. A sealing cover 86 is hinged on an upper end of the rear plate 55*e* by a cover hinge 58 which is coaxial with the hinge 58 of the top door 10. On a front portion of the sealing cover 86 is provided a locking mechanism 87. If the sealing cover 86 is opened upward after the locking mechanism 87 is unlocked by turning a key (not shown) inserted in the locking mechanism 87 to detach a retaining piece 87*a* of the locking mechanism 87 from a retaining hole (not shown) of the front plate 55*c* of the sealing box 55, an upper portion of the bill detecting unit 81 is exposed as shown in FIG. 43.

Within the sealing box 55 is provided a wind lifter 88 positioned at a rear side of the bill receiving case 83. A tip end of a wire veered out from the wind lifter 88 is connected to a rear bottom of the bill receiving case 83 so that the bill receiving case 83 can move up and down lightly by forcing energy of the wind lifter 88.

On the right side plate 55*b* of the sealing box 55 is integrally attached a guide plate 89 having a guide groove 89*a* formed vertically. On the right side plate 83*b* of the bill receiving case 83 are projected upper and lower guide pins 83*c*, 83*d* which can slide up and down in the guide groove 89*a* of the guide plate 89.

On the right side plate 55*b* of the sealing box 55 and the guide plate 89 is provided a shaft 90 projecting to the left, and a manipulative lever 91 and a lift limiting member 92 are pivoted on the shaft 90. A retaining piece 91*a* formed at a rear upper part of the manipulative lever 91 bent to the left engages with an upper rear edge 92*e* of a front piece 92*a* of the lift limiting member 92.

The lift limiting member 92 is formed in nearly J-shape comprising the front piece 92*a* and a rear piece 92*b*. Upper and lower retaining pawls 92*c*, 92*d* are formed on a rear edge of the front piece 92*a* and a tensile coil spring 93 is interposed between an upper end of the rear piece 92*b* and the guide plate 89. The coil spring 93 forces the lift limiting member 92 rearward, and the retaining pawls 92*c*, 92*d* projects over the guide groove 89*a* so as to engage with the guide pins 83*c*, 83*d* of the bill receiving case 83.

A locking mechanism 94 is provided on an upper portion of an inner surface of the front plate 55*c* of the sealing box 55, and a retaining piece 94*a* of the locking mechanism 94 is adapted to touch the front piece 91*b* of the manipulative lever 91.

Next, a guard apparatus 100 (FIG. 46) of the casino game machine 0 will be described.

The box-like game unit cabinet 9 has five doors, namely, the top door 10, the machine door 24, the cash box door 26, the sealing cover 86 of the bill receiving apparatus 13 and the closing plate 34 of the control unit case 18. The guard apparatus 100 watches opening and closing of the doors round the clock. Especially opening and closing of the cash box door 26 and the bill receiving apparatus 13 are important regarding the guard.

Figure 46:
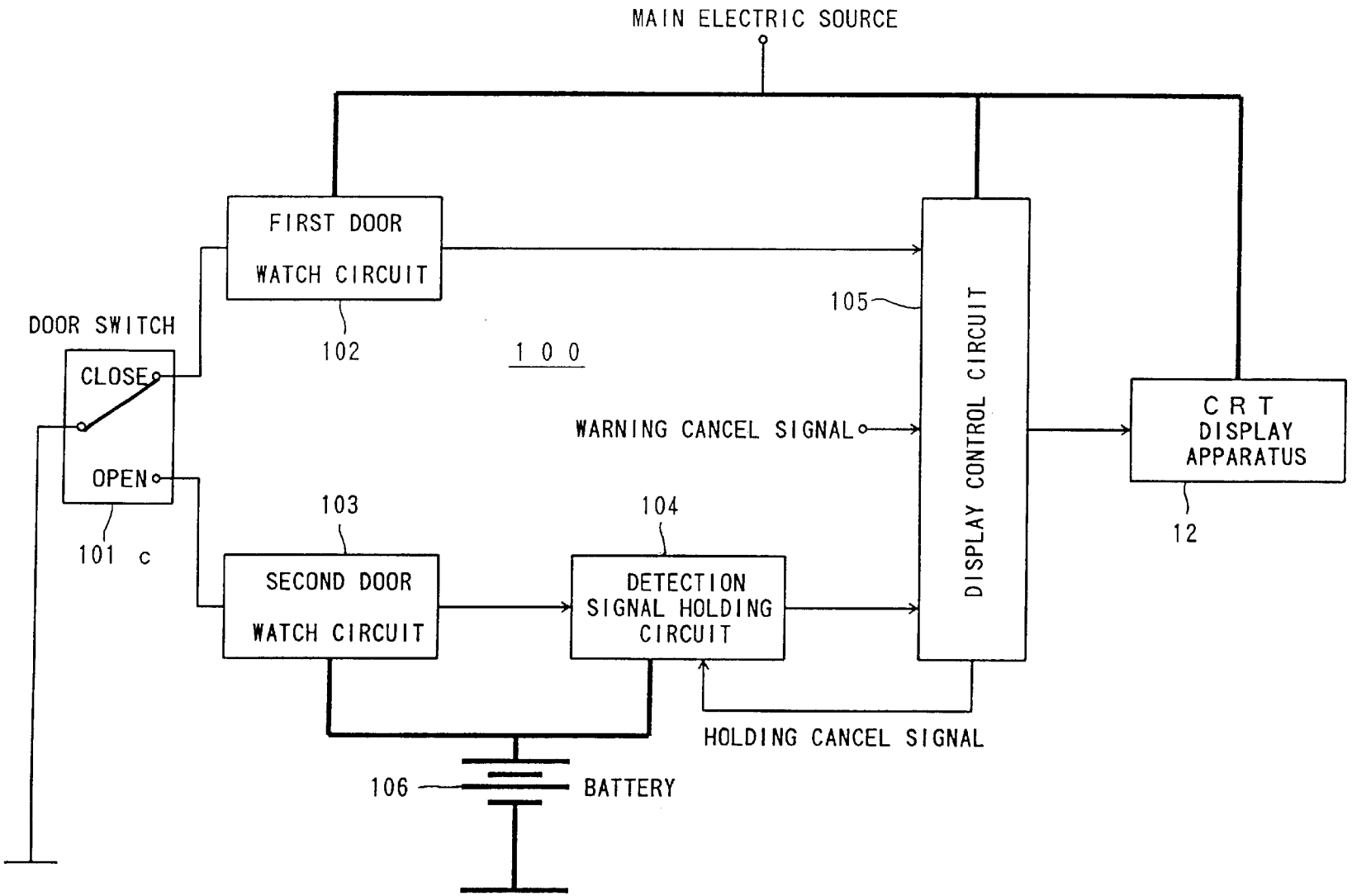
FIG. 46 is a diagram showing a general constitution of a guard apparatus of the casino game machine.

FIG. 46 shows a general constitution of the guard apparatus 100.

The doors 10, 24, 26, the sealing cover 86 and the closing plate 34 of the game unit cabinet 9 have respective door switches 101*a*, 101*b*, 101*c*, 101*d* and 101*e* for detecting opening and closing of the doors. In FIG. 46, only the door switch 101*c* is illustrated representatively but other door switches are also arranged in parallel.

The door switch 101*c* is a changing-over switch having a common grounded terminal a, a terminal b which short-circuits when the door is closed and a terminal c which short-circuits when the door is opened. The terminal b is connected to a first door watch circuit 102 for during electrification and the terminal c is connected to a second door watch circuit 103 for during electricity failure.

The first door watch circuit 102 watches opening-closing of the door switch 101*c* when the circuit 102 is electrified from a main electric source, and outputs a detection signal to a display control circuit 105 when the door switch 101*c* is in "open" state.

When supply of electricity from the main electric source is cut off, the second door watch circuit 103 watches opening-closing of the door using electric power of a battery 106 and outputs a detection signal to a detection signal holding circuit 104 if the door switch 101*c* is opened even once.

The detection signal holding circuit 104 acts using the electric power of the battery 106 and holds the detection signal from the circuit 103. The detection signal holding circuit 104 outputs a signal to the effect that the detection signal has been received to the display control circuit 105 and continues to output the same signal until a holding cancel signal is sent from the display control circuit 105.

The display control circuit 105 controls display of the above-mentioned CRT display apparatus 12.

The first door watch circuit for during electrification 102, the display control circuit 105, the CRT display apparatus 12 and other instruments in the game unit 2 act by electric power of the main electric source. On the one hand, the second door watch circuit for during electricity failure 103 and the detection signal holding circuit 104 act by the battery 106 so that even if the main electric source is cut off or electricity fails, the second door watch circuit 103 and the detection signal holding circuit 104 act surely to continue watching opening-closing of the five doors.

When electricity is transmitted from the main electric source, if any one of the doors opens and a detection signal is outputted from the first door watch circuit 102 to the display control circuit 105, the display control circuit 105 lets the CRT display apparatus 12 display "DOOR OPEN" in green.

On the one hand, when electricity from the main electric source is cut off, if any one of the doors opens and a detection signal is outputted from the second door watch circuit 103 to the detection signal holding circuit 104, the detection signal holding circuit 104 holds the detection signal and outputs a signal to the effect that the detection signal has been received to the display control circuit 105.

After that, when electricity is transmitted from the main electric source, the display control circuit 105 acts to receive an output signal from the detection signal holding circuit 104 and let the CRT display 12 display "DOOR OPEN" in red specially for warning.

By this warning, it is known that at least one door was opened during electricity failure.

If a warning cancel signal is outputted to the display control circuit 105, the display control circuit 105 stops the red display "DOOR OPEN" and outputs a holding cancel signal to the detection signal holding circuit 104 to stop signal output therefrom.

Figure 47:
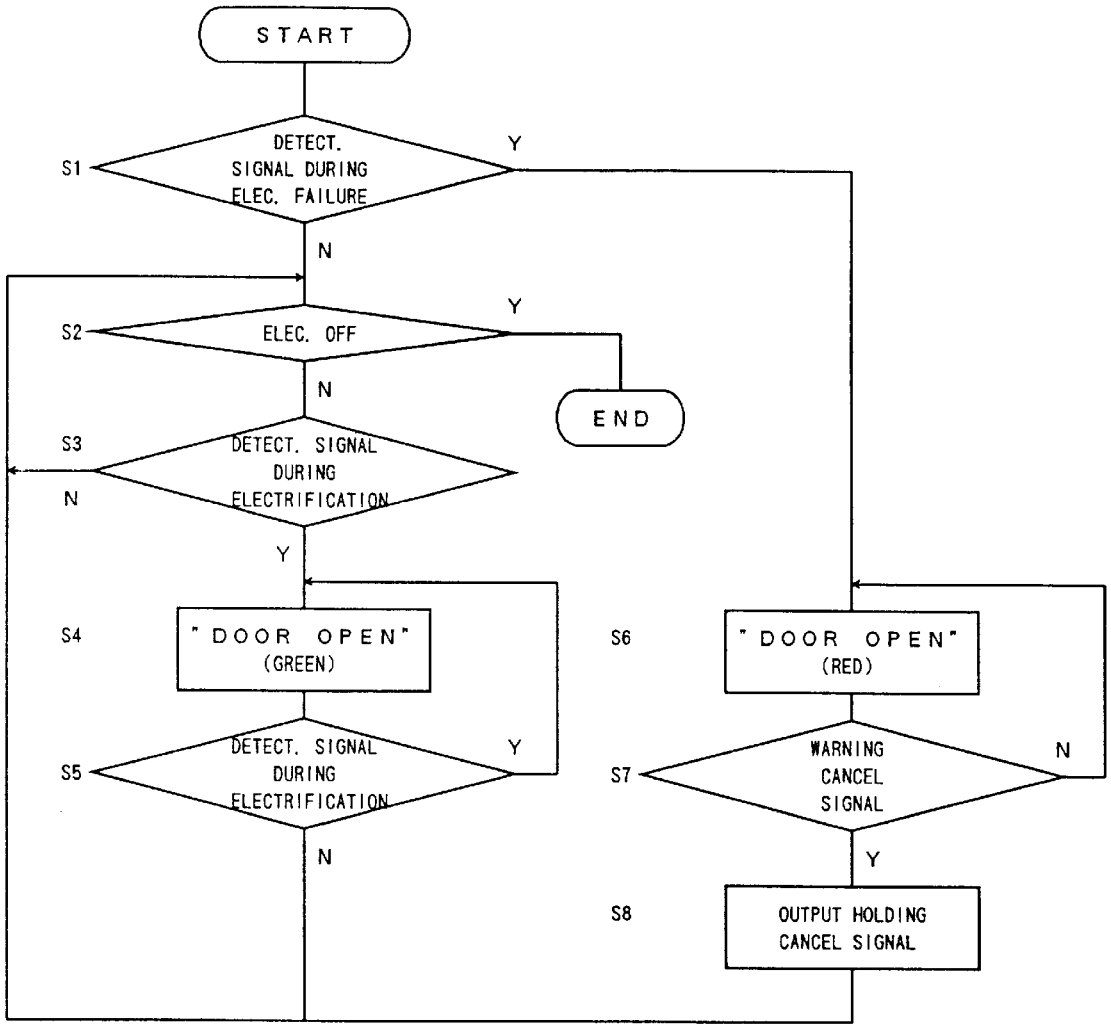
FIG. 47 is a flow chart showing a operation procedure of display control in a display control circuit of the guard apparatus.

FIG. 47 shows operation procedure of the CRT display apparatus 12 by the above-mentioned display control circuit 105.

When electricity is transmitted from the main electric source to start, it is judged at Step 1 whether or not there was a detection signal during electricity failure (the detection signal from the detection signal holding circuit 104), and if there was not the detection signal during electricity failure, the flow advances to Step 2 where it is judged whether or not electricity is off. If electricity is off, the flow ends, and if electricity is on, the flow advances to Step 3.

At Step 3, presence of detection signal during electrification (the detection signal from the detection signal holding circuit 104) is judged. If the detection signal during electrification is not present, the flow returns to Step 2, and if the detection signal during electrification is present, the flow advances to Step 4 to let the CRT display apparatus 12 display "DOOR OPEN" in green. Then, at Step 5, presence of the detection signal during electrification is judged again, and as far as the detection signal is present continuously, the flow returns to Step 4 to maintain the green display "DOOR OPEN". When the door is closed and the detection signal during electrification disappears, the flow returns to Step 2 and the display is stopped.

On the one hand, when it is judged at Step 1 that a detection signal during electricity failure is present, the flow jumps to Step 6 to let the CRT display apparatus display "DOOR OPEN" in red.

Until a cancel signal appears at Step 7, Step 6 is repeated to maintain the red display "DOOR OPEN". When the cancel signal appears at Step 7, the flow advances to Step 8 to stop the display and output a holding cancel signal to the detection signal holding circuit 104, then jumps to Step 2.

As mentioned above, if at least one of the five doors opens, the green display "DOOR OPEN" is expressed for enabling to confirm present state of doors. Therefore, it can be prevented that a door is left opening by mistake, and even if a door is opened forcibly it can be detected soon.

If any one door is opened during electricity failure, the red warning display "DOOR OPEN" is expressed on the game unit 2 when electricity is transmitted next. Therefore, it can be known whether or not a door has been opened during the electricity failure.

Thus, the guard apparatus 100 can watch opening-closing of the doors round the clock.

Even during electricity failure, the watch can be carried out using a minimum electric power of the battery 106.

According to the guard apparatus 100, the display shows that at least one of the five doors opens, however, the watch circuit during electrification 102 and the detection signal holding circuit 104 may output signals corresponding to opening-closing of the five doors respectively so that the CRT display apparatus 12 can express different displays enabling to distinguish an opened door from other doors.

Lamps of different colors may be used in place of the CRT display apparatus 12.

Figure 15:
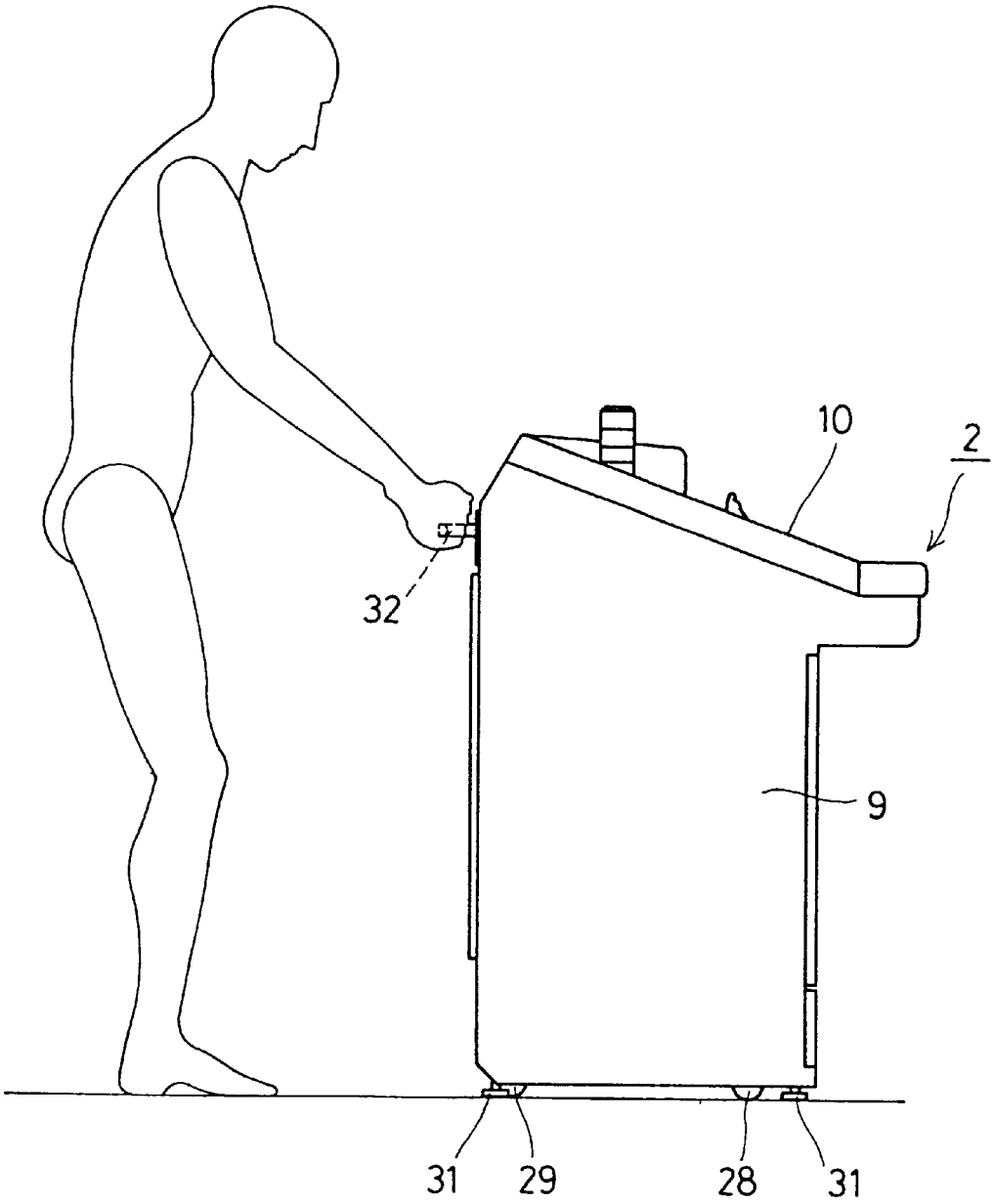
FIG. 15 is a left side view showing the game unit being moved.

Since the box-like game unit 2 is constructed as described above, even if the machine door 24 is deformed into a parallelogram with the right side descending compared to the left side near the hinge 23 by its own weight, when the machine door closes, the right side is raised by the machine door guide piece 25 to reform the machine door 24 into a rectangle, so that the lower edge of the machine door guide piece 25 is held in parallel with the upper edge of the cash box door 26. Therefore, the machine door 24 and the cash box door 26 can open and close smoothly. Since the game unit cabinet 9 has casters 28 provided at both right and left ends on the front side of the bottom plate 9*e* and the wheels 29 provided at both right and left ends on the rear side of the bottom plate 92 as shown in FIGS. 14 to 16, the game unit cabinet 9 on a floor can be moved toward required directions stably and easily.

Figure 16:
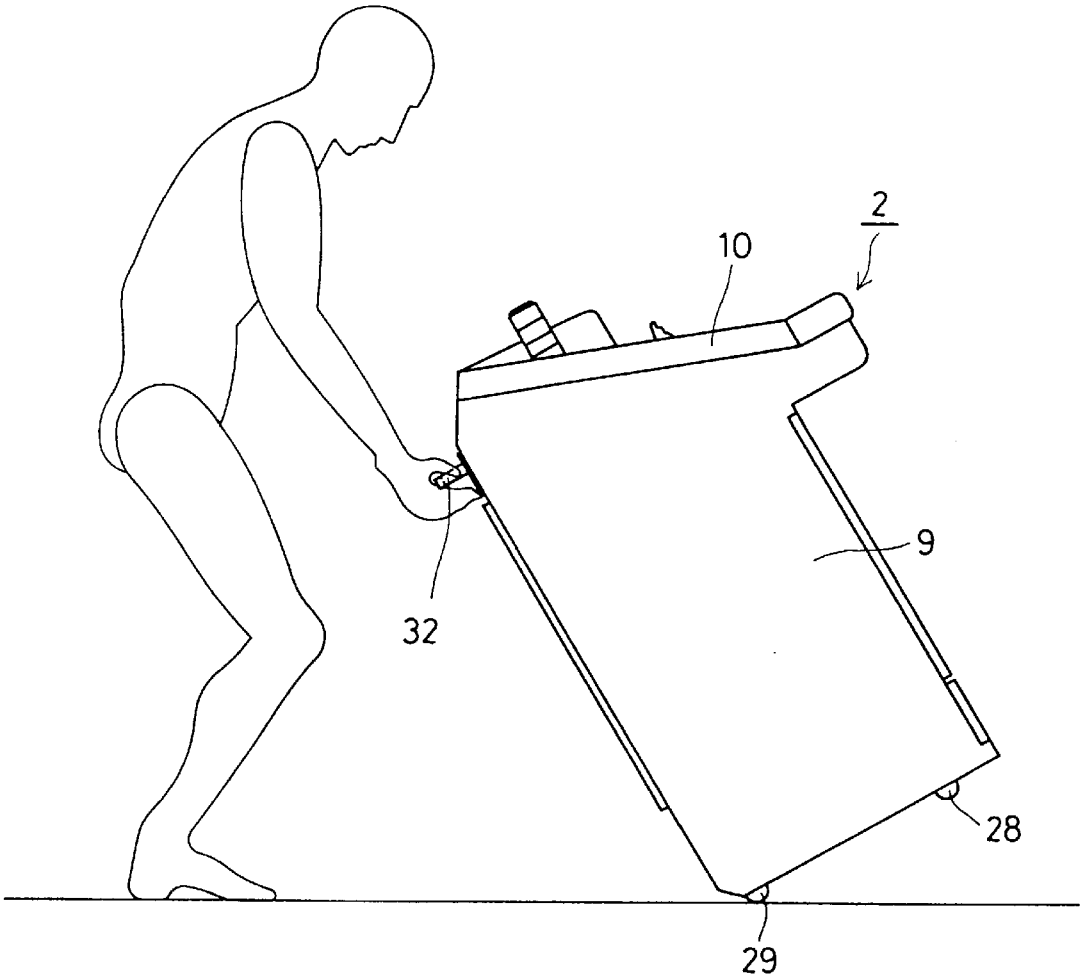
FIG. 16 is a left side view showing the game unit being inclined.

When there is a step on the floor, one may hold the grip handle 32 provided on the back plate 9*a* of the game unit cabinet 9 to incline the cabinet 9 backward as shown in FIG. 16 and move it maintaining the inclined posture. Thus, the game unit cabinet 9 can be carried getting over the step by only one person easily.

When a coin falls down between the casino game machine main 1 and the game unit 2 or between neighboring game units 2, the coin can be recovered easily by moving only a necessary game unit cabinet 9 forward irrespective of other game unit 2.

When it is wanted to fix the game unit cabinet 9 on the floor, the fixing stud bolt 31 can be stretched down to support the game unit cabinet 9 by the stud bolt 31.

As shown in FIG. 9, the flat parallelepiped control unit case 18 is positioned in a narrow space within the game unit cabinet 9 formed between the left side plate 9*c* of the cabinet 9 and the CRT display apparatus 12 as well as the electric power unit 16. Therefore, space within the game unit cabinet 9 is utilized effectively and miniaturization of the game unit cabinet 9 is possible.

Since the sliding member 37 integral with the left side plate 18*c* of the control unit case 18 is slidably fitted to the guide rail 36 attached to the left side plate 9*c* of the game unit cabinet 9, the control unit case 18 can be easily raised by means of the grip 38 when the top door 10 is opened, so that the control unit case 18 can be easily taken out of the game unit cabinet 9.

Since many ventilation holes 47 are formed in the left side plate 18*c* and the top plate 18*d* of the control unit case 18, air can smoothly flow through the control unit case 18 to cool various electronic parts in the control unit case 18 sufficiently.

The control substrate 33 can be easily taken out by unlocking the locking mechanism 44, releasing the adhering hold member and pulling the grip 43. Therefore, necessary repair and maintenance of the control substrate 33 can be carried out easily.

Since weight of the top door 10 is supported by the gas cylinder 51, the top door 10 can be opened and closed lightly.

Immediately before the top door 10 is closed completely when downward moment of the top door 10 is considerably increased, the top door 10 is supported by the oil damper 57 having a resistant force larger than the spring force of the gas cylinder 51, so that the top door can be closed quietly without a violent collision against the game unit cabinet 9.

Even if a player standing just in front of the game unit 2 or resting his elbows on the armrest for playing spills a drink such as a juice by mistake on the CRT display apparatus 12, the drink is intercepted by the touch panel 62 covering the display surface 12*a* of the CRT display apparatus 12, and guided onto the top door 10 or into the liquid receiving trough member 60 by the frame member 64 so as not to invade the CRT display apparatus 12, the electric power unit 16, the coin pay-back apparatus 17, the control unit case 18, the coin inspecting apparatus 19 and the like in the game unit cabinet 9. Thus, trouble or damage of the above-mentioned apparatuses can be prevented.

The drink flowing into the liquid receiving trough member 60 is guided to the liquid receiving saucer 66 through the communication pipe 65 and stored in the liquid receiving saucer 66 which can be easily taken out for disposal of the drink by opening the top door 10.

In that case, it is necessary to open only the top door 10 and the machine door 24 need not be opened, so that the player can continue the game standing in front of the game unit cabinet 9 watching the CRT display apparatus 12.

Adjustment of closing position of the top door 10 is carried out as follows. After the nut 77 (FIGS. 35, 36) is released in a state that the top door 10 is opened, the adjust screw 79 is turned by a driver engaged with a diametric groove provided on a lower end of the adjust screw 79 to raise or lower the channel-like rise and fall piece 74 relatively to the channel-like attachment member 73.

After the adjustment, the nut 77 is tightened again to firmly fix the rise and fall piece 74 to the attachment member 73 for maintaining the adjusted state.

Even if the top door 10 is closed and opened many times during the above adjustment work by the adjust screw 79 and forces are applied to the adjust screw 79, because the adjust screw 79 is engaged with the nut 78 integral with the rise and fall member 74, the member 74 is not moved relatively to the member 73 so much and the member 74 can hold its position. Therefore, the adjustment work can be carried out divided in many steps to ensure a proper adjustment of closing position of the top door 10.

The bill receiving apparatus 13 is sealed by the sealing box 55 and the sealing cover 56 irrespective of opening-closing of the top door 10, therefore, even if maintenance or modification of instruments other than the bill receiving apparatus 13 such as the CRT display apparatus 12, the coin return section 14, the electric power unit 16, the coin pay-back apparatus 17 and the control unit case 18, is carried out with the top door 10 opened, there is no fear that bills in the bill receiving apparatus 13 are stolen.

Since the hinge 58 of the top door 10 and the cover hinge 85 of the sealing cover 86 are arranged on the same axis, the top door 10 and the sealing cover 86 can be opened and closed separately without interfering with each other.

If a serviceman for repair, maintenance and inspection of the bill receiving apparatus 13 inserts a private key into the locking mechanism 87 to unlock it and opens the sealing cover 86 upward as shown in FIG. 43, an upper portion of the bill detecting unit 81 is exposed so that bills clogging in a bill feed mechanism provided in the upper portion for feeding bills from front toward rear can be removed easily.

If the manipulative lever 91 is pulled forward, the lift limiting member 92 interlocked with the lever 91 rocks clockwise, the upper retaining pawl 92*c* is disconnected from the guide pin 83*c* of the bill receiving case 83, the case 83 goes up forced by the wind lifter 88, the guide pin 83*d* of the case 83 is retained by the retaining pawl 92*d* of the lift limiting member 92, and only the bill detecting unit 81 is exposed above the sealing box 55. As a result, the bill detecting unit 81 can be taken out from the bill receiving case 83 by pulling forward only the bill detecting unit 81 relatively to the bill storing unit 82 for repair and inspection of the bill detecting unit 81.

An administrator of the casino game machine 0 has both keys for the locking mechanisms 87, 94. When the locking mechanisms 87, 94 are unlocked, the manipulative lever 91 can be rocked further forward. As the result, the lower retaining pawl 92*d* is disconnected from the guide pin 83*d* of the bill receiving case 83 and the case 83 goes up forced by the wind lifter 88 up to the upper limit position, so that the bill storing unit 82 can be removed from the bill receiving case 83 to take out bills in the bill storing unit 82.

As mentioned above, the bill receiving apparatus 13 is provided with two locking mechanisms 87, 94, the serviceman has only a key for the locking mechanism 87 and the administrator of the casino game machine 0 has two kinds of keys for the locking mechanisms 87, 94. Therefore, it is prevented that the serviceman takes out bills in the bill storing unit 82 in the course of repair.

In the above embodiment shown in the drawings, the present invention is applied to the casino game machine, however, the present invention is also applicable to a horse race game machine, a boat race game machine or any other game machines.

What is claimed is:

1. A game unit to be arranged outside of and adjacently to a game machine, comprising:

a game unit cabinet of box-shape having a front face and a top face;

a display instrument housed in said game unit cabinet having a display surface for displaying at least progress of game, bet rate, result of game, and allotment, said display surface being disposed on said top face of said game unit cabinet upward;

a top door provided at said top face of said game unit cabinet substantially on the same surface as said display surface so as to be opened upward;

a machine door hinged on a side of said front face of said game unit cabinet by a hinge so as to be opened in front;

a narrow flat space formed between said display instrument and a side wall of said game unit cabinet near said hinge within said game unit cabinet; and a control unit case in shape of a flat parallelepiped disposed in said flat space in an erect posture, said control unit case moving up and down in said flat space to be detachably housed in said flat space from above when said top door is opened and said control unit case comprising electronic control parts for communicating with said game machine.

2. A game unit as claimed in claim 1, wherein said top door is formed with an opening for said display instrument which is fitted to a circumference of said display instrument.

3. A game unit as claimed in claim 1 or 2, wherein a vertical guide rail is provided on an inner surface of said side wall of said game unit cabinet near said hinge, and a slide member going up and down guided by said guide rail is provided on an outer surface of said control unit case.

4. A game unit as claimed in claim 3, wherein a handle for pulling up said control unit case against its weight is provided at a top of said control unit case.

5. A game unit to be arranged outside of and adjacently to a game machine; comprising:

a game unit cabinet of box-shape having a front face and a top face;

a display instrument housed in said game unit cabinet having a display surface for displaying at least progress of game, bet rate, result of game, and allotment, said display surface being disposed on said top face of said game unit cabinet upward;

a top door provided at said top face of said game unit cabinet substantially on the same surface as said display surface so as to be opened upward;

a machine door hinged on a side of said front face of said game unit cabinet by a hinge so as to be opened in front;

a narrow flat space formed between said display instrument and a side wall of said game unit cabinet near said hinge within said game unit cabinet;

a control unit case in shape of a flat parallelepiped disposed in said flat space in an erect posture;

a control substrate with electronic control parts for communicating with said game machine housed in said control unit case;

an opening formed in a front face of said control unit case for taking in and out said control substrate along a flat face of said control unit case; and a closing member formed on a front edge of said control substrate integrally for closing said opening when said control substrate is housed in said control unit case.

6. A game unit as claimed in claim 5, wherein grooves of V-shape in plan are formed at respective upper and lower parts on a rear side in said control unit case, for holding respective upper and lower edges on a rear side of said control substrate.

7. A game unit as claimed in claim 5 or 6, wherein a locking mechanism for maintaining said control substrate housed in said control unit case is provided.

8. A game unit to be arranged outside of and adjacently to a game machine; comprising:

a game unit cabinet of box-shape having a front face and a top face;

a display instrument housed in said game unit cabinet having a display surface for displaying at least progress of game, bet rate, result of game, and allotment, said display surface being disposed on said top face of said game unit cabinet upward;

a top door provided at said top face of said game unit cabinet substantially on the same surface as said display surface so as to be opened upward;

a liquid receiving trough member surrounding and adhered to said display instrument;

a liquid receptacle detachably provided in said game unit cabinet positioned under said liquid receiving trough member and said top door closed; and a pipe connecting a lowermost part of said liquid receiving trough member with said liquid receptacle.

9. A game unit as claimed in claim 8, wherein said liquid receptacle is disposed just under said closed top door.

10. A game unit as claimed in claim 8 or 9, wherein said display surface of said display instrument is inclined so as to lower toward front from rear.

11. A game unit to be arranged outside of and adjacently to a game machine, comprising:

a game unit cabinet of box-like having a front face and a top face;

a display instrument housed in said game unit cabinet having a display surface for displaying at least progress of game, bet rate, result of game, and allotment, said display surface being disposed on said top face of said game unit cabinet;

a top door provided at said top face of said game unit cabinet substantially on the same surface as said display surface so as to be opened upward;

a machine door hinged on a side of said front face of said game unit cabinet by a hinge so as to be opened in front; and a door guide piece formed along a lower edge of said machine door gently curved upward toward rear, said door guide piece coming into sliding contact with a middle bottom member of said game unit cabinet adjacent to a lower edge of said machine door when said machine door is opened and closed.

12. A game unit as claimed in claim 11, wherein an opening and closing member other than said machine door is provided under and adjacently to said machine door so as to be opened in front.

13. A game unit to be arranged outside of and adjacently to a game machine, comprising:

a game unit cabinet of box-like having a front face and a top face;

a display instrument housed in said game unit cabinet having a display surface for displaying at least progress of game, bet rate, result of game, and allotment, said display surface being disposed on said top face of said game unit cabinet;

a top door provided at said top face of said game unit cabinet substantially on the same surface as said display surface so as to be opened upward;

a gas spring having both ends respectively connected to said game unit cabinet and said top door; and an oil buffer mechanism provided on said game unit cabinet so as to be contacted with said top door when said top door is on or near a closing position thereof.

14. a game unit as claimed in claim 13, wherein said top door is hinged on a rear edge of said game unit cabinet so as to open upward and close downward.

15. A game unit to be arranged outside of and adjacently to a game machine, comprising:

a game unit cabinet of box-shape having a front face and a top face;

a display instrument housed in said game unit cabinet having a display surface for displaying at least progress of game, bet rate, result of game, and allotment, said display surface being disposed on said top face of said game unit cabinet upward;

a bill receiving apparatus positioned on one side of said display instrument;

a top face member of said game unit cabinet covering upper surfaces of said display instrument and said bill receiving apparatus having an opening through which an upper portion of said bill receiving apparatus is exposed;

a lid member for opening and shutting said opening; and a locking mechanism for locking said lid member.

16. A game unit as claimed in claim 15, wherein a rear edge of said lid member is hinged on said game unit cabinet so as to be opened upward.

17. A game unit as claimed in claim 16, wherein said top face member of said game unit cabinet and said lid member open and close about a common pivotal axis.

18. A game unit as claimed in claim 15, 16 or 17, wherein said bill receiving apparatus has a lifting mechanism by which said bill receiving apparatus can be lifted for repair, maintenance, inspection and the like when said lid member is opened upward.

19. A game unit as claimed in claim 15, 16 or 17, wherein said bill receiving apparatus comprises an upper bill inspecting section and a lower bill storing section which are separable from each other.

20. A game unit as claimed in claim 18, wherein said bill receiving apparatus comprises an upper bill inspecting section and a lower bill storing section and is lifted in two steps by said lifting mechanism to have two lift positions of which a second lift position can be taken by unlocking a locking mechanism other than said locking mechanism of said lid member, thereby said bill inspecting section can be separately taken out from said game unit cabinet at a first lift position of said bill receiving apparatus, and said bill storing section can be separately taken out from said game unit cabinet at said second lift position of said bill receiving apparatus.

21. A game unit to be arranged outside of and adjacently to a game machine, comprising:

a game unit cabinet of box-shape having a front face and a top face;

a display instrument housed in said game unit cabinet having a display surface for displaying at least progress of game, bet rate, result of game, and allotment, said display surface being disposed on said top face of said game unit cabinet upward;

a handle provided on a rear face of said game unit cabinet;

a plurality of wheels provided on a bottom face near said rear face of said game unit cabinet so as to roll in front and in the rear; and a caster provided on a bottom face near said front face of said game unit cabinet so as to roll in every direction.

22. A game unit to be arranged outside of and adjacently to a game machine, comprising:

a game unit cabinet of box-shape having a front face and a top face;

a display instrument housed in said game unit cabinet having a display surface for displaying at least progress of game, bet rate, result of game, and allotment, said display surface being disposed on said top face of said game unit cabinet upward;

a top door provided at said top face of said game unit cabinet substantially on the same surface as said display surface so as to be opened upward;

a channel-like attachment member fixed to said top door or said game unit cabinet;

a rise and fall member fitted to said attachment member so as to rise and fall;

an adjust screw provided between said rise and fall member and said top door or said game unit cabinet;

an engage member fixed to said rise and fall member; and a hook member detachably engaging with said engage member provided on said game unit cabinet or said top door.

23. A game unit as claimed in claim 22, wherein said hook member is combined with a locking means so as to be disconnected from said engage member when said locking means is unlocked.

24. A guard apparatus of a game unit having a game unit cabinet, comprising:

a door switch for detecting opening-closing of a door provided in said game unit cabinet;

a display means for displaying information of opening-closing of said door, a first watch means for watching state of said door switch when electricity is transmitted from a main electric source;

a second watch means for watching state of said door switch when electricity from aid main electric source is cut off;

a signal holding means for holding a detection signal when said second watch means detects opening of said door switch to generate said detection signal;

a battery for supplying said second watch means and said signal holding means with electric power; and a display control means for letting said display means display a special display in case that said signal holding means holds said detection signal when electricity is transmitted from said main electric power.

25. A guard apparatus as claimed in claim 24, wherein said game unit cabinet has a plurality of doors provided with respective said door switches, and said first and second watching means watch states of said door switches.

26. A game machine wherein a plurality of game units as claimed in any one of claims 1, 5, 8, 11, 13, 15, 21, 22 or 24 is arranged around said game machine.

27. A game unit to be arranged outside of and adjacently to a game machine, comprising:

a game unit cabinet of box-shape having a front face and a top face;

a display instrument housed in the game unit cabinet and having a display surface for displaying process of a game, a bet rate, result of the game and allotment, said display surface being disposed to face upward on said top face of the game unit cabinet;

a control unit case in the shape of a flat parallelepiped disposed within the game unit cabinet at a position between said display instrument and a side wall of the game unit cabinet;

a top door provided at said top face of the game unit cabinet substantially on a same plane as said display surface so as to be openable upward, said top door having an opening in which said display surface is fitted when the top door is closed and being sized to lie above said control unit case; and said control unit case being supported vertically and slidably within the game unit cabinet so that when the top door is opened, the control unit case can be inserted downwardly into, and taken upwardly out of, the game unit cabinet.

28. The game unit as claimed in claim 27, further comprising a machine door disposed on said front face of the game unit cabinet, said machine door opening and closing and providing access to an interior of said game unit cabinet.

29. The game unit as claimed in claim 28, wherein said machine door is attached to a side of said front face of the game unit cabinet with a hinge so as to be openable on said front face, said control unit case being disposed adjacent to said hinge.

* * * * *